US011839279B2

(12) United States Patent
Wulff et al.

(10) Patent No.: US 11,839,279 B2
(45) Date of Patent: Dec. 12, 2023

(54) MAGNETICALLY ATTACHABLE WALLET

(71) Applicant: Apple Inc., Cupertino, CA (US)

(72) Inventors: Timothy C. Wulff, Santa Clara, CA (US); Yang Zhou, San Jose, CA (US); James C. Wu, Redwood City, CA (US); Tao Pan, San Jose, CA (US); Leon Zilun Zhang, Mountain View, CA (US); Geng Luo, Santa Clara, CA (US)

(73) Assignee: Apple Inc., Cupertino, CA (US)

( * ) Notice: Subject to any disclaimer, the term of this patent is extended or adjusted under 35 U.S.C. 154(b) by 107 days.

(21) Appl. No.: 17/223,690

(22) Filed: Apr. 6, 2021

(65) Prior Publication Data

US 2022/0087389 A1 Mar. 24, 2022

Related U.S. Application Data

(60) Provisional application No. 63/081,833, filed on Sep. 22, 2020.

(51) Int. Cl.
*A45C 13/10* (2006.01)
*H01F 7/02* (2006.01)
(Continued)

(52) U.S. Cl.
CPC ..... *A45C 13/1069* (2013.01); *A45C 11/182* (2013.01); *H01F 7/02* (2013.01); *A45C 2011/002* (2013.01); *A45C 2011/003* (2013.01)

(58) Field of Classification Search
CPC ..... A45C 13/1069; A45C 11/182; A45C 2011/002; A45C 2011/003; A45C 2011/186; H01F 7/02; H01F 7/0252
See application file for complete search history.

(56) References Cited

U.S. PATENT DOCUMENTS 5,740,624 A * 4/1998 Baseley ..... A45C 11/182 40/27.5
6,888,940 B1 5/2005 Deppen
(Continued)

FOREIGN PATENT DOCUMENTS

CN 104467129 A 3/2015
CN 205670700 U 11/2016
(Continued)

OTHER PUBLICATIONS

Shanshui Magsafe Wallet: https://www.amazon.com/SHANSHUI-Magnetic-Compatible-Magsafe-Stretchy/dp/B09LM7J6Z5/ref (Year : 2021).*
(Continued)

*Primary Examiner* — John K Fristoe, Jr.
*Assistant Examiner* — Justin Caudill
(74) *Attorney, Agent, or Firm* — KILPATRICK TOWNSEND & STOCKTON, LLP

(57) ABSTRACT

Accessories that can add new functionality to an electronic device. These accessories can provide additional functionality that allow for the replacement of a physical object that would otherwise be carried in addition to and separate from the electronic device. These accessories can further provide improvements, such as a reduction in size or improvement in functionality over the physical object to be replaced.

20 Claims, 44 Drawing Sheets

(51) Int. Cl.
*A45C 11/18* (2006.01)
*A45C 11/00* (2006.01)

(56) References Cited

U.S. PATENT DOCUMENTS

| | | | | |
|---|---|---|---|---|
| 7,530,499 | B2 * | 5/2009 | Osborn | G06K 19/077 235/486 |
| 7,918,335 | B1 * | 4/2011 | Kitchen | A45C 11/18 150/132 |
| 8,073,324 | B2 | 12/2011 | Tsai | |
| 8,558,411 | B2 | 10/2013 | Baarman | |
| 8,688,037 | B2 | 4/2014 | Chatterjee et al. | |
| 8,798,675 | B2 * | 8/2014 | Salmon | H04M 1/724 455/418 |
| 8,878,637 | B2 * | 11/2014 | Sartee | H01F 41/00 361/679.01 |
| 8,907,752 | B2 | 12/2014 | Wodrich et al. | |
| 8,912,686 | B2 | 12/2014 | Stoner et al. | |
| 9,038,971 | B1 | 5/2015 | Guthrie | |
| 9,106,083 | B2 | 8/2015 | Partovi | |
| 9,112,364 | B2 | 8/2015 | Partovi | |
| 9,413,191 | B2 | 8/2016 | Kim et al. | |
| 9,627,130 | B2 | 4/2017 | Golko et al. | |
| 9,642,293 | B2 * | 5/2017 | Duthilleul | H01Q 1/245 |
| 9,654,165 | B2 * | 5/2017 | Cho | H04B 1/3888 |
| 9,977,205 | B2 | 5/2018 | Williams et al. | |
| 10,153,666 | B2 | 12/2018 | Lee et al. | |
| 10,210,975 | B1 * | 2/2019 | Ji | H01F 7/0205 |
| 10,243,402 | B2 | 3/2019 | Park et al. | |
| 10,273,942 | B2 | 4/2019 | Nakamura | |
| 10,292,514 | B1 * | 5/2019 | Kuhn | B63B 17/00 |
| 10,404,089 | B2 | 9/2019 | Kasar et al. | |
| 10,418,839 | B2 | 9/2019 | Miller | |
| 10,420,403 | B1 * | 9/2019 | Calder | A45C 1/06 |
| 10,491,041 | B2 | 11/2019 | Wittenberg et al. | |
| 10,595,611 | B2 * | 3/2020 | Berkley | A45C 13/005 |
| 10,622,842 | B2 | 4/2020 | Lee et al. | |
| 11,342,800 | B2 | 5/2022 | Oro et al. | |
| 2009/0212637 | A1 | 8/2009 | Baarman et al. | |
| 2009/0278642 | A1 | 11/2009 | Fullerton et al. | |
| 2010/0081377 | A1 | 4/2010 | Chatterjee et al. | |
| 2011/0192857 | A1 * | 8/2011 | Rothbaum | F16M 11/041 248/220.21 |
| 2012/0068942 | A1 * | 3/2012 | Lauder | G06F 1/1601 361/679.01 |
| 2012/0112553 | A1 | 5/2012 | Stoner, Jr. et al. | |
| 2012/0146576 | A1 | 6/2012 | Partovi | |
| 2012/0146752 | A1 * | 6/2012 | Fullerton | H05K 9/00 335/306 |
| 2012/0306440 | A1 | 12/2012 | Yeh | |
| 2013/0037187 | A1 * | 2/2013 | D'Amore | A45C 15/00 150/147 |
| 2013/0099730 | A1 | 4/2013 | Yoon | |
| 2013/0113423 | A1 | 5/2013 | Baarman | |
| 2013/0187596 | A1 | 7/2013 | Eastlack | |
| 2013/0260677 | A1 | 10/2013 | Partovi | |
| 2013/0329360 | A1 * | 12/2013 | Aldana | G06F 1/1626 361/679.01 |
| 2014/0242429 | A1 | 8/2014 | Lee | |
| 2015/0325352 | A1 * | 11/2015 | Lowe | H01F 7/0247 224/191 |
| 2016/0094076 | A1 | 3/2016 | Kasar et al. | |
| 2016/0105047 | A1 | 4/2016 | Cui | |
| 2016/0106202 | A1 * | 4/2016 | Ford | H04N 19/103 224/267 |
| 2016/0128210 | A1 | 5/2016 | Lee | |
| 2016/0206065 | A1 * | 7/2016 | Ehrlich | A45C 1/06 |
| 2016/0277841 | A1 * | 9/2016 | Slotte | H04R 9/025 |
| 2016/0373152 | A1 * | 12/2016 | Schmidt | F16M 11/105 |
| 2017/0005399 | A1 | 1/2017 | Ito et al. | |
| 2017/0040665 | A1 * | 2/2017 | Takashima | H01Q 1/2225 |
| 2017/0070076 | A1 | 3/2017 | Karanikos | |
| 2017/0086523 | A1 * | 3/2017 | Miller | A45F 3/02 |
| 2017/0223878 | A1 * | 8/2017 | Lee | H05K 9/0088 |
| 2017/0245040 | A1 | 8/2017 | Hankey | |
| 2018/0235338 | A1 * | 8/2018 | Lamb | A45C 13/001 |
| 2018/0248406 | A1 | 8/2018 | Bae et al. | |
| 2018/0301936 | A1 | 10/2018 | Lee et al. | |
| 2019/0089188 | A1 | 3/2019 | Chien et al. | |
| 2019/0097448 | A1 * | 3/2019 | Partovi | B60L 53/12 |
| 2019/0198212 | A1 * | 6/2019 | Levy | F16M 11/22 |
| 2019/0363565 | A1 | 11/2019 | Graham et al. | |
| 2020/0346006 | A1 | 11/2020 | Eigentler et al. | |
| 2021/0099026 | A1 | 4/2021 | Larsson | |
| 2021/0099027 | A1 | 4/2021 | Larsson | |
| 2022/0014655 | A1 | 1/2022 | Hu | |

FOREIGN PATENT DOCUMENTS

| | | | |
|---|---|---|---|
| CN | 106877429 | A | 6/2017 |
| CN | 207442540 | U | 6/2018 |
| CN | 208581077 | U | 3/2019 |
| EP | 0823717 | A2 | 2/1998 |
| JP | 2013120837 | A | 6/2013 |
| JP | 3197750 | U | 5/2015 |
| JP | 2015171166 | A | 9/2015 |
| JP | 6233504 | B2 | 11/2017 |
| TW | M414057 | U | 10/2011 |
| TW | 201347349 | A | 11/2013 |
| TW | 201711335 | A | 3/2017 |
| WO | 2010129369 | A2 | 11/2010 |
| WO | 2011156768 | A2 | 12/2011 |
| WO | 2016053633 | A1 | 4/2016 |

OTHER PUBLICATIONS

Shanshui Phone Card Holder: https://www.amazon.com/dp/B06WWPKB9K (Year: 2017).*

Cardly Phone Holder: https://www.amazon.com/dp/B07QXDH4SW (Year: 2018).*

* cited by examiner

MAGNETICALLY ATTACHABLE WALLET

CROSS-REFERENCES TO RELATED APPLICATIONS

The present application claims the benefit of and priority to U.S. provisional application No. 63/081,833, filed Sep. 22, 2020, which is hereby incorporated by reference.

BACKGROUND

The number of types of electronic devices that are commercially available has increased tremendously the past few years and the rate of introduction of new devices shows no signs of abating. Devices such as tablet computers, laptop computers, desktop computers, all-in-one computers, cell phones, storage devices, wearable-computing devices, portable media players, navigation systems, monitors, adapters, and others, have become ubiquitous.

As a result of the ubiquity and increasing functionality of these electronic devices, they now travel with us wherever we go. They are often used during or in conjunction with many daily activities, either while performing an activity or in a manner that supplements an activity.

As a result of this constant companionship, it can be desirable for these electronic devices to assume other functions. For example, it can be desirable if the additional functionality can replace a physical object that would otherwise be carried in addition to and separate from the electronic device. That is, it can be desirable to provide an accessory that can replace the physical object.

These electronic devices and physical objects are often carried in a pocket, purse, backpack, satchel, or other such pouch. As such, the size of these electronic devices and physical objects is always of concern. Accordingly, it can be desirable that an accessory that is to replace the physical object have a small and efficient form factor. It can also be desirable that the accessory provide other improvements over the physical object that is being replaced.

Thus, what is needed are accessories that can add new functionality to an electronic device. It can also be desirable if the additional functionality is able to allow for the replacement of a physical object that would otherwise be carried in addition to and separate from the electronic device. It can also be desirable for such an accessory to provide other improvements, such as a reduction in size or improvement in functionality over the physical object that is being replaced.

SUMMARY

Accordingly, embodiments of the present invention can provide accessories that can add new functionality to an electronic device. These accessories can provide additional functionality that allow for the replacement of a physical object that would otherwise be carried in addition to and separate from the electronic device. These accessories can further provide other improvements, such as a reduction in size or improvement in functionality, over the physical object.

These and other embodiments of the present invention can provide an accessory that can add the functionality of a wallet to an electronic device. In providing this additional functionality, a need for a conventional physical wallet can be negated, that is, a conventional wallet can be replaced by the accessory, which can be an attachable wallet. This replacement can reduce a number of separate items that might otherwise be carried. This accessory can provide other improvements over a conventional wallet by having a small and efficient form factor. The accessory can provide further improvements such as providing effective retention features for securing items in the accessory and effective extraction features for removing items from the accessory. In this way, the function of a physical wallet can be added to an electronic device thereby negating the necessity of carrying a separate physical wallet. Further, the function of the wallet itself can be improved by adding these retention, extraction, and other features.

These and other embodiments of the present invention can provide an accessory that can add the functionality of a wallet to an electronic device by including an attachment feature that can attach the accessory to a surface of an electronic device. The attachment feature can include a magnet. The attachment feature can include multiple magnets. The attachment feature can include a magnet array. The magnet array can be arranged in a circular pattern. The magnet array can be magnetically attracted to a corresponding magnetic array in the electronic device.

These and other embodiments of the present invention can further include an alignment feature for the accessory, where the alignment feature can align the accessory in a particular orientation relative to the electronic device. The alignment feature can include magnets in the magnet array. The alignment feature can also or instead be one or more additional magnets that are separate and spaced apart from the magnet array.

These and other embodiments of the present invention can provide an accessory having a small and efficient form factor. The accessory can include a front panel and a back panel. The front panel can be attached to the back panel along sides and a bottom of the front panel and the back panel. The top of the front panel and the top of the back panel can be left unattached to each other to form a throat, where the throat can provide access to an interior compartment. In this way the entirety of the accessory can provide an interior compartment that can be used to hold items.

These and other embodiments of the present invention can provide further improvements such as an improvement in functionality. An accessory can include a retention feature for securing items in the accessory. This retention feature can include a spring tab that can be attached to or formed as part of a metallic shunt in the back panel. The spring tab can be biased towards an interior compartment to secure items in the interior compartment in place. An accessory can include an extraction feature for removing items from the accessory. A passage can extend through the back panel from a back outside surface of the back panel to the interior compartment. This passage can be used to apply a force to an item in the interior compartment in a direction that can move an item in the interior compartment to the throat of the accessory where it can be removed from the accessory.

These and other embodiments of the present invention can provide an accessory that can provide magnetic shielding for items in the interior compartment, as well as for items around and on a backside of the accessory. The back panel can include a metallic shunt supporting a magnet array and an alignment magnet. The metallic shunt can be positioned between the interior compartment and the magnet array and between the interior compartment and the alignment magnet such that items in the interior compartment can be protected from magnetic flux from the magnet array and the alignment magnet. That is, the metallic shunt can direct the magnetic field of the magnet array and alignment magnet away from items in the interior compartment and towards an electronic device attached at the back panel. This can help to protect magnetically stored information on credit cards, transit cards, and the like from inadvertent erasure. This can also help to increase the magnetic attraction between the magnet array and alignment magnet and corresponding magnets in the electronic device.

These and other embodiments of the present invention can further reduce unwanted magnetic fields. The passage through the back panel of the accessory can be laterally and circumferentially surrounded by the magnet array. A ferritic piece or ferrite can be located laterally and circumferentially around the passage and the ferritic piece can be laterally and circumferentially surrounded by the magnet array. In this configuration the ferritic piece can provide further magnetic shielding for items in the interior compartment from the magnet array and alignment magnet. Near-field communication (NFC) circuitry can further be included in the back panel. This NFC circuitry can be located on or near an NFC inlay and can be located between the ferrite and a backside of the attachable wallet. In this configuration, the ferrite can help to prevent the NFC circuitry from being detuned by the metallic shunt and by metallic cards or other objects in the interior compartment.

These and other embodiments of the present invention can provide an accessory that can be identified by an electronic device, for example by reading a tag or other information on an electronic circuit of the NFC circuitry. Once an electronic device identifies that it is attached to an accessory, such as an attachable wallet, the electronic device can commence various operations. For example, the electronic device can comprise a magnetometer. The magnetometer can detect the magnet array in the attachable wallet. In response to this detection, the electronic device can generate a field using near-field communication circuitry. The near-field communication circuitry in the electronic device can detect near-field communication circuitry in the attachable wallet and determine that it is attached to the attachable wallet. The near-field communication circuitry in the attachable wallet can include the tag or other electronic circuit, capacitors, and other components. The tag can include identifying information. This circuitry can also be used to detect a removal of an accessory such as an attachable wallet from the electronic device. In response to detecting a disconnection, the electronic device can remember the location of where the attachable wallet is detached, along with other information. The identification of the attachable wallet can be used by the electronic device in other ways. For example, following attachment, graphics including a color of the attachable wallet can be displayed on a screen of the electronic device. Other personalized information, such as the name of the owner of the attachable wallet, can also be shown. The electronic device can further adjust one or more of its constituent components, such as antennas, cameras, or others.

Various embodiments of the present invention can incorporate one or more of these and the other features described herein. A better understanding of the nature and advantages of the present invention can be gained by reference to the following detailed description and the accompanying drawings.

BRIEF DESCRIPTION OF THE DRAWINGS

FIG. 12B shows an axial cross-section view through a portion of the system of FIG. 12A, while

DESCRIPTION OF ILLUSTRATIVE EMBODIMENTS

Figure 1:
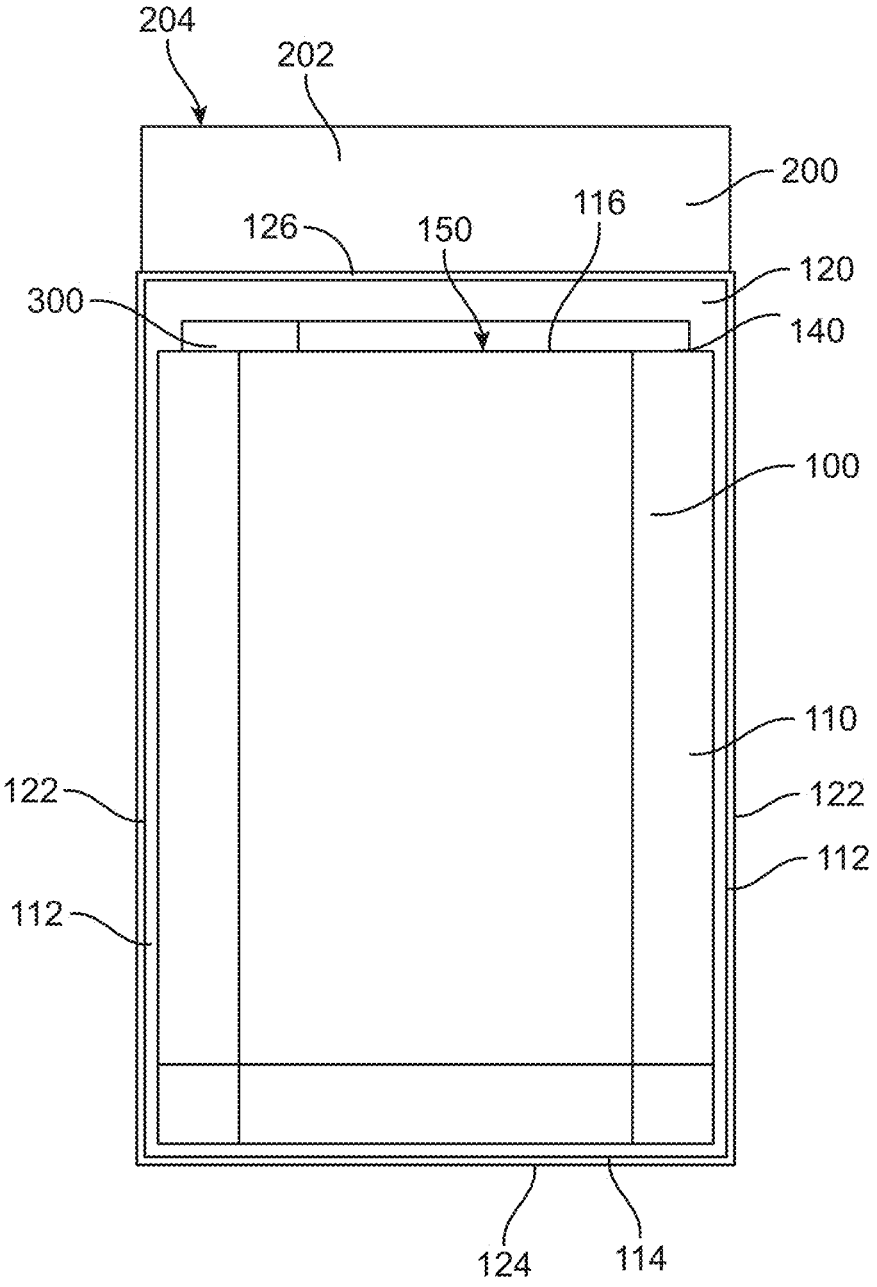
FIG. 1 illustrates an attachable wallet according to an embodiment of the present invention.

FIG. 1 illustrates an attachable wallet according to an embodiment of the present invention. This figure, as with the other included figures, is shown for illustrative purposes and does not limit other the possible embodiments of the present invention or the claims.

In this example, an accessory, specifically attachable wallet 100, can be attached to a back surface 202 of electronic device 200. This can leave a screen (not shown) or other component on front surface 204 of electronic device 200 unobstructed. Electronic device 200 can be a phone or other electronic device. Attachable wallet 100 can include an attachment feature for attaching attachable wallet 100 to back surface 202 of electronic device 200. Attachable wallet 100 can further include an alignment feature for aligning attachable wallet 100 to back surface 202 of electronic device 200 in a specific orientation. In this way, the functionality of a physical wallet can be added to electronic device 200. This can eliminate the need for a conventional wallet that would otherwise be carried separately and in addition to electronic device 200.

Attachable wallet 100 can provide further additional advantages and improvements. For example, attachable wallet 100 can provide a reduction in size over a conventional wallet. In this example, attachable wallet can include front panel 110 and back panel 120. Front panel 110 can be attached to back panel 120 along sides 112 of front panel 110 and sides 122 of back panel 120. Bottom 114 of front panel 110 can be attached to bottom 124 of back panel 120. A top 116 of front panel 110 and top 126 of back panel 120 can be left unattached to each other to form throat 140. Throat 140 can provide access to an interior compartment 150. Interior compartment 150 can be used to hold cards, money, or other objects, referred to collectively as card or cards 300. This configuration can provide a small and efficient form factor for attachable wallet 100.

Figure 5:
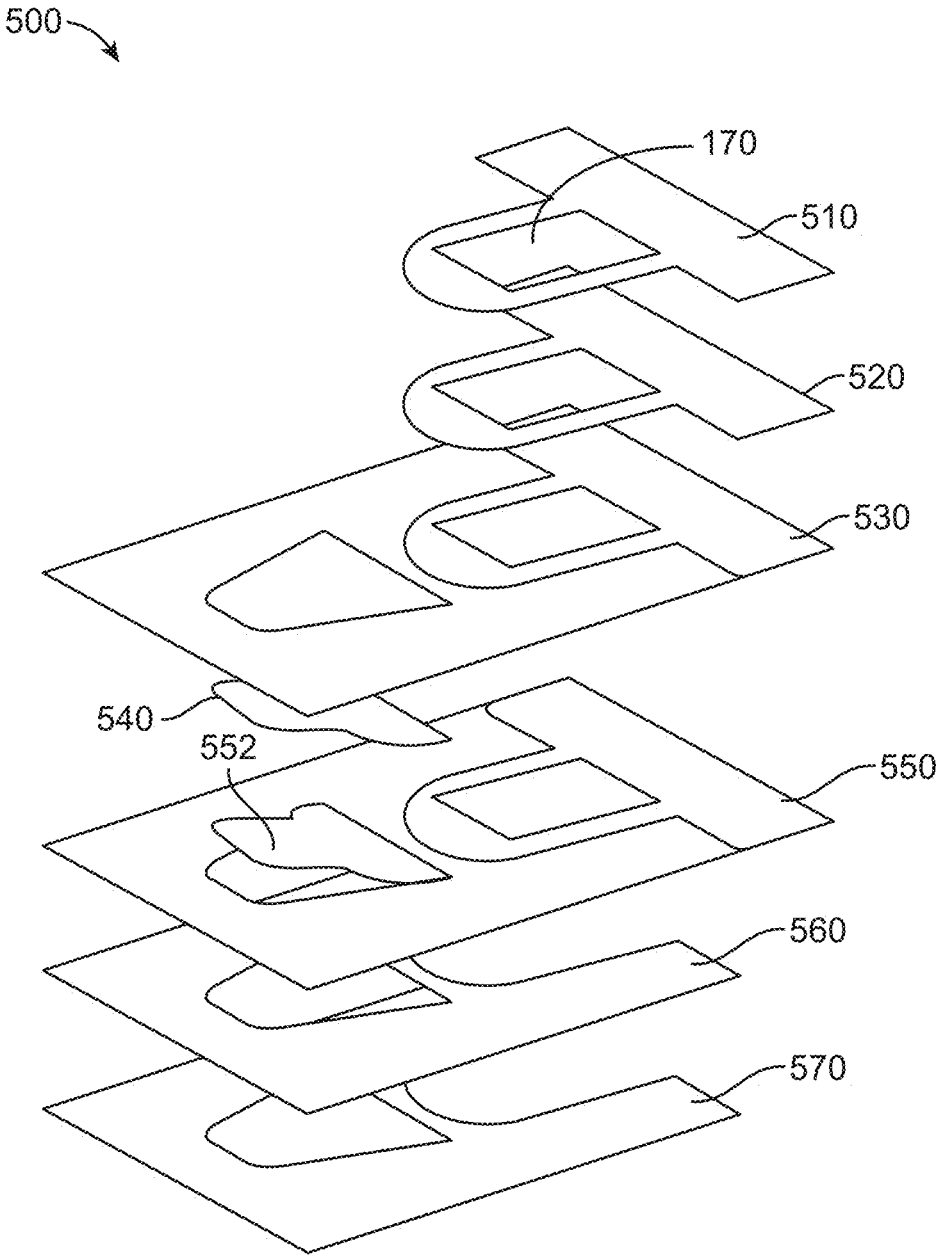
FIG. 5 illustrates layers that can be utilized to form a portion of a back panel for an attachable wallet according to an embodiment of the present invention.
Figure 6:
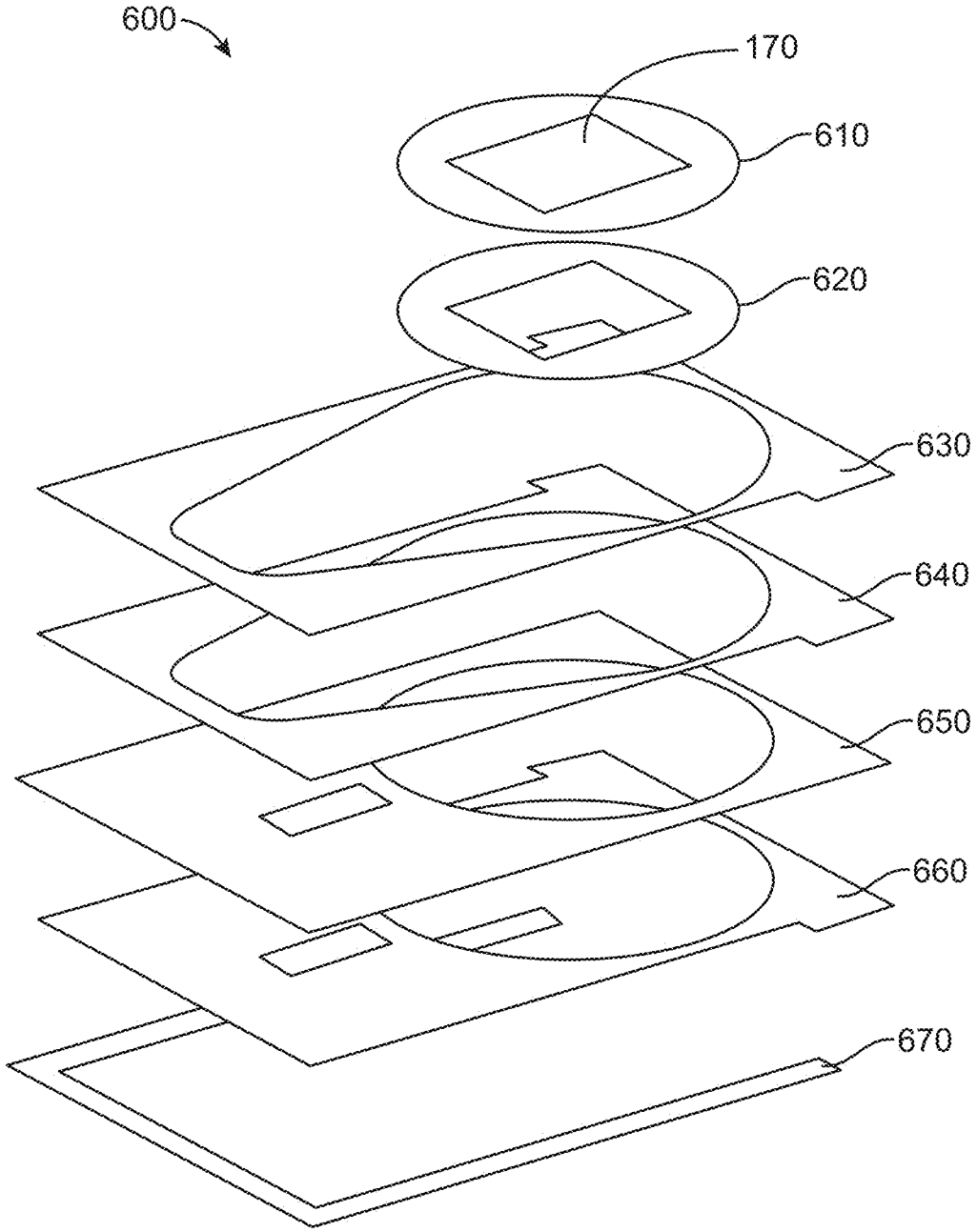
FIG. 6 and FIG. 7 illustrate layers that can be utilized to form a portion of a back panel for an attachable wallet according to an embodiment of the present invention.
Figure 7:
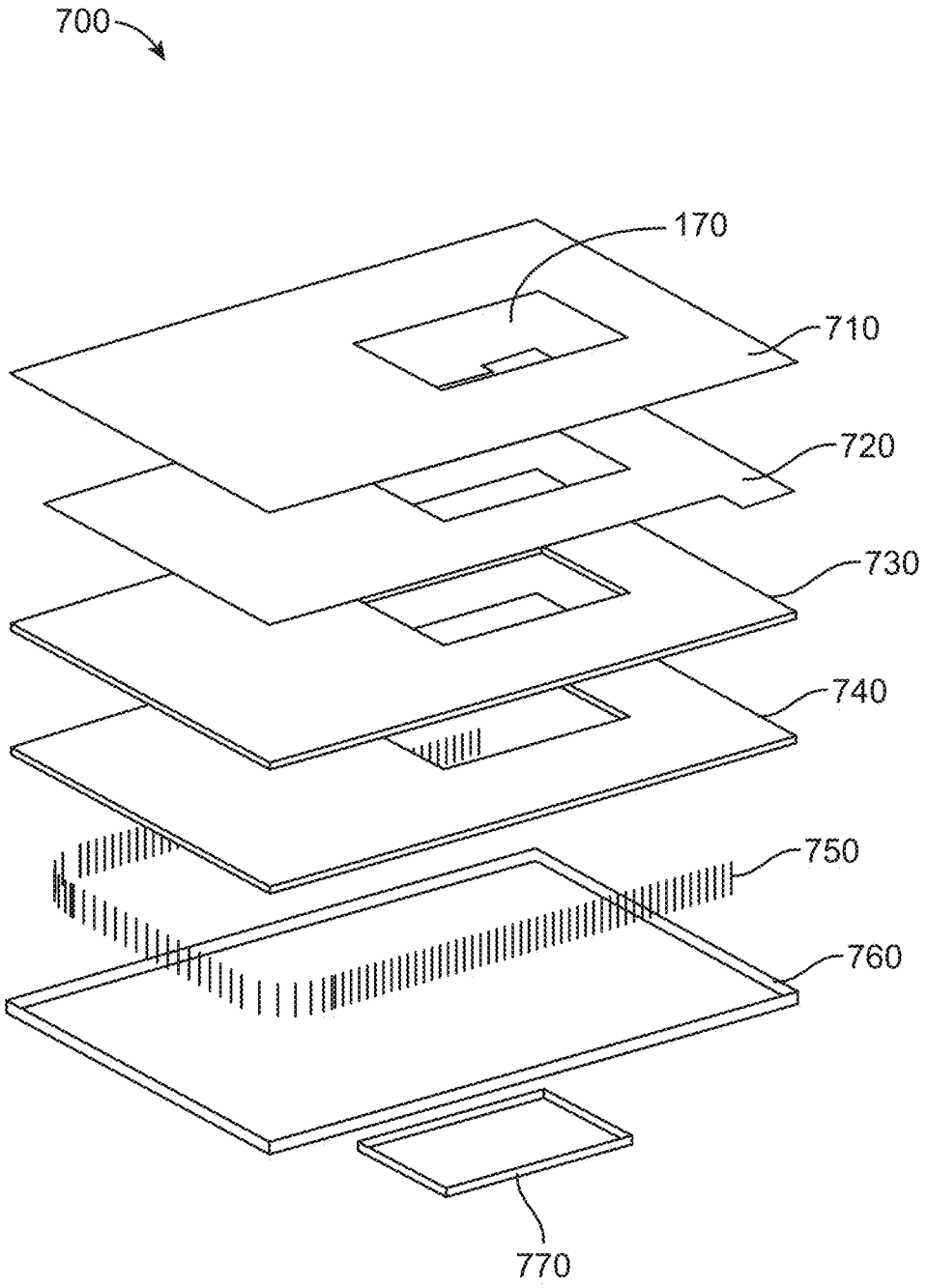

Attachable wallet 100 can further provide improvements in functionality, including an improved retention feature (shown in FIG. 2) and an improved extraction feature (shown in FIGS. 5-7.) Attachable wallet 100 can provide other features, such as a near-field communication circuit (shown in FIGS. 3C and 3D), which can be used by electronic device 200 to identify attachable wallet 100. This identification can be an identification of the attached accessory as an attachable wallet 100. The identification can be the identification of a specific attachable wallet 100.

Figure 2:
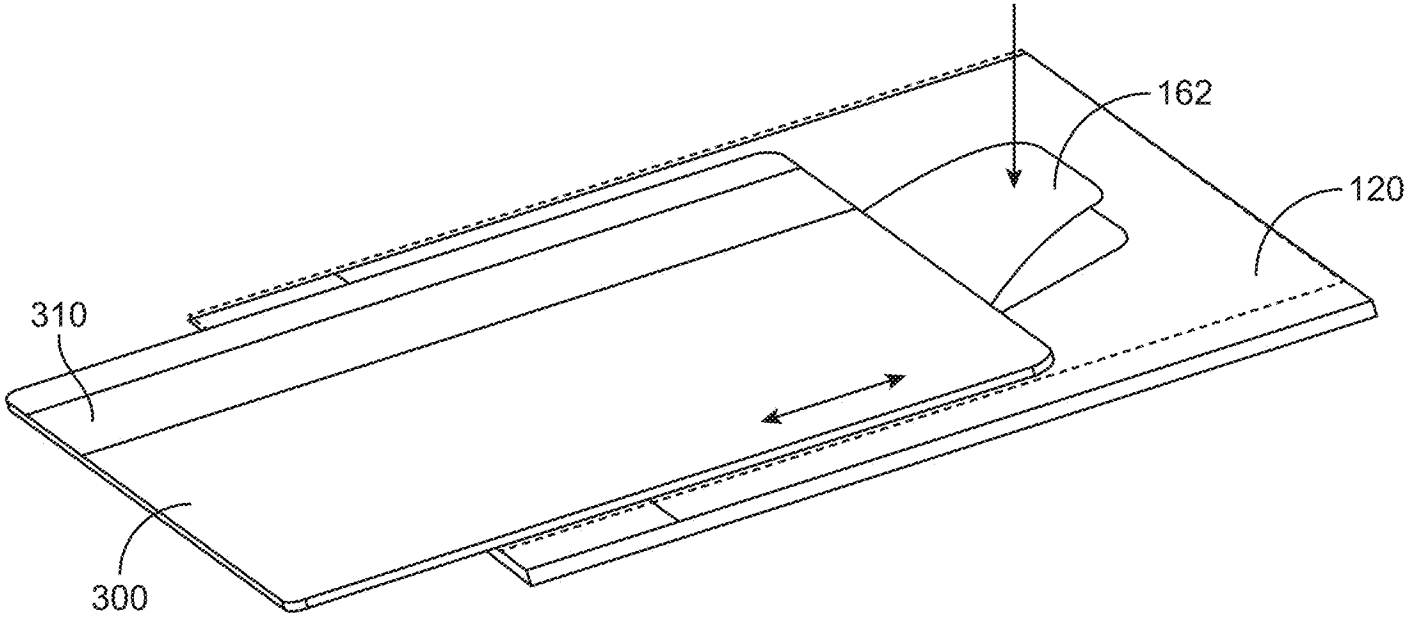
FIG. 2 illustrates an improved retention feature according to an embodiment of the present invention.

FIG. 2 illustrates an improved retention feature according to an embodiment of the present invention. Back panel 120 can support inner shunt 160 (shown in FIG. 3B) having spring tab 162. As card 300 is inserted into interior compartment 150 (shown in FIG. 1), it can engage spring tab 162. Spring tab 162 can apply a pressure against card 300 holding it in place against front panel 110. This arrangement can help to retain card 300 in place in attachable wallet 100 (shown in FIG. 1.)

Again, attachable wallet 100 can include an attachment feature for attaching to electronic device 200 (shown in FIG. 1.) Attachable wallet 100 can further include an alignment feature for aligning attachable wallet 100 to electronic device 200 in a specific orientation. The attachment feature and the alignment feature can be magnets. These magnets can pose a risk of accidental erasure for information stored on magnetic stripe 310 of card 300, where card 300 can be a credit card, transit pass, or other card having magnetically stored information. Accordingly, one or more metallic shunts can be used to provide shielding for card 300. Examples are shown in the following figures.

Figure 3B:
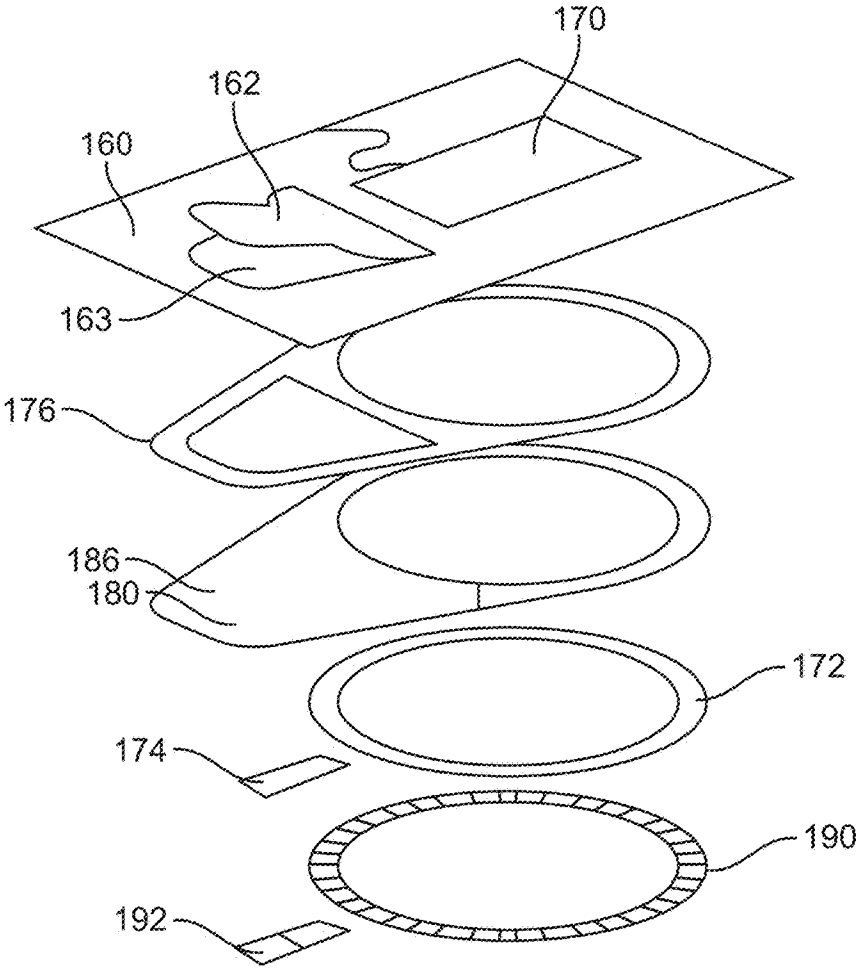
FIG. 3A and FIG. 3B illustrate a subassembly for use in an attachable wallet according to an embodiment of the present invention.
Figure 3A:
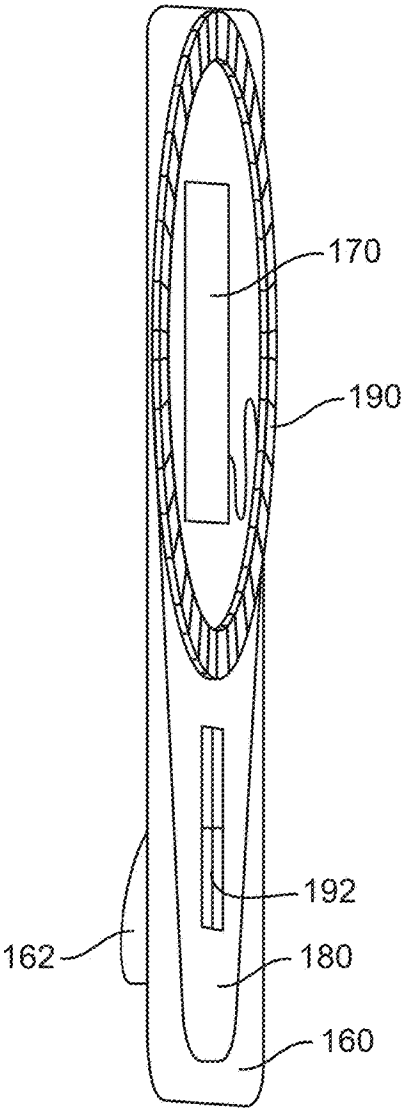

FIG. 3A and FIG. 3B illustrate a subassembly for use in an attachable wallet according to an embodiment of the present invention. In this example, attachable wallet 100 (shown in FIG. 1) can include magnet array 190 as an attachment feature to attach attachable wallet 100 to electronic device 200 (shown in FIG. 1.) Magnet array 190 is shown in further detail below starting in FIG. 8. Magnet array 190 can be attached to outer shunt 180 using adhesive layer 172, or magnet array 190 can move relative to outer shunt 180 as shown below in FIG. 26 through FIG. 33. Outer shunt 180 can be attached to inner shunt 160 using adhesive layer 176.

Also in this example, attachable wallet 100 can include alignment magnet 192 as an alignment feature to align attachable wallet 100 to electronic device 200 in a specific orientation. Alignment magnet 192 is shown in further detail below starting in FIG. 18. Alignment magnet 192 can attached to outer shunt 180 using adhesive layer 174.

With this arrangement, inner shunt 160 and outer shunt 180 can be between magnet array 190 and card 300 and also between alignment magnet 192 and card 300 when card 300 is stored in interior compartment 150 (shown in FIG. 1.) Accordingly, inner shunt 160 and outer shunt 180 can provide shielding to protect information stored on magnetic stripe 310 of card 300 from accidental erasure.

Again, spring tab 162 can provide a retention feature to hold card 300 in place in interior compartment 150 of attachable wallet 100. Spring tab 162 can be stamped from inner shunt 160 leaving opening 163. To improve shielding and to provide an attachment location for alignment magnet 192, outer shunt 180 can include wide portion 186. Wide portion 186 can cover opening 163 in inner shunt 160. The subassembly can further include opening 170. Opening 170 can extend from interior compartment 150 to an outside surface of back panel 120. That is, opening 170 can extend from interior compartment 150 to the back surface of attachable wallet 100 where attachable wallet attaches to electronic device 200. Opening 170 can provide an improved extraction feature. Specifically, opening 170 can allow access to a surface of card 300. Force can be applied to the surface of card 300 to extract card 300 out of throat 140 (shown in FIG. 1) of attachable wallet 100. That is, a user can extent a digit through opening 170 from a back of attachable wallet 100 to card 300 and apply a force to card 300 in order to extract card 300 from interior compartment 150. Ferrite 610 (shown in FIG. 3C) can be used to reduce magnetic flux that can otherwise pass through opening 170 to further improve shielding for card 300 when card 300 is in interior compartment 150 of attachable wallet 100. Opening 170 can also be positioned such that it does not align with magnetic stripe 310 on card 300 when card 300 is located in interior compartment 150.

In the manner described above, card 300 can be protected from magnetic flux generated by magnet array 190 an alignment magnet 192 when card 300 is located in interior compartment 150 of attachable wallet 100. It can also be desirable to protect card 300 when card 300 is nearby, for example when card 300 is placed on a front surface of attachable wallet 100. Accordingly, front panel 110 (shown in FIG. 1) can further include shielding, such as shield layer 460 (shown in FIG. 4.) Examples of layers including shield layer 460 that can be used to form front panel 110 are shown below in FIG. 4.

Figure 3C:
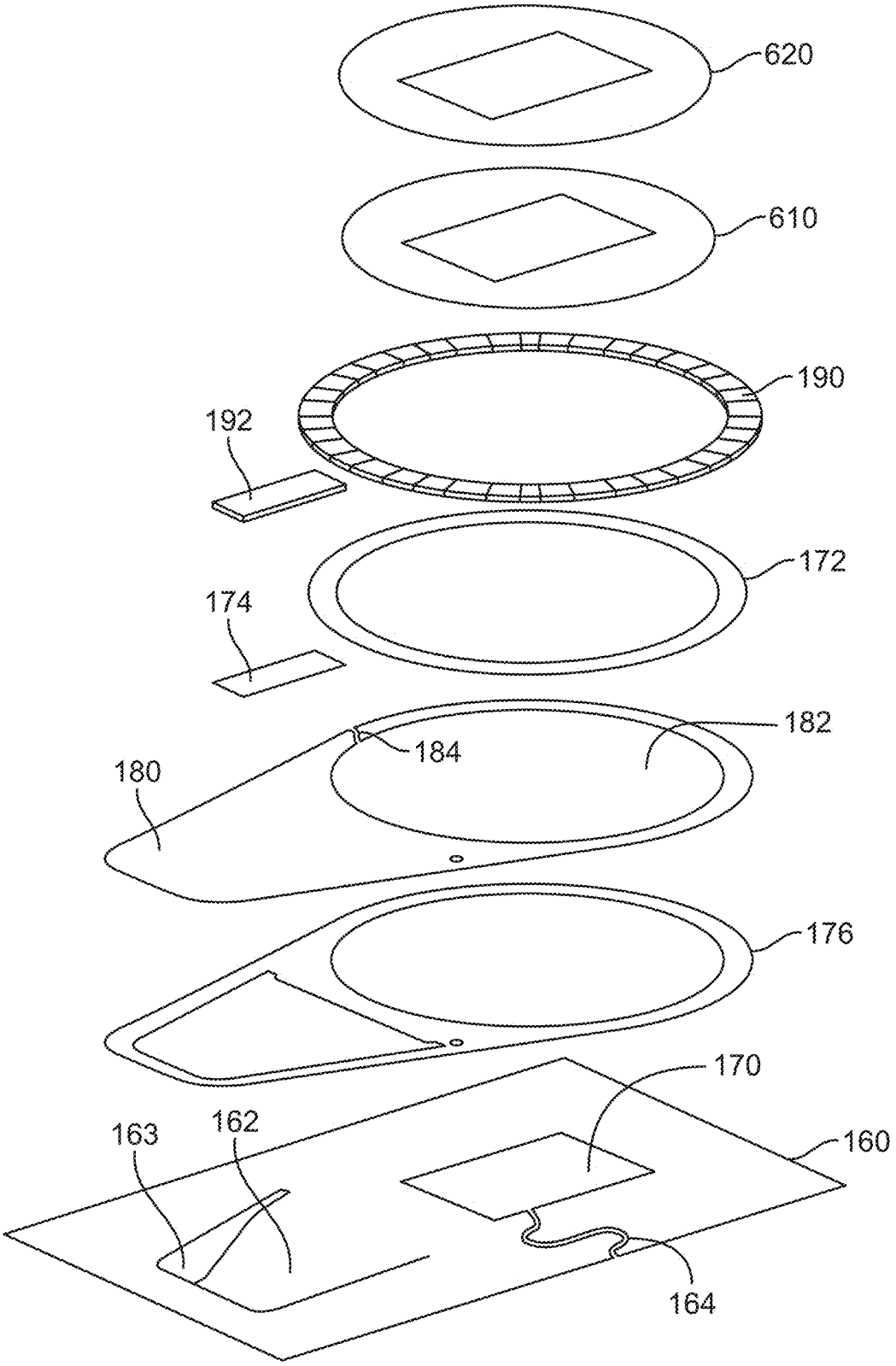
FIG. 3C illustrates another view of the subassembly of FIG. 3B.

FIG. 3C is another view of the subassembly of FIG. 3B. In this example, NFC inlay 620 and ferrite 610 can be located in central opening 182 of outer shunt 180 and in the center of magnet array 190. Magnet array 190 can be attached to outer shunt 180 by adhesive layer 172. Outer shunt 180 can be attached to inner shunt 160 using adhesive layer 176. NFC inlay 620 and ferrite 610 can be located in opening 182 of outer shunt 180 and can be attached to inner shunt 160, for example using an adhesive layer on a bottom surface of ferrite 610. NFC inlay 620 can be attached to ferrite 610 by using, for example, an adhesive layer on a bottom surface of NFC inlay 620. Further details of ferrite 610 are shown below in FIG. 38.

NFC inlay 620 can include NFC circuitry including but not limited to NFC coil 3710 (shown in FIG. 36), capacitor 3820, and capacitor 3830 (both shown in FIG. 37.) Capacitor 3820 and capacitor 3830 can be used with the inductance of NFC coil 3710 to tune a frequency response of NFC inlay 620. That is, a frequency response of NFC inlay 620 (more specifically the NFC circuit of NFC inlay 620) can be tuned to receive an NFC signal from electronic device 200 (shown in FIG. 1.)

The presence of metal, particularly metal that forms a loop in parallel with NFC coil 3710, can detune the frequency response of NFC inlay 620 and degrade the reception of an NFC signal from electronic device 200. Accordingly, embodiments of the present invention can include shielding to isolate NFC inlay 620 from such metal loops.

Both inner shunt 160 and outer shunt 180 can form metal loops in parallel with NFC coil 3710. Accordingly, inner shunt 160 can include break or gap 164. Gap 164 can be an actual separation in inner shunt 160 where material from inner shunt 160 has been removed, gap 164 can be a section of nonconductive material inserted in an otherwise conductive plate, or gap 164 can be another structure. Gap 164 can be formed by stamping, cold working, laser ablation, or other technique. Gap 164 can help to prevent or reduce the formation of eddy currents in inner shunt 160 when NFC coil 3710 receives an NFC signal from electronic device 200. This can help to prevent the NFC circuitry on NFC inlay 620 from being detuned by inner shunt 160. Further ferrite 610 can be placed between NFC coil 3710 of NFC inlay 620 and inner shunt 160. Ferrite 610 can help to shield NFC inlay 620 from inner shunt 160. Ferrite 610 can help to prevent eddy currents from developing in inner shunt 160, thereby limiting the amount inner shunt 160 can detune the NFC circuitry on NFC inlay 620.

Similarly, outer shunt 180 can include gap 184. Gap 184 can be an actual separation in outer shunt 180 where material from outer shunt 180 has been removed, gap 184 can be a section of nonconductive material inserted in an otherwise conductive plate, or gap 184 can be a different structure. Gap 184 can be formed by stamping, cold working, laser ablation, or other technique. Gap 184 can help to prevent or reduce the formation of eddy currents in outer shunt 180 when NFC coil 3710 receives an NFC signal from electronic device 200. This can help to prevent the NFC circuitry on NFC inlay 620 from being detuned by outer shunt 180. Further, ferrite 610 can be placed between NFC coil 3710 of NFC inlay 620 and outer shunt 180. Ferrite 610 can help to shield NFC inlay 620 from outer shunt 180. Ferrite 610 can help to prevent eddy currents from developing in outer shunt 180, thereby limiting the amount outer shunt 180 can detune the NFC circuitry on NFC inlay 620.

Figure 36:
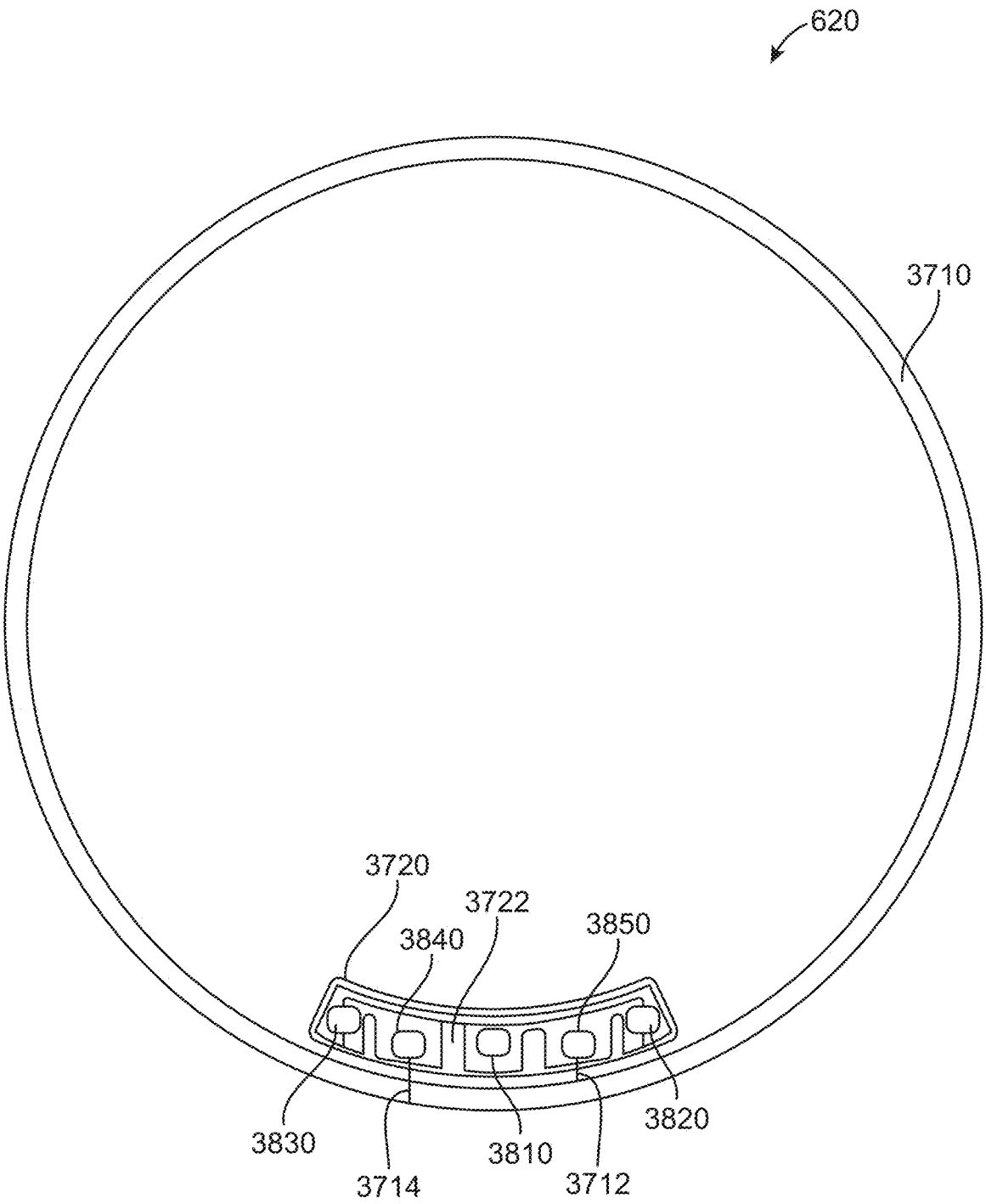
FIG. 36 illustrates a portion of NFC inlay according to an embodiment of the present invention.

Attachable wallet 100 (shown in FIG. 1) can be used to carry card 300 (shown in FIG. 2), where card 300 is formed of metal. Accordingly, ferrite 610 can be placed between NFC inlay 620 and card 300. Ferrite 610 can help to block an NFC signal from electronic device 200 from reaching card 300 and thereby detuning the NFC circuitry on NFC inlay 620. That is, ferrite 610 can further help to prevent eddy currents from developing in card 300, thereby helping to prevent the detuning of the NFC circuitry on NFC inlay 620. Further details of the NFC circuitry and NFC inlay 620 are shown in FIG. 36 below.

In these and other embodiments of the present invention, gap 164 and gap 184 can be positioned such that they are not aligned with each other. For example, gap 164 and gap 184 can be on opposite sides of opening 170. This variation in positioning between gap 164 and gap 184 can help to provide a structure that can mechanically support ferrite 610 and NFC inlay 620. In these and other embodiments of the present invention, it can be desirable to avoid shorting gap 164 with a portion of outer shunt 180. Accordingly, adhesive layer 176 can be accurately positioned to prevent such shorting. This accurate positioning can be further used to avoid shorting gap 184 with a portion of inner shunt 160.

In these and other embodiments of the present invention, it can be desirable to protect card 300 from magnet array 190. It can also be desirable to direct magnetic flux from magnet array 190 towards electronic device 200. Accordingly, inner shunt 160 and outer shunt 180 can be formed of metal, such as steel, 1085 steel, carbon steel, DT4 steel, or other type of steel or other material. Inner shunt 160 and outer shunt 180 can provide shielding between magnet array 190 and card 300. Inner shunt 160 and outer shunt 180 can further direct magnetic flux from magnet array 190 towards electronic device 200, thereby increasing the magnetic attraction between magnet array 190 and a corresponding magnet array in electronic device 200.

In order to rotationally align attachable wallet 100 to electronic device 200, alignment magnet 192 can be included. Alignment magnet 192 can be attached to the outer shunt 180 using adhesive layer 174. Spring tab 162 can be stamped from inner shunt 160 leaving opening 163.

Figure 3D:
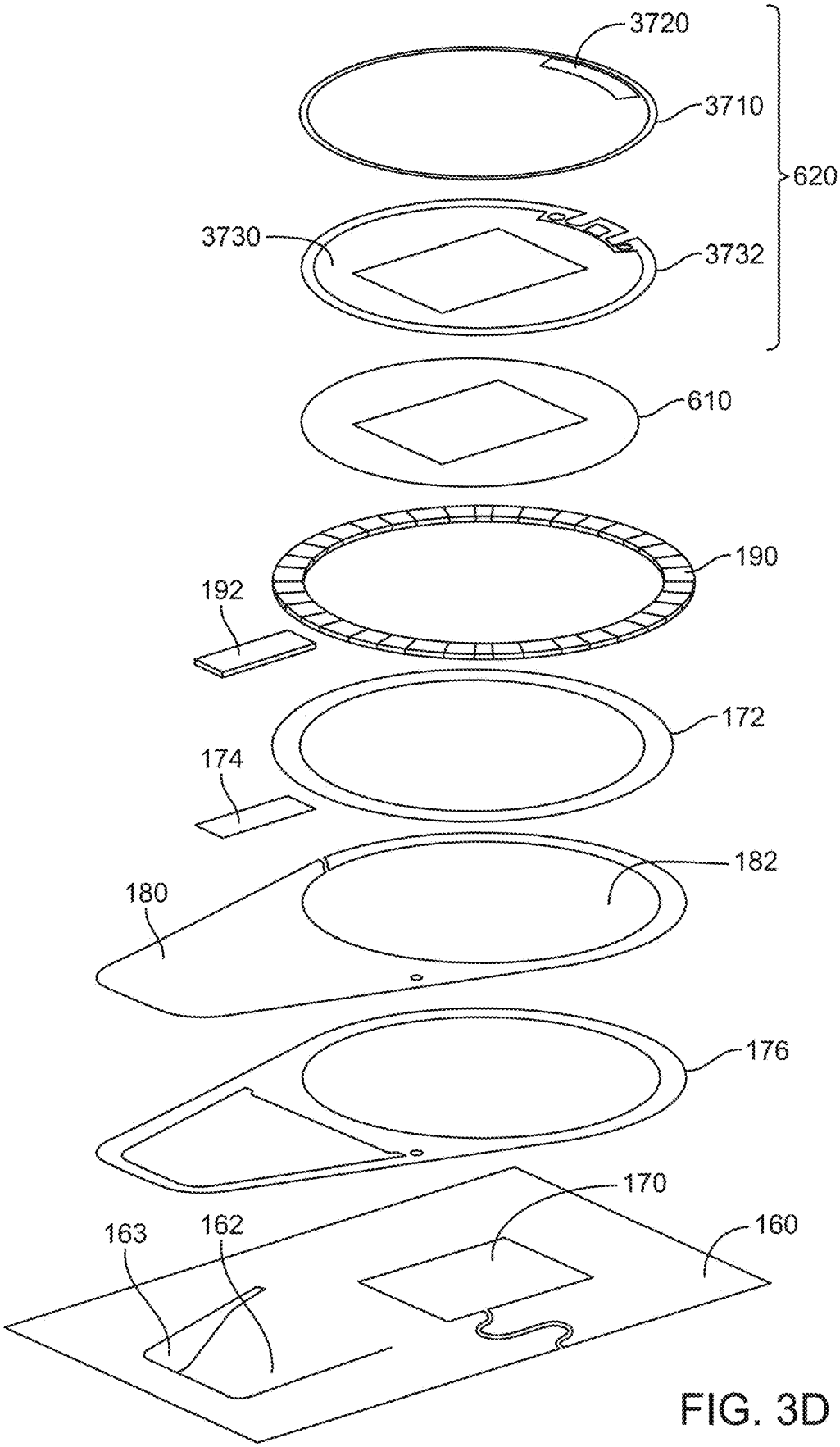
FIG. 3D is a more detailed view the subassembly of FIG. 3B.

FIG. 3D is a more detailed view of the subassembly of FIG. 3B. In this example, some of the constituent portions of NFC inlay 620 are shown. NFC inlay 620 can include NFC coil 3710 and flexible circuit board 3720. NFC coil 3710 can be attached to shim 3730 with adhesive layer 3732. Adhesive layer 3732 can attach the remainder of NFC inlay 620 to ferrite 610. Ferrite 610 can include an adhesive layer (shown in FIG. 38) on a bottom surface that can be used to attach ferrite 610 and NFC inlay 620 to inner shunt 160. NFC inlay 620 and ferrite 610 can be positioned in opening 182 of outer shunt 180. Outer shunt 180 can be attached to inner shunt 160 using adhesive layer 176. Magnet array 190 can be attached to outer shunt 180 with adhesive layer 172 and alignment magnet 192 can be attached to outer shunt 180 with adhesive layer 174

Figure 37A:
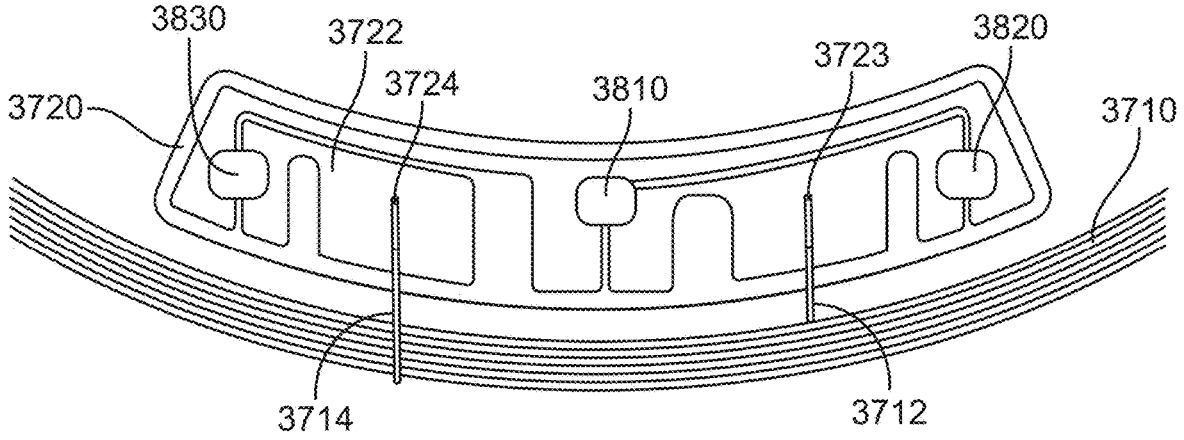
FIG. 37A and FIG. 37B illustrate portions of an NFC inlay according to an embodiment of the present invention.
Figure 37B:
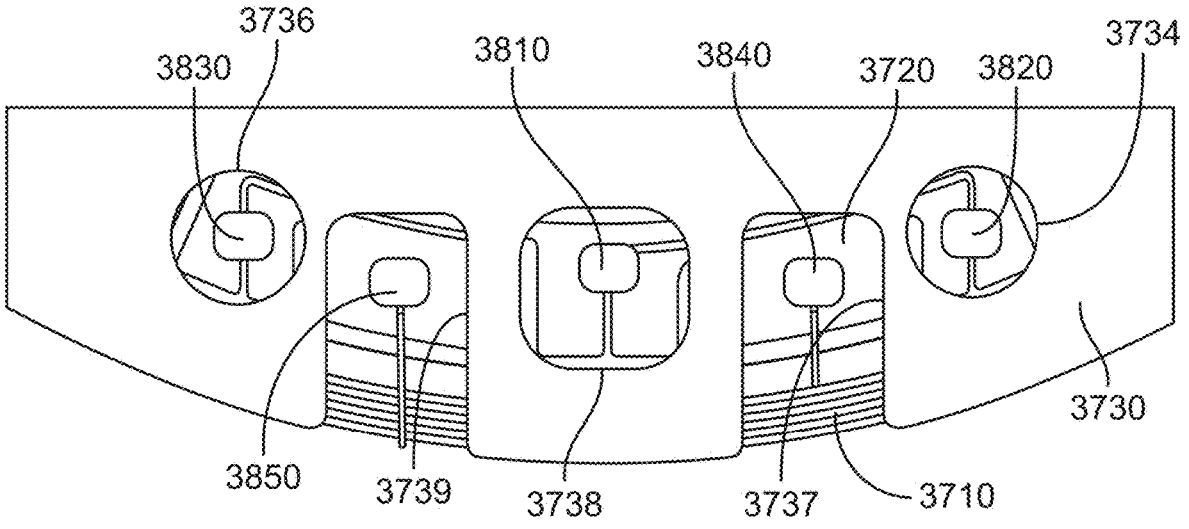

In this example, capacitor 3820, capacitor 3830, and electronic circuit 3810 (all shown in FIG. 37A and FIG. 37B) can be located on a bottom side of flexible circuit board 3720. Shim 3730 can include one or more openings, one or more notches, or both, for capacitor 3820, capacitor 3030, and electronic circuit 3810, where details of one example are shown in FIG. 37A and FIG. 37B. In this way, shim 3730 can help to protect capacitor 3820, capacitor 3830, and electronic circuit 3810. Shim 3730 can further provide a flat surface at a back side of flexible circuit board 3720, such that capacitor 3020, capacitor 3830, and electronic circuit 3810 do not form a visible or tactile impression at an outside surface of back panel 120 (shown in FIG. 1.) Spring tab 162 can be formed in inner shunt 160, leaving opening 163. Inner shunt 160 can include opening 170.

Figure 4:
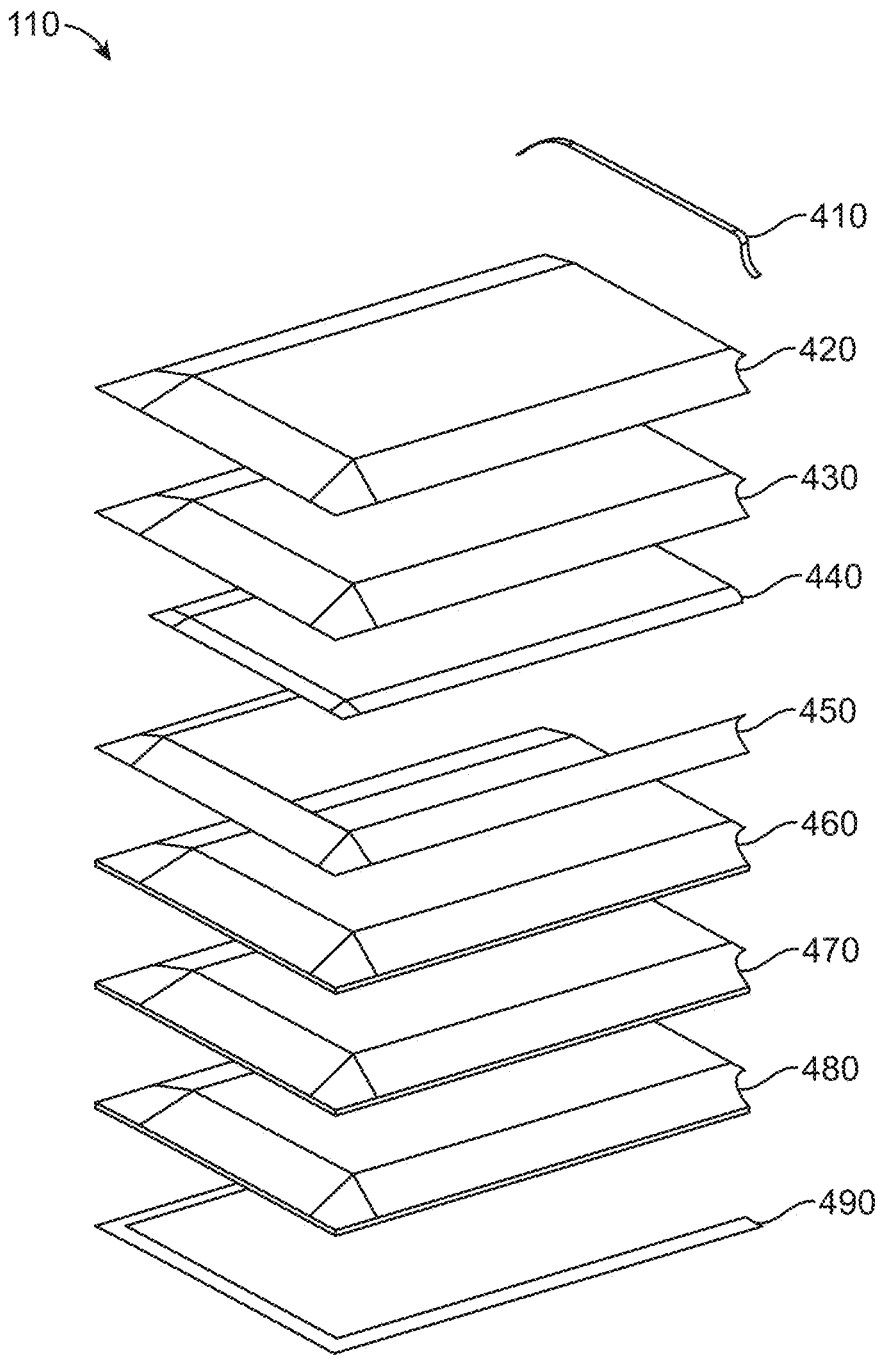
FIG. 4 illustrates layers that can be utilized to form a front panel for an attachable wallet according to an embodiment of the present invention.

FIG. 4 illustrates layers that can be utilized to form a front panel for an attachable wallet according to an embodiment of the present invention. In this example, an outside surface of front panel 110 can be formed by decorative layer 420. Decorative layer 420 can be leather, or other material, such as a man-made leather substitute. Paint layer 410 can be a painted or decorative layer along an edge of decorative layer 420. Shunt layer 440 can form a flexible shunt for shield layer 460. Details of shield layer 460 are shown below in FIG. 38. Shield layer 460 can help to protect card 300 (or other structures) when card 300 is outside of attachable wallet 100 (shown in FIG. 1) and is instead on top or near attachable wallet 100. Shunt layer 450 can be a wrap-around flexible shunt or filler for shield layer 460. Adhesive layer 430 can attach shunt layer 440 and shunt layer 450 to decorative layer 420. Interior compartment 150 (shown in FIG. 1) can be lined with taffeta or other material. Taffeta layer 480 can be attached to shield layer 460 with adhesive layer 470. Taffeta layer 480 can be attached to taffeta layer 530 (shown in FIG. 5) by adhesive or stitching layer 490. Taffeta layer 480 and taffeta layer 530 can line interior compartment 150.

FIG. 5 illustrates layers that can be utilized to form a portion of a back panel for an attachable wallet according to an embodiment of the present invention. In this example, layers 500 can include some of the layers between inner shunt 160 (shown in FIG. 3A) and interior compartment 150 (shown in FIG. 1.) Layers 500 can include decorative layer 510, which can be attached to taffeta layer 530 with adhesive layer 520. Taffeta layer 530 and taffeta layer 480 (shown in FIG. 4) can line interior compartment 150. Decorative layer 510 can be formed of leather or other material. Decorative layer 510 can be formed of the same material as decorative layer 420 (shown in FIG. 4.) A rigid polycarbonate layer 540 can cover spring tab 162 (shown in FIG. 2.) Polycarbonate layer 540 can protect card 300 (shown in FIG. 2) from marring when inserted into interior compartment 150 of attachable wallet 100 (shown in FIG. 1.) Filler layer 560 can be attached to inner shunt 160 in the subassembly shown in FIG. 3A. Filler layer 560 can be attached to taffeta layer 530 by adhesive layer 550. Adhesive layer 550 can include portion 552 for attaching polycarbonate layer 540 to spring tab 162. Adhesive layer 570 can attach filler layer 560 to inner shunt 160 in the subassembly shown in FIG. 3A. Passage or opening 170 can extend through layers 500.

Figure 38:
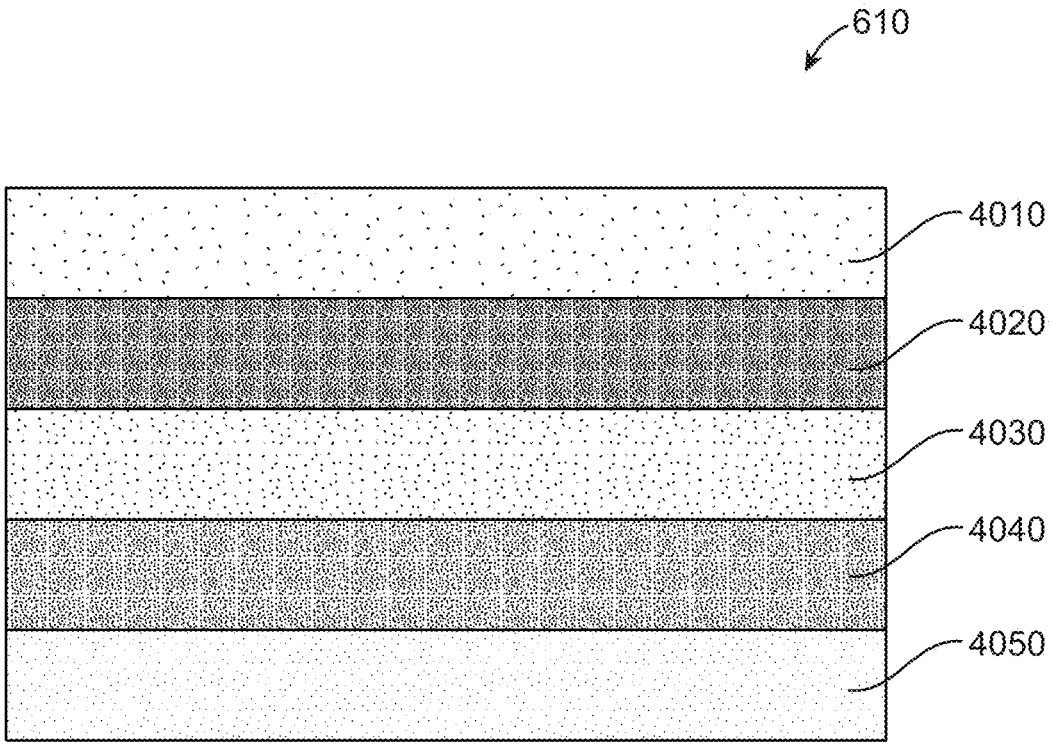
FIG. 38 illustrates a cross-section of a ferrite according to an embodiment of the present invention.

FIG. 6 and FIG. 7 illustrate layers that can be utilized to form a portion of a back panel for an attachable wallet according to an embodiment of the present invention. In this example, layers 600 (shown in FIG. 6) and layers 700 (shown in FIG. 7) can include layers between outer shunt 180 (shown in FIG. 3A) and an outside surface of back panel 120. In FIG. 6, ferrite 610 can be a ferrite layer, further details of which are shown in FIG. 38. NFC inlay 620 and ferrite 610 can be around opening 170 (shown in FIG. 3A) which can extend from an outside surface of back panel 120 to interior compartment 150. Filler layer 640 can provide mechanical support. Filler layer 640 can be attached to inner shunt 160 of the subassembly shown in FIG. 3A by adhesive layer 630 and to filler layer 660 with adhesive layer 650. Filler layer 670 can also be included. Passage or opening 170 can extend through layers 600.

In FIG. 7, polycarbonate layer 720 can be used as a stiffener. Polycarbonate layer 720 can be attached to filler layer 660 (shown in FIG. 6) with adhesive layer 710. Adhesive layer 730 can attach polycarbonate layer 720 to decorative layer 740. Decorative layer 740 can be formed of leather or other material. Decorative layer 740 can be formed of the same material as decorative layer 420 in FIG. 4 and decorative layer 510 in FIG. 5. Back panel 120 and front panel 110 can be stitched together with stitching 750. Paint layer 760 and paint layer 770 can be painted layers for decorative purposes. Passage or opening 170 can extend through layers 700.

In these and other embodiments of the present invention, near-field communication circuits, such as NFC coil 3710, capacitor 3820, capacitor 3830, and tag or electronic circuit 3810 (all shown in FIG. 36) can be included in attachable wallet 100. This near-field communication circuit can be located on or near inner shunt 160 and outer shunt 180 (shown in FIG. 3A.) This arrangement can provide an accessory, such as attachable wallet 100, that can be identified by an electronic device, such as electronic device 200 (shown in FIG. 1.) This identification can include electronic device 200 identifying that it is attached to an attachable wallet. This identification can include electronic device 200 identifying that it is attached to a specific attachable wallet. This identification can include electronic device 200 identifying that it is attached to a specific attachable wallet having specific characteristics or attributes, such as ownership, color, version, model, firmware, or other characteristics or attributes.

Once electronic device 200 identifies that it is attached to an accessory, such as attachable wallet 100, electronic device 200 can commence various operations. These operations can include providing color graphics on a screen (not shown) of electronic device 200, where a color in the color graphics has a relationship to a color of attachable wallet 100, where the relationship is that the color is at least an approximate match, the color is a complementary color, the color is a contrasting color, or other relationship. These operations can include adjusting one or more lights, cameras, antennas, or other structures or components of electronic device 200, where the structures or components are adjusted in response to the attachment (and therefore presence) of attachable wallet 100.

For example, electronic device 200 can comprise a magnetometer (not shown.) The magnetometer can detect magnet array 190 in attachable wallet 100. In response to this detection, electronic device 200 can generate a field using near-field communication circuitry (not shown). The near-field communication circuitry in electronic device 200 can detect this near-field communication circuitry in attachable wallet 100 and determine that it is attached to attachable wallet 100. The near-field communication circuitry in attachable wallet 100 can include a tag or electronic circuit 3810, and tag or electronic circuit 3810 can include identifying or other information that can be read by electronic device 200. The near-field communication circuitry in electronic device 200 can also be used to detect a removal of an accessory such as attachable wallet 100 from the electronic device 200. In response to detecting a disconnection, electronic device 200 can store the location of where the attachable wallet was detached, along with other information.

These and other embodiments of the present invention can provide an attachable wallet 100 that can further provide charging to an electronic device 200. In such an attachable wallet 100, a coil can be placed on or near either or both ferrite 610 and NFC inlay 620. In such an attachable wallet 100, a connector receptacle can also be included to receive power and data and to provide data. Simplified examples are shown in the following figures.

Described herein are various embodiments of magnetic alignment systems and components thereof. The magnetic alignment systems shown below can be used as magnet array 190 or as other magnet arrays and alignment magnets in other embodiments of the present invention. A magnetic alignment system can include annular alignment components comprising a ring of magnets having a particular magnetic orientation or pattern of magnetic orientations such that a "primary" annular alignment component can attract and hold a complementary "secondary" annular alignment component. In some embodiments described below, the primary annular alignment component is assumed to be in an attachable wallet, which can be wireless charging device, and which might or might not surround an inductive charging coil, while the secondary annular alignment component is assumed to be in a portable electronic device, which might or might not surround a receiver coil that can receive power from the inductive charging coil of the wireless charging device. Many variations are possible; for instance, a "primary" annular alignment component can be in a portable electronic device while a "secondary" annular alignment component can be in an attachable wallet, which can be wireless charging device. Also possible are "auxiliary" annular alignment components that are complementary to the primary and secondary annular alignment components such that one surface of the auxiliary annular alignment component is attracted to the primary alignment component while the opposite surface is attracted to the secondary alignment component. An auxiliary annular alignment component can be disposed, e.g., in a case for a portable electronic device.

In some embodiments, a magnetic alignment system can also include a rotational alignment component that facilitates aligning two devices in a preferred rotational orientation. It should be understood that any device that has an annular alignment component might or might not also have a rotational alignment component.

In some embodiments, a magnetic alignment system can also include an near-field communication coil and supporting circuitry to allow devices to identify themselves to each other using an NFC protocol. NFC coils can be disposed inboard of the annular alignment component or outboard of the annular alignment component. It should be understood that an NFC component is optional in the context of providing magnetic alignment.

Figure 8:
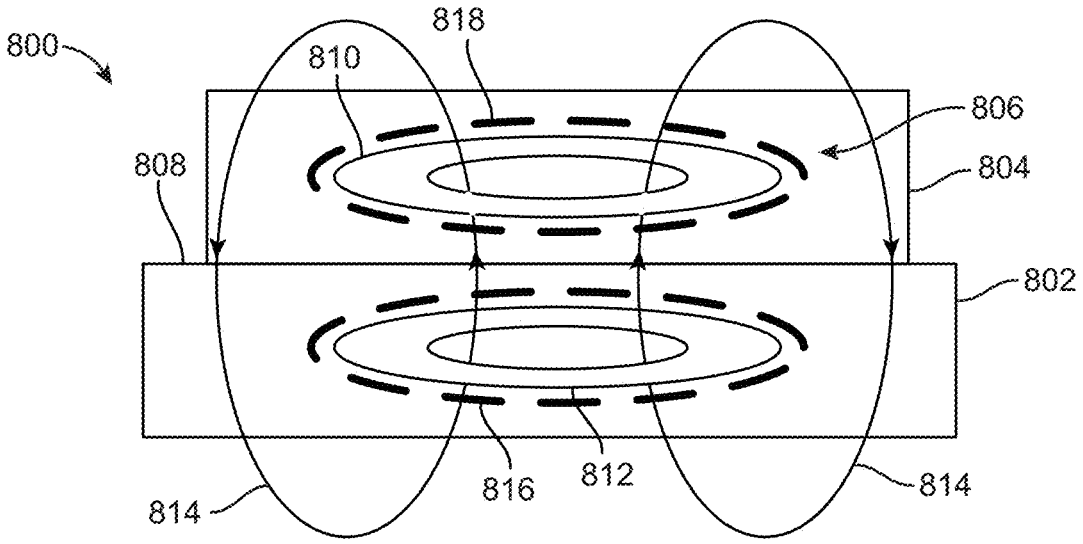
FIG. 8 shows a simplified representation of a wireless charging system incorporating a magnetic alignment system according to some embodiments.

FIG. 8 shows a simplified representation of a wireless charging system 800 incorporating a magnetic alignment system 806 according to some embodiments. A portable electronic device 804 is positioned on a charging surface 808 of a wireless charging device 802. Portable electronic device 804 can be a consumer electronic device, such as a smart phone, tablet, wearable device, or the like, or any other electronic device for which wireless charging is desired. Electronic device 804 can be electronic device 200 (shown in FIG. 1.) Wireless charging device 802 can be any device that is configured to generate time-varying magnetic flux to induce a current in a suitably configured receiving device. For instance, wireless charging device 802 can be attachable wallet 100 shown above in FIG. 1, wireless charging mat, puck, docking station, or the like. Wireless charging device 802 can include or have access to a power source such as battery power or standard AC power.

To enable wireless power transfer, portable electronic device 804 and wireless charging device 802 can include inductive coils 810 and 812, respectively, which can operate to transfer power between them. For example, inductive coil 812 can be a transmitter coil that generates a time-varying magnetic flux 814, and inductive coil 810 can be a receiver coil in which an electric current is induced in response to time-varying magnetic flux 814. The received electric current can be used to charge a battery of portable electronic device 804, to provide operating power to a component of portable electronic device 804, and/or for other purposes as desired. ("Wireless power transfer" and "inductive power transfer," as used herein, refer generally to the process of generating a time-varying magnetic field in a conductive coil of a first device that induces an electric current in a conductive coil of a second device.)

To enable efficient wireless power transfer, it is desirable to align inductive coils 812 and 810. According to some embodiments, magnetic alignment system 806 can provide such alignment. In the example shown in FIG. 8, magnetic alignment system 806 includes a primary magnetic alignment component 816 disposed within or on a surface of wireless charging device 802 and a secondary magnetic alignment component 818 disposed within or on a surface of portable electronic device 804. Primary alignment components 816 and secondary alignment components 818 are configured to magnetically attract one another into an aligned position in which inductive coils 810 and 812 are aligned with one another to effectuate wireless power transfer.

According to embodiments described herein, a magnetic alignment component (including a primary or secondary alignment component) of a magnetic alignment system can be formed of arcuate magnets arranged in an annular configuration. In some embodiments, each magnet can have its magnetic polarity oriented in a desired direction so that magnetic attraction between the primary and secondary magnetic alignment components provides a desired alignment. In some embodiments, an arcuate magnet can include a first magnetic region with magnetic polarity oriented in a first direction and a second magnetic region with magnetic polarity oriented in a second direction different from (e.g., opposite to) the first direction. As will be described, different configurations can provide different degrees of magnetic field leakage.

In this example, portable electronic device 804 can be a phone or other electronic device such as electronic device 200 in FIG. 1. Wireless charging device 802 can be an attachment device such as attachable wallet 100 in FIG. 1. Primary alignment components 816 can be used as magnet array 190 (shown in FIG. 3A) or as a magnet array in other embodiments of the present invention. Inductive coil 812 can be optional where wireless charging device 802 is used as an attachable wallet, such as attachable wallet 100. Inductive coil 812 can be used as a coil in these and other embodiments of the present invention.

Figure 9A:
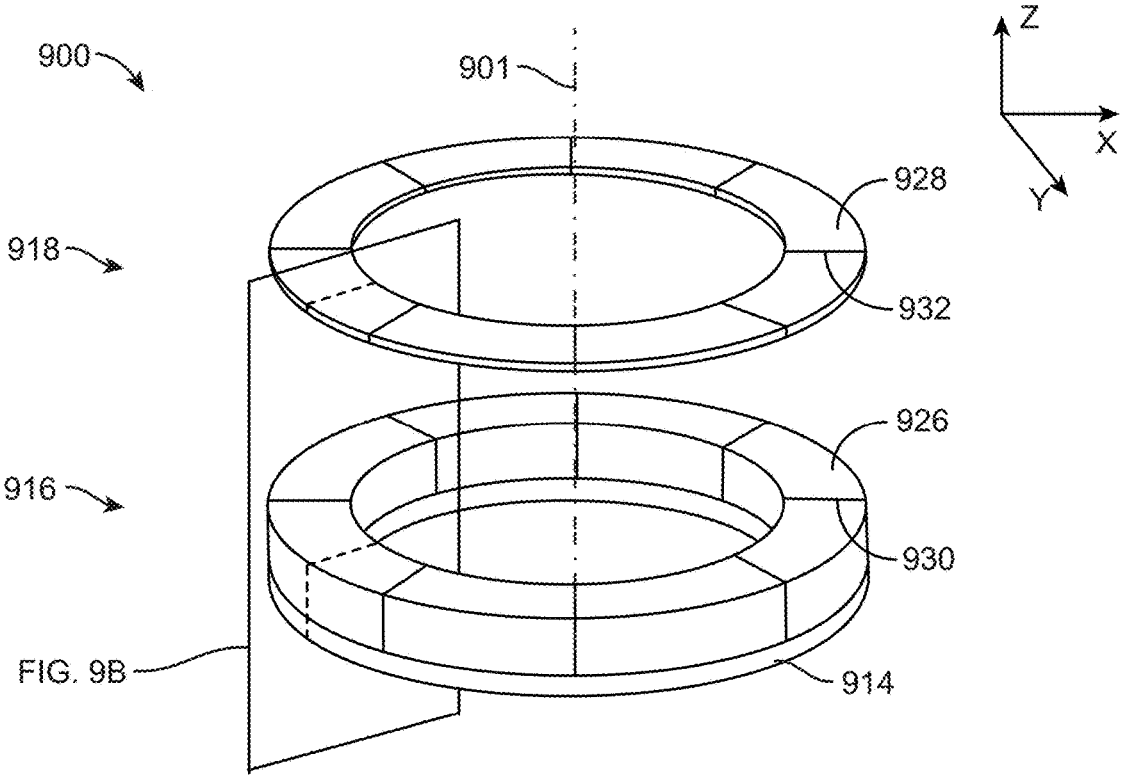
FIG. 9A shows a perspective view of a magnetic alignment system according to some embodiments.
Figure 9B:
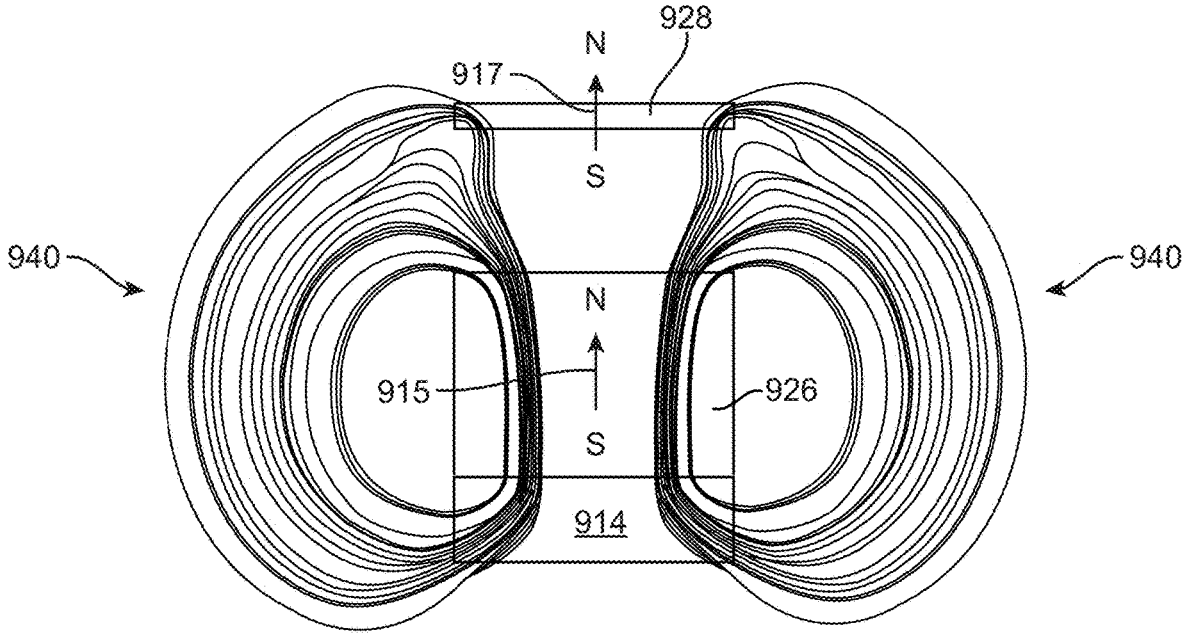
FIG. 9B shows a cross-section through the magnetic alignment system of FIG. 9A.

FIG. 9A shows a perspective view of a magnetic alignment system 900 according to some embodiments, and FIG. 9B shows a cross-section through magnetic alignment system 900 across the cut plane indicated in FIG. 9A. Magnetic alignment system 900 can be an implementation of magnetic alignment system 806 of FIG. 8. In magnetic alignment system 900, the alignment components all have magnetic polarity oriented in the same direction (along the axis of the annular configuration.) For convenience of description, an "axial" direction (also referred to as a "longitudinal" or "z" direction) is defined to be parallel to an axis of rotational symmetry 901 of magnetic alignment system 900, and a transverse plane (also referred to as a "lateral" or "x" or "y" direction) is defined to be normal to axis 901. The term "proximal side" is used herein to refer to a side of one alignment component that is oriented toward the other alignment component when the magnetic alignment system is aligned, and the term "distal side" is used to refer to a side opposite the proximal side.

As shown in FIG. 9A, magnetic alignment system 900 can include a primary alignment component 916 (which can be an implementation of primary alignment component 816 of FIG. 8) and a secondary alignment component 918 (which can be an implementation of secondary alignment component 818 of FIG. 8). Primary alignment component 916 and secondary alignment component 918 have annular shapes and can also be referred to as "annular" alignment components. The particular dimensions can be chosen as desired. In some embodiments, primary alignment component 916 and secondary alignment component 918 can each have an outer diameter of about 124 mm and a radial width of about 6 mm. The outer diameters and radial widths of primary alignment component 916 and secondary alignment component 918 need not be exactly equal. For instance, the radial width of secondary alignment component 918 can be slightly less than the radial width of primary alignment component 916 and/or the outer diameter of secondary alignment component 918 can also be slightly less than the radial width of primary alignment component 916 so that, when in alignment, the inner and outer sides of primary alignment component 916 extend beyond the corresponding inner and outer sides of secondary alignment component 918. Thicknesses (or axial dimensions) of primary alignment component 916 and secondary alignment component 918 can also be chosen as desired. In some embodiments, primary alignment component 916 has a thickness of about 1.5 mm while secondary alignment component 918 has a thickness of about 0.37 mm.

Primary alignment component 916 can include a number of sectors, each of which can be formed of one or more primary arcuate magnets 926, and secondary alignment component 918 can include a number of sectors, each of which can be formed of one or more secondary arcuate magnets 928. In the example shown, the number of primary magnets 926 is equal to the number of secondary magnets 928, and each sector includes exactly one magnet, but this is not required. Primary magnets 926 and secondary magnets 928 can have arcuate (or curved) shapes in the transverse plane such that when primary magnets 926 (or secondary magnets 928) are positioned adjacent to one another end-to-end, primary magnets 926 (or secondary magnets 928) form an annular structure as shown. In some embodiments, primary magnets 926 can be in contact with each other at interfaces 930, and secondary magnets 928 can be in contact with each other at interfaces 932. Alternatively, small gaps or spaces can separate adjacent primary magnets 926 or secondary magnets 928, providing a greater degree of tolerance during manufacturing.

In some embodiments, primary alignment component 916 can also include an annular shield 914 disposed on a distal surface of primary magnets 926. In some embodiments, shield 914 can be formed as a single annular piece of material and adhered to primary magnets 926 to secure primary magnets 926 into position. Shield 914 can be formed of a material that has high magnetic permeability, such as stainless steel, and can redirect magnetic fields to prevent them from propagating beyond the distal side of primary alignment component 916, thereby protecting sensitive electronic components located beyond the distal side of primary alignment component 916 from magnetic interference.

Primary magnets 926 and secondary magnets 928 can be made of a magnetic material such as an NdFeB material, other rare earth magnetic materials, or other materials that can be magnetized to create a persistent magnetic field. Each primary magnet 926 and each secondary magnet 928 can have a monolithic structure having a single magnetic region with a magnetic polarity aligned in the axial direction as shown by magnetic polarity indicators 915, 917 in FIG. 9B. For example, each primary magnet 926 and each secondary magnet 928 can be a bar magnet that has been ground and shaped into an arcuate structure having an axial magnetic orientation. (As will be apparent, the term "magnetic orientation" refers to the direction of orientation of the magnetic polarity of a magnet.) In the example shown, primary magnet 926 has its north pole oriented toward the proximal surface and south pole oriented toward the distal surface while secondary magnet 928 has its south pole oriented toward the proximal surface and north pole oriented toward the distal surface. In other embodiments, the magnetic orientations can be reversed such that primary magnet 926 has its south pole oriented toward the proximal surface and north pole oriented toward the distal surface while secondary magnet 928 has its north pole oriented toward the proximal surface and south pole oriented toward the distal surface.

As shown in FIG. 9B, the axial magnetic orientation of primary magnet 926 and secondary magnet 928 can generate magnetic fields 940 that generate an attractive force between primary magnet 926 and secondary magnet 928, thereby facilitating alignment between respective electronic devices in which primary alignment component 916 and secondary alignment component 918 are disposed (e.g., as shown in FIG. 8). While shield 914 can redirect some of magnetic fields 940 away from regions below primary magnet 926, magnetic fields 940 can still propagate to regions laterally adjacent to primary magnet 926 and secondary magnet 928. In some embodiments, the lateral propagation of magnetic fields 940 can result in magnetic field leakage to other magnetically sensitive components. For instance, if an inductive coil having a ferromagnetic shield is placed in the interior region of annular primary alignment component 916 (or secondary alignment component 918), leakage of magnetic fields 940 can saturate the ferrimagnetic shield, which can degrade wireless charging performance.

It will be appreciated that magnetic alignment system 900 is illustrative and that variations and modifications are possible. For instance, while primary alignment component 916 and secondary alignment component 918 are each shown as being constructed of eight arcuate magnets, other embodiments may use a different number of magnets, such as sixteen magnets, thirty-six magnets, or any other number of magnets, and the number of primary magnets need not be equal to the number of secondary magnets. In other embodiments, primary alignment component 916 and/or secondary alignment component 918 can each be formed of a single, monolithic annular magnet; however, segmenting magnetic alignment components 916 and 918 into arcuate magnets may improve manufacturing because smaller arcuate segments are less brittle than a single, monolithic annular magnet and are less prone to yield loss due to physical stresses imposed on the magnetic material during manufacturing.

As noted above with reference to FIG. 9B, a magnetic alignment system with a single axial magnetic orientation may allow lateral leakage of magnetic fields, which may adversely affect performance of other components of an electronic device. Accordingly, some embodiments provide magnetic alignment systems with reduced magnetic field leakage. Examples will now be described.

Figure 10A:
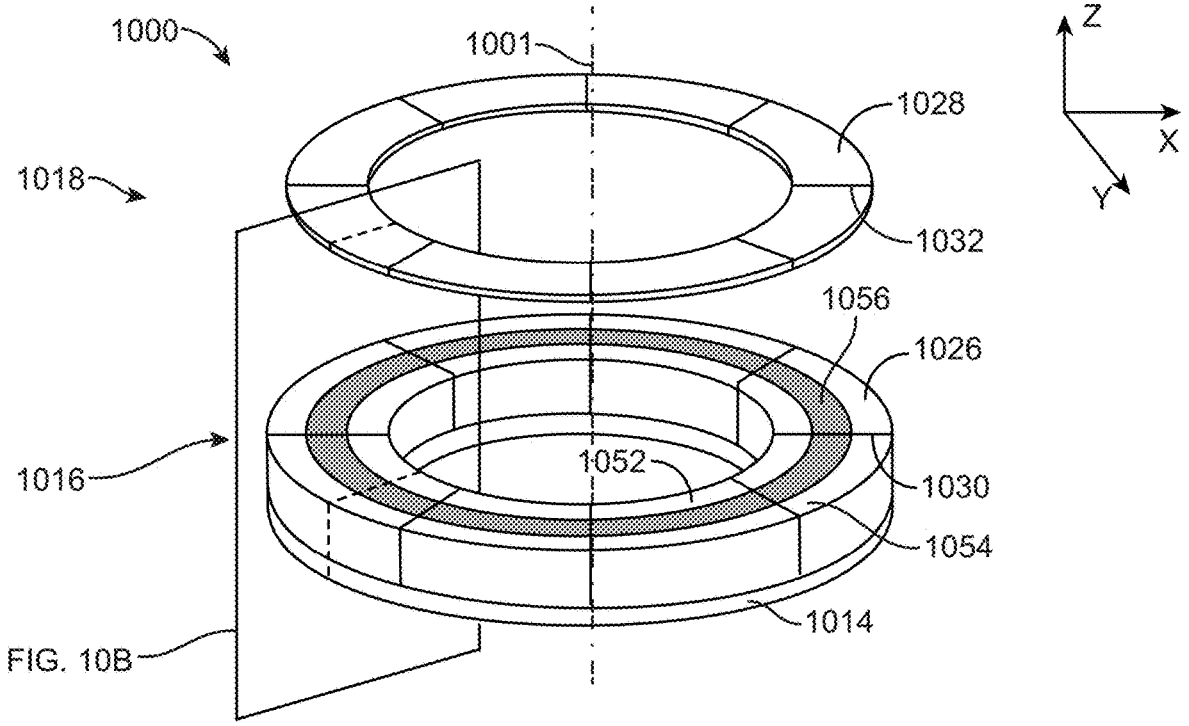
FIG. 10A shows a perspective view of a magnetic alignment system according to some embodiments.
Figure 10B:
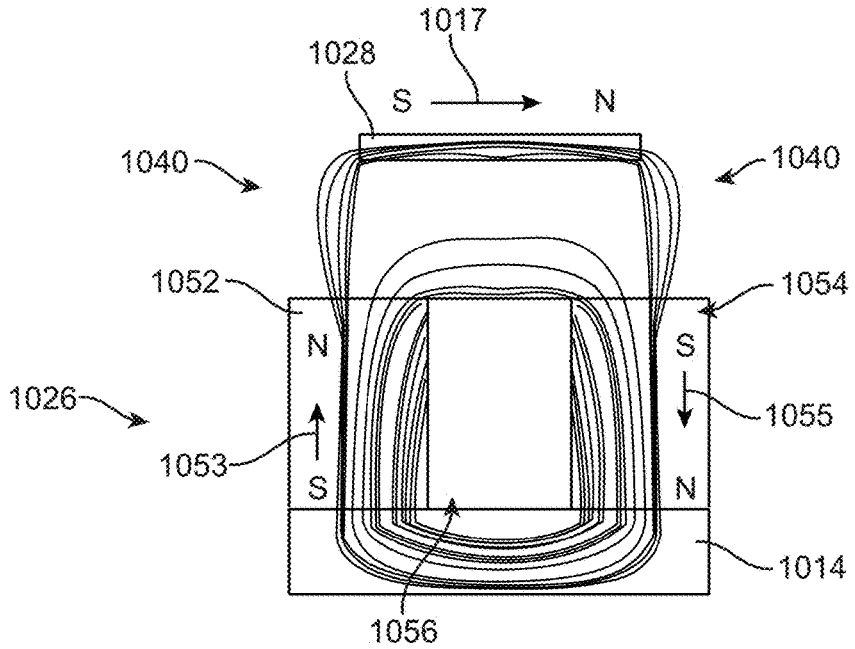
FIG. 10B shows a cross-section through the magnetic alignment system of FIG. 10A.

FIG. 10A shows a perspective view of a magnetic alignment system 1000 according to some embodiments, and FIG. 10B shows a cross-section through magnetic alignment system 1000 across the cut plane indicated in FIG. 10A. Magnetic alignment system 1000 can be an implementation of magnetic alignment system 806 of FIG. 8. In magnetic alignment system 1000, the alignment components have magnetic components configured in a "closed loop" configuration as described below.

As shown in FIG. 10A, magnetic alignment system 1000 can include a primary alignment component 1016 (which can be an implementation of primary alignment component 816 of FIG. 8) and a secondary alignment component 1018 (which can be an implementation of secondary alignment component 818 of FIG. 8). Primary alignment component 1016 and secondary alignment component 1018 have annular shapes and may also be referred to as "annular" alignment components. The particular dimensions can be chosen as desired. In some embodiments, primary alignment component 1016 and secondary alignment component 1018 can each have an outer diameter of about 124 mm and a radial width of about 6 mm. The outer diameters and radial widths of primary alignment component 1016 and secondary alignment component 1018 need not be exactly equal. For instance, the radial width of secondary alignment component 1018 can be slightly less than the radial width of primary alignment component 1016 and/or the outer diameter of secondary alignment component 1018 can also be slightly less than the radial width of primary alignment component 1016 so that, when in alignment, the inner and outer sides of primary alignment component 1016 extend beyond the corresponding inner and outer sides of secondary alignment component 1018. Thicknesses (or axial dimensions) of primary alignment component 1016 and secondary alignment component 1018 can also be chosen as desired. In some embodiments, primary alignment component 1016 has a thickness of about 1.5 mm while secondary alignment component 1018 has a thickness of about 0.37 mm.

Primary alignment component 1016 can include a number of sectors, each of which can be formed of a number of primary magnets 1026, and secondary alignment component 1018 can include a number of sectors, each of which can be formed of a number of secondary magnets 1028. In the example shown, the number of primary magnets 1026 is equal to the number of secondary magnets 1028, and each sector includes exactly one magnet, but this is not required; for example, as described below a sector may include multiple magnets. Primary magnets 1026 and secondary magnets 1028 can have arcuate (or curved) shapes in the transverse plane such that when primary magnets 1026 (or secondary magnets 1028) are positioned adjacent to one another end-to-end, primary magnets 1026 (or secondary magnets 1028) form an annular structure as shown. In some embodiments, primary magnets 1026 can be in contact with each other at interfaces 1030, and secondary magnets 1028 can be in contact with each other at interfaces 1032. Alternatively, small gaps or spaces may separate adjacent primary magnets 1026 or secondary magnets 1028, providing a greater degree of tolerance during manufacturing.

In some embodiments, primary alignment component 1016 can also include an annular shield 1014 disposed on a distal surface of primary magnets 1026. In some embodiments, shield 1014 can be formed as a single annular piece of material and adhered to primary magnets 1026 to secure primary magnets 1026 into position. Shield 1014 can be formed of a material that has high magnetic permeability, such as stainless steel, and can redirect magnetic fields to prevent them from propagating beyond the distal side of primary alignment component 1016, thereby protecting sensitive electronic components located beyond the distal side of primary alignment component 1016 from magnetic interference.

Primary magnets 1026 and secondary magnets 1028 can be made of a magnetic material such as an NdFeB material, other rare earth magnetic materials, or other materials that can be magnetized to create a persistent magnetic field. Each secondary magnet 1028 can have a single magnetic region with a magnetic polarity having a component in the radial direction in the transverse plane (as shown by magnetic polarity indicator 1017 in FIG. 10B). As described below, the magnetic orientation can be in a radial direction with respect to axis 1001 or another direction having a radial component in the transverse plane. Each primary magnet 1026 can include two magnetic regions having opposite magnetic orientations. For example, each primary magnet 1026 can include an inner arcuate magnetic region 1052 having a magnetic orientation in a first axial direction (as shown by polarity indicator 1053 in FIG. 10B), an outer arcuate magnetic region 1054 having a magnetic orientation in a second axial direction opposite the first direction (as shown by polarity indicator 1055 in FIG. 10B), and a central non-magnetized region 1056 that does not have a magnetic orientation. Central non-magnetized region 1056 can magnetically separate inner arcuate region 1052 from outer arcuate region 1054 by inhibiting magnetic fields from directly crossing through central region 1056. Magnets having regions of opposite magnetic orientation separated by a non-magnetized region are sometimes referred to herein as having a "quad-pole" configuration.

In some embodiments, each secondary magnet 1028 can be made of a magnetic material that has been ground and shaped into an arcuate structure, and a magnetic orientation having a radial component in the transverse plane can be created, e.g., using a magnetizer. Similarly, each primary magnet 1026 can be made of a single piece of magnetic material that has been ground and shaped into an arcuate structure, and a magnetizer can be applied to the arcuate structure to induce an axial magnetic orientation in one direction within an inner arcuate region of the structure and an axial magnetic orientation in the opposite direction within an outer arcuate region of the structure, while demagnetizing or avoiding creation of a magnetic orientation in the central region. In some alternative embodiments, each primary magnet 1026 can be a compound structure with two arcuate pieces of magnetic material providing inner arcuate magnetic region 1052 and outer arcuate magnetic region 1054; in such embodiments, central non-magnetized region 1056 can be formed of an arcuate piece of nonmagnetic material or formed as an air gap defined by sidewalls of inner arcuate magnetic region 1052 and outer arcuate magnetic region 1054.

As shown in FIG. 10B, the magnetic polarity of secondary magnet 1028 (shown by indicator 1017) can be oriented such that when primary alignment component 1016 and secondary alignment component 1018 are aligned, the south pole of secondary magnet 1028 is oriented toward the north pole of inner arcuate magnetic region 1052 (shown by indicator 1053) while the north pole of secondary magnet 1028 is oriented toward the south pole of outer arcuate magnetic region 1054 (shown by indicator 1055). Accordingly, the respective magnetic orientations of inner arcuate magnetic region 1052, secondary magnet 1028 and outer arcuate magnetic region 1056 can generate magnetic fields 1040 that produce an attractive force between primary magnet 1026 and secondary magnet 1028, thereby facilitating alignment between respective electronic devices in which primary alignment component 1016 and secondary alignment component 1018 are disposed (e.g., as shown in FIG. 8). Shield 1014 can redirect some of magnetic fields 1040 away from regions below primary magnet 1026. Further, the "closed-loop" magnetic field 1040 formed around central nonmagnetic region 1056 can have tight and compact field lines that do not stray from primary and secondary magnets 1026 and 1028 as far as magnetic field 1040 strays from primary and secondary magnets 1076 and 1078 in FIG. 10B. Thus, magnetically sensitive components can be placed relatively close to primary alignment component 1016 with reduced concern for stray magnetic fields. Accordingly, as compared to magnetic alignment system 1050, magnetic alignment system 1000 can help to reduce the overall size of a device in which primary alignment component 1016 is positioned and can also help reduce noise created by magnetic field 1040 in adjacent components or devices, such as a power-receiving device in which secondary alignment component 1018 is positioned.

It will be appreciated that magnetic alignment system 1000 is illustrative and that variations and modifications are possible. For instance, while primary alignment component 1016 and secondary alignment component 1018 are each shown as being constructed of eight arcuate magnets, other embodiments may use a different number of magnets, such as sixteen magnets, thirty-six magnets, or any other number of magnets, and the number of primary magnets need not be equal to the number of secondary magnets. In other embodiments, secondary alignment component 1018 can be formed of a single, monolithic annular magnet. Similarly, primary alignment component 1016 can be formed of a single, monolithic annular piece of magnetic material with an appropriate magnetization pattern as described above, or primary alignment component 1016 can be formed of a monolithic inner annular magnet and a monolithic outer annular magnet, with an annular air gap or region of non-magnetic material disposed between the inner annular magnet and outer annular magnet. In some embodiments, a construction using multiple arcuate magnets may improve manufacturing because smaller arcuate magnets are less brittle than a single, monolithic annular magnet and are less prone to yield loss due to physical stresses imposed on the magnetic material during manufacturing. It should also be understood that the magnetic orientations of the various magnetic alignment components or individual magnets do not need to align exactly with the lateral and axial directions. The magnetic orientation can have any angle that provides a closed-loop path for a magnetic field through the primary and secondary alignment components.

Figure 11:
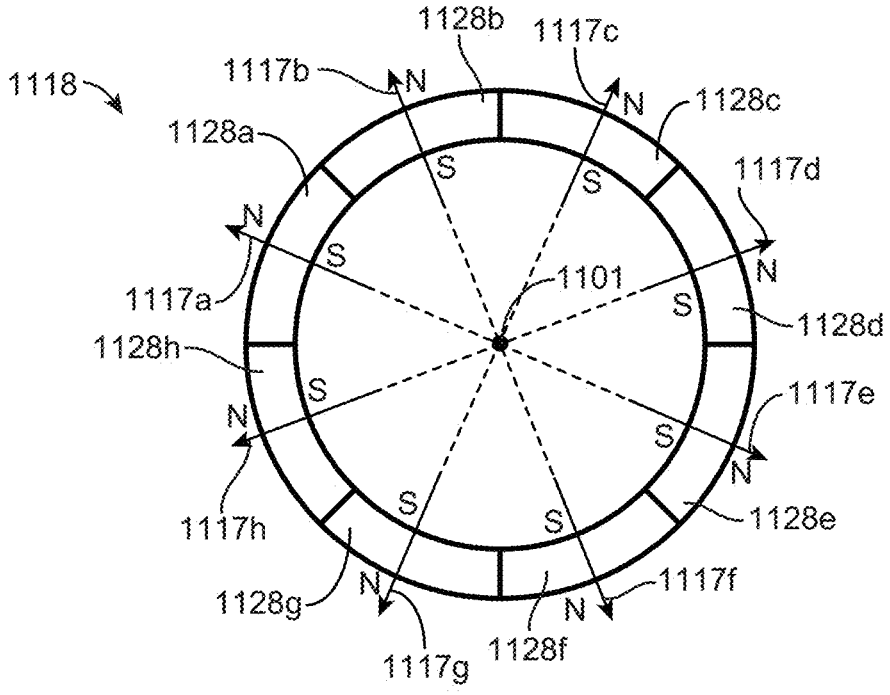
FIG. 11 shows a simplified top-down view of a secondary alignment component according to some embodiments.

As noted above, in embodiments of magnetic alignment systems having closed-loop magnetic orientations, such as magnetic alignment system 1000, secondary alignment component 1018 can have a magnetic orientation in the transverse plane. For example, in some embodiments, secondary alignment component 1018 can have a magnetic polarity in a radial orientation. FIG. 11 shows a simplified top-down view of a secondary alignment component 1118 according to some embodiments having secondary magnets 1128*a-h* with radial magnetic orientations as shown by magnetic polarity indicators 1117*a-h*. In this example, each secondary magnet 1128*a-h* has a north magnetic pole oriented toward the radially outward side and a south magnetic pole toward the radially inward side; however, this orientation can be reversed, and the north magnetic pole of each secondary magnet 1128*a-h* can be oriented toward the radially inward side while the south magnetic pole is oriented toward the radially outward side.

Figure 12A:
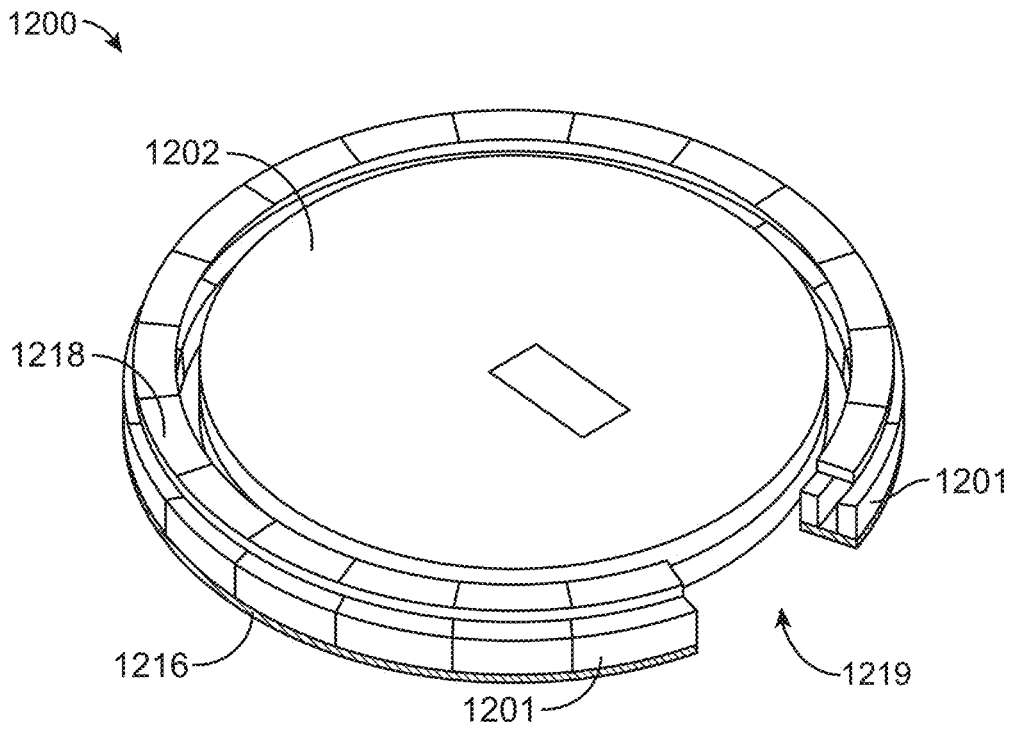
FIG. 12A shows a perspective view of a magnetic alignment system according to some embodiments.

FIG. 12A shows a perspective view of a magnetic alignment system 1200 according to some embodiments. Magnetic alignment system 1200, which can be an implementation of magnetic alignment system 1000, includes a secondary alignment component 1218 having a radially outward magnetic orientation (e.g., as shown in FIG. 11) and a complementary primary alignment component 1216. In this example, magnetic alignment system 1200 includes a gap 1219 between two of the sectors; however, gap 1219 is optional and magnetic alignment system 1200 can be a complete annular structure. Also shown are components 1202, which can include, for example an inductive coil assembly or other components located within the central region of primary magnetic alignment component 1216 or secondary magnetic alignment component 1218. Magnetic alignment system 1200 can have a closed-loop configuration similar to magnetic alignment system 1000 (as shown in FIG. 10B) and can include arcuate sectors 1201, each of which can be made of one or more arcuate magnets. In some embodiments, the closed-loop configuration of magnetic alignment system 1200 can reduce or prevent magnetic field leakage that may affect components 1202.

Figure 12B:
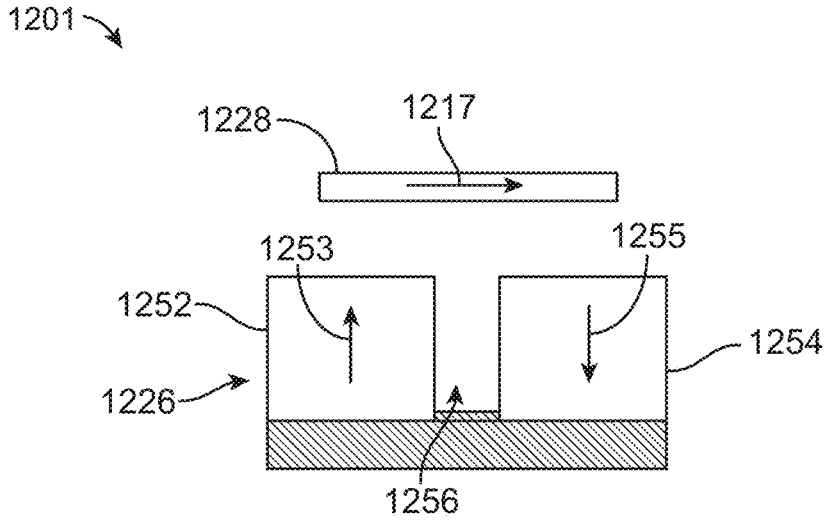

FIG. 12B shows an axial cross-section view through one of arcuate sectors 1201. Arcuate sector 1201 includes a primary magnet 1226 and a secondary magnet 1228. As shown by orientation indicator 1217, secondary magnet 1228 has a magnetic polarity oriented in a radially outward direction, i.e., the north magnetic pole is toward the radially outward side of magnetic alignment system 1200. Like primary magnets 1026 described above, primary magnet 1226 includes an inner arcuate magnetic region 1252, an outer arcuate magnetic region 1254, and a central non-magnetized region 1256 (which can include, e.g., an air gap or a region of nonmagnetic or non-magnetized material). Inner arcuate magnetic region 1252 has a magnetic polarity oriented axially such that the north magnetic pole is toward secondary magnet 1228, as shown by indicator 1253, while outer arcuate magnetic region 1254 has an opposite magnetic orientation, with the south magnetic pole oriented toward secondary magnet 1228, as shown by indicator 1255. As described above with reference to FIG. 15B, the arrangement of magnetic orientations shown in FIG. 12B results in magnetic attraction between primary magnet 1226 and secondary magnet 1228. In some embodiments, the magnetic polarities can be reversed such that the north magnetic pole of secondary magnet 1228 is oriented toward the radially inward side of magnetic alignment system 1200, the north magnetic pole of outer arcuate region 1254 of primary magnet 1226 is oriented toward secondary magnet 1228, and the north magnetic pole of inner arcuate region 1252 is oriented away from secondary magnet 1228.

When primary alignment component 1216 and secondary alignment component 1218 are aligned, the radially symmetrical arrangement and directional equivalence of magnetic polarities of primary alignment component 1216 and secondary alignment component 1218 allow secondary alignment component 1218 to rotate freely (relative to primary alignment component 1216) in the clockwise or counterclockwise direction in the lateral plane while maintaining alignment along the axis.

Figure 12C:
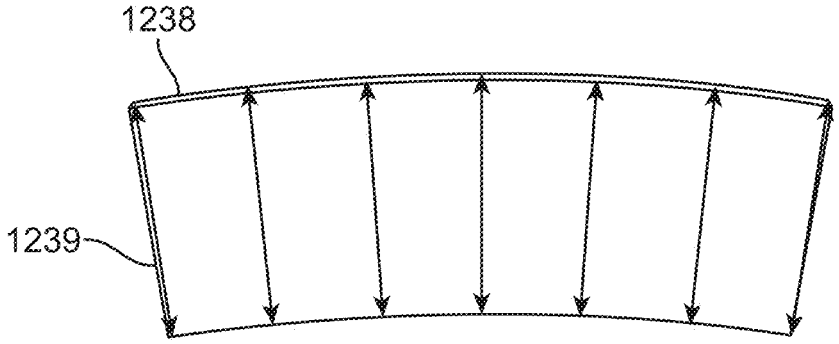
FIGS. 12C through 12E show examples of arcuate magnets with radial magnetic orientation according to some embodiments.
Figure 12D:
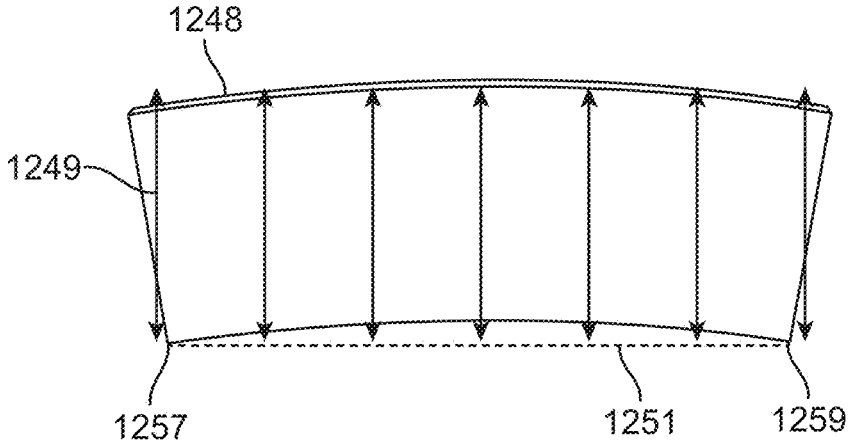
Figure 12E:
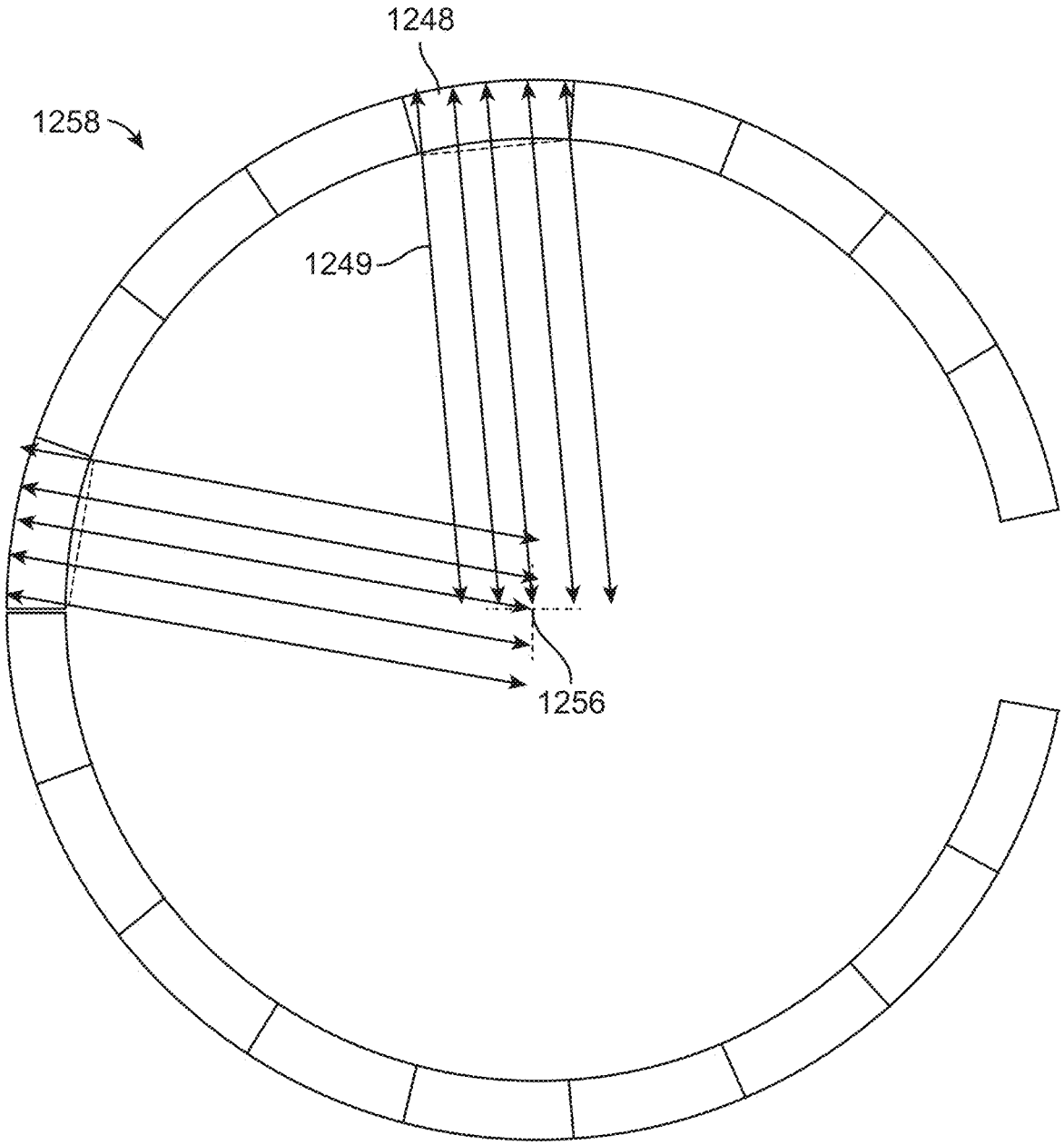

As used herein, a "radial" orientation need not be exactly or purely radial. For example, FIG. 12C shows a secondary arcuate magnet 1238 according to some embodiments. Secondary arcuate magnet 1238 has a purely radial magnetic orientation, as indicated by arrows 1239. Each arrow 1239 is directed at the center of curvature of magnet 1238; if extended inward, arrows 1239 would converge at the center of curvature. However, achieving this purely radial magnetization requires that magnetic domains within magnet 1238 be oriented obliquely to neighboring magnetic domains. For some types of magnetic materials, purely radial magnetic orientation may not be practical. Accordingly, some embodiments use a "pseudo-radial" magnetic orientation that approximates the purely radial orientation of FIG. 12C. FIG. 12D shows a secondary arcuate magnet 1248 with pseudo-radial magnetic orientation according to some embodiments. Magnet 1248 has a magnetic orientation, shown by arrows 1249, that is perpendicular to a baseline 1251 connecting the inner corners 1257, 1259 of arcuate magnet 1248. If extended inward, arrows 1249 would not converge. Thus, neighboring magnetic domains in magnet 1248 are parallel to each other, which is readily achievable in magnetic materials such as NdFeB. The overall effect in a magnetic alignment system, however, can be similar to the purely radial magnetic orientation shown FIG. 12C. FIG. 12E shows a secondary annular alignment component 1258 made up of magnets 1248 according to some embodiments. Magnetic orientation arrows 1249 have been extended to the center point 1261 of annular alignment component 1258. As shown the magnetic field direction can be approximately radial, with the closeness of the approximation depending on the number of magnets 1248 and the inner radius of annular alignment component 1258. In some embodiments, 138 magnets 1248 can provide a pseudo-radial orientation; in other embodiments, more or fewer magnets can be used. It should be understood that all references herein to magnets having a "radial" magnetic orientation include pseudo-radial magnetic orientations and other magnetic orientations that are approximately but not purely radial.

In some embodiments, a radial magnetic orientation in a secondary alignment component 1218 (e.g., as shown in FIG. 12B) provides a magnetic force profile between secondary alignment component 1218 and primary alignment component 1216 that is the same around the entire circumference of the magnetic alignment system. The radial magnetic orientation can also result in greater magnetic permeance, which allows secondary alignment component 1218 to resist demagnetization as well as enhancing the attractive force in the axial direction and improving shear force in the lateral directions when the two components are aligned.

Figure 13A:
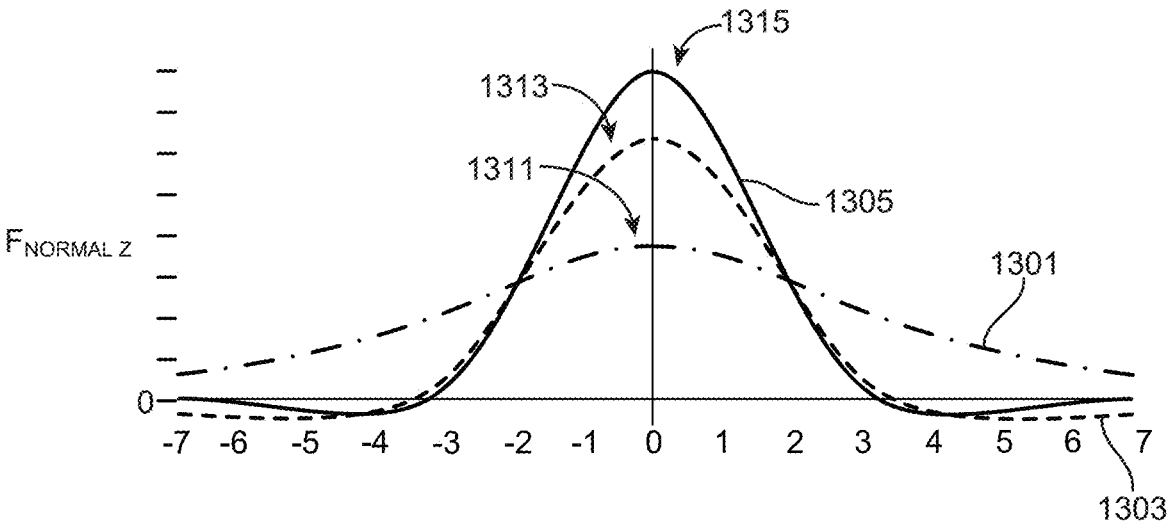
FIGS. 13A and 13B show graphs of force profiles for different magnetic alignment systems, according to some embodiments.
Figure 13B:
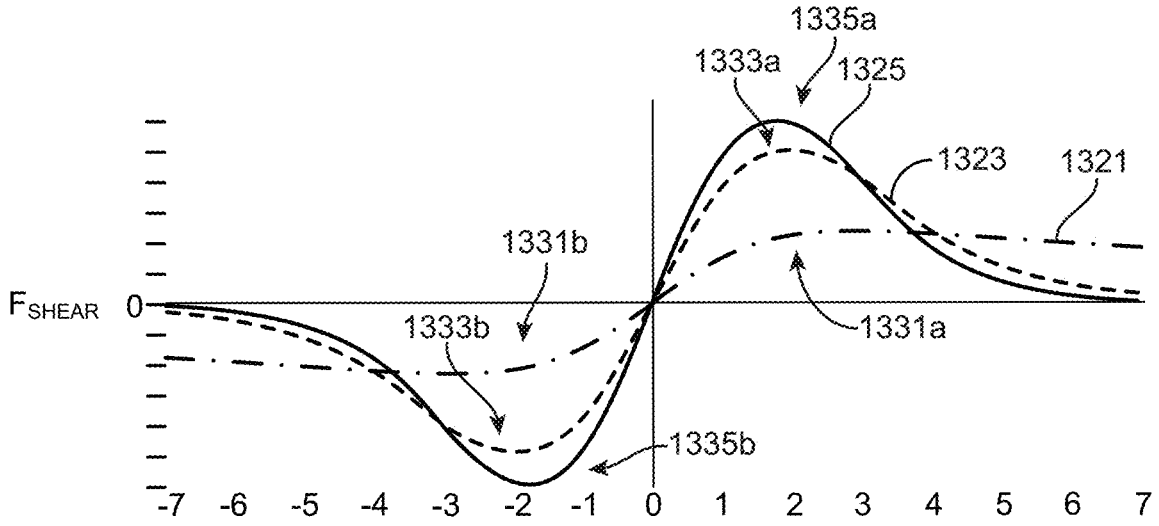

FIGS. 13A and 13B show graphs of force profiles for different magnetic alignment systems, according to some embodiments. Specifically, FIG. 13A shows a graph 1300 of vertical attractive (normal) force in the axial (z) direction for different magnetic alignment systems of comparable size and using similar types of magnets. Graph 1300 has a horizontal axis representing displacement from a center of alignment, where 0 represents the aligned position and negative and positive values represent left and right displacements from the aligned position in arbitrary units, and a vertical axis showing the normal force ($F_{NORMAL}$) as a function of displacement in arbitrary units. For purposes of this description, $F_{NORMAL}$ is defined as the magnetic force between the primary and secondary alignment components in the axial direction; $F_{NORMAL}>0$ represents attractive force while $F_{NORMAL}<0$ represents repulsive force. Graph 1300 shows normal force profiles for three different types of magnetic alignment systems. A first type of magnetic alignment system uses central alignment components, such as a pair of complementary disc-shaped magnets placed along an axis; a representative normal force profile for a "central" magnetic alignment system is shown as line 1301 (dot-dash line). A second type of magnetic alignment system uses annular alignment components with axial magnetic orientations, e.g., magnetic alignment system 900 of FIGS. 9A and 9B; a representative normal force profile for such an annular-axial magnetic alignment system is shown as line 1303 (dashed line). A third type of magnetic alignment system uses annular alignment components with closed-loop magnetic orientations and radial symmetry (e.g., magnetic alignment system 1200 of FIG. 12); a representative normal force profile for a radially symmetric closed-loop magnetic alignment system is shown as line 1305 (solid line).

Similarly, FIG. 13B shows a graph 1320 of lateral (shear) force in a transverse direction for different magnetic alignment systems. Graph 1320 has a horizontal axis representing displacement from a center of alignment using the same convention and units as graph 1300, and a vertical axis showing the shear force ($F_{SHEAR}$) as a function of direction in arbitrary units. For purposes of this description, $F_{SHEAR}$ is defined as the magnetic force between the primary and secondary alignment components in the lateral direction; $F_{SHEAR}>0$ represents force toward the left along the displacement axis while $F_{SHEAR}<0$ represents force toward the right along the displacement axis. Graph 1320 shows shear force profiles for the same three types of magnetic alignment systems as graph 1300: a representative shear force profile for a central magnetic alignment system is shown as line 1321 (dot-dash line); a representative shear force profile for an annular-axial magnetic alignment system is shown as line 1323 (dashed line); and a representative normal force profile for a radially symmetric closed-loop magnetic alignment system is shown as line 1325 (solid line).

As shown in FIG. 13A, each type of magnetic alignment system achieves the strongest magnetic attraction in the axial direction when the primary and secondary alignment components are in the aligned position (0 on the horizontal axis), as shown by respective peaks 1311, 1313, and 1315. While the most strongly attractive normal force is achieved in the aligned positioned for all systems, the magnitude of the peak depends on the type of magnetic alignment system. In particular, a radially-symmetric closed-loop magnetic alignment system (e.g., magnetic alignment system 1200 of FIG. 12) provides stronger magnetic attraction when in the aligned position than the other types of magnetic alignment systems. This strong attractive normal force can overcome small misalignments due to frictional force and can achieve a more accurate and robust alignment between the primary and secondary alignment components, which in turn can provide a more accurate and robust alignment between a portable electronic device and a wireless charging device within which the magnetic alignment system is implemented.

As shown in FIG. 13B, the strongest shear forces (attractive or repulsive) are obtained when the primary and secondary alignment components are laterally just outside of the aligned position, e.g., at −2 and +2 units of separation from the aligned position, as shown by respective peaks 1331*a-b*, 1333*a-b*, and 1335*a-b*. Similarly to the normal force, the magnitude of the peak strength of shear force depends on the type of magnetic alignment system. In particular, a radially-symmetric closed-loop magnetic alignment system (e.g., magnetic alignment system 1200 of FIG. 12) provides higher magnitude of shear force when just outside of the aligned position than the other types of magnetic alignment systems. This strong shear force can provide tactile feedback to help the user identify when the two components are aligned. In addition, like the strong normal force, the strong shear force can overcome small misalignments due to frictional force and can achieve a more accurate and robust alignment between the primary and secondary alignment components, which in turn can provide a more accurate and robust alignment between a portable electronic device and a wireless charging device within which the magnetic alignment system is implemented.

A radially-symmetric closed-loop magnetic alignment system (e.g., magnetic alignment system 1200 of FIG. 12) can provide accurate and robust alignment in the axial and lateral directions. Further, because of the radial symmetry, the alignment system does not have a preferred rotational orientation in the lateral plane about the axis; the shear force profile is the same regardless of relative rotational orientation of the electronic devices being aligned.

Figure 14:
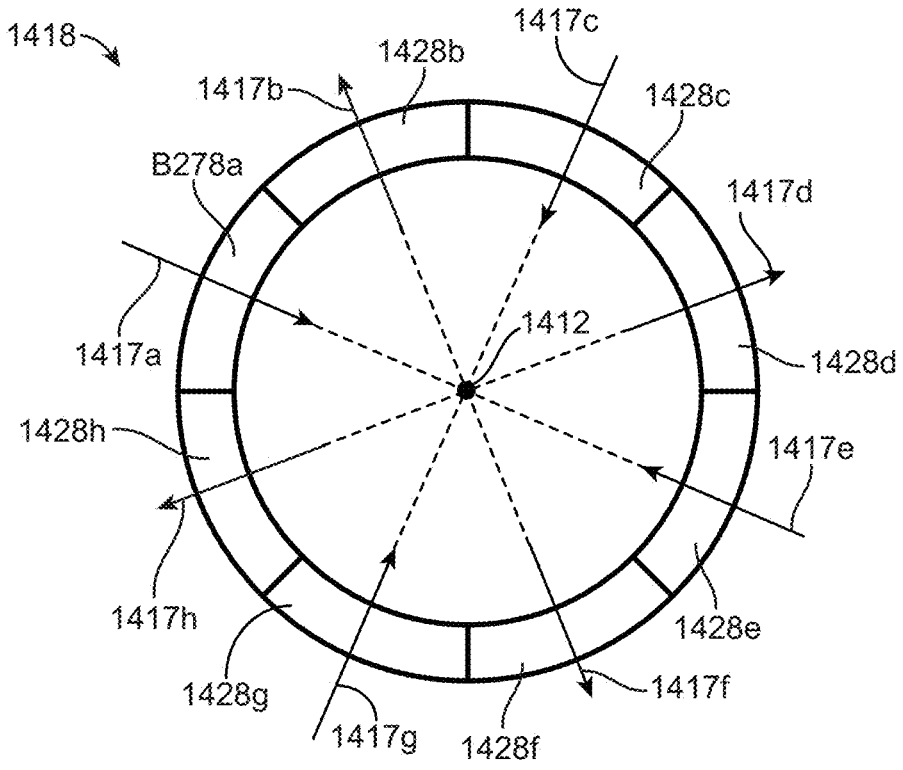
FIG. 14 shows a simplified top-down view of a secondary alignment component according to some embodiments.

In some embodiments, a closed-loop magnetic alignment system can be designed to provide one or more preferred rotational orientations. FIG. 14 shows a simplified top-down view of a secondary alignment component 1418 according to some embodiments. Secondary alignment component 1418 includes sectors 1428*a-h* with radial magnetic orientations as shown by magnetic polarity indicators 1417*a-h*. Each of sectors 1428*a-h* can include one or more secondary arcuate magnets (not shown). In this example, secondary magnets in sectors 1428*b*, 1428*d*, 1428*f*, and 1428*h* each have a north magnetic pole oriented toward the radially outward side and a south magnetic pole toward the radially inward side, while secondary magnets in sectors 1428*a*, 1428*c*, 1428*e*, and 1428*g* each have a north magnetic pole oriented toward the radially inward side and a south magnetic pole toward the radially outward side. In other words, magnets in sectors 1428*a-h* of secondary alignment component 1418 have alternating magnetic orientations. A complementary primary alignment component can have sectors with correspondingly alternating magnetic orientations.

Figure 15A:
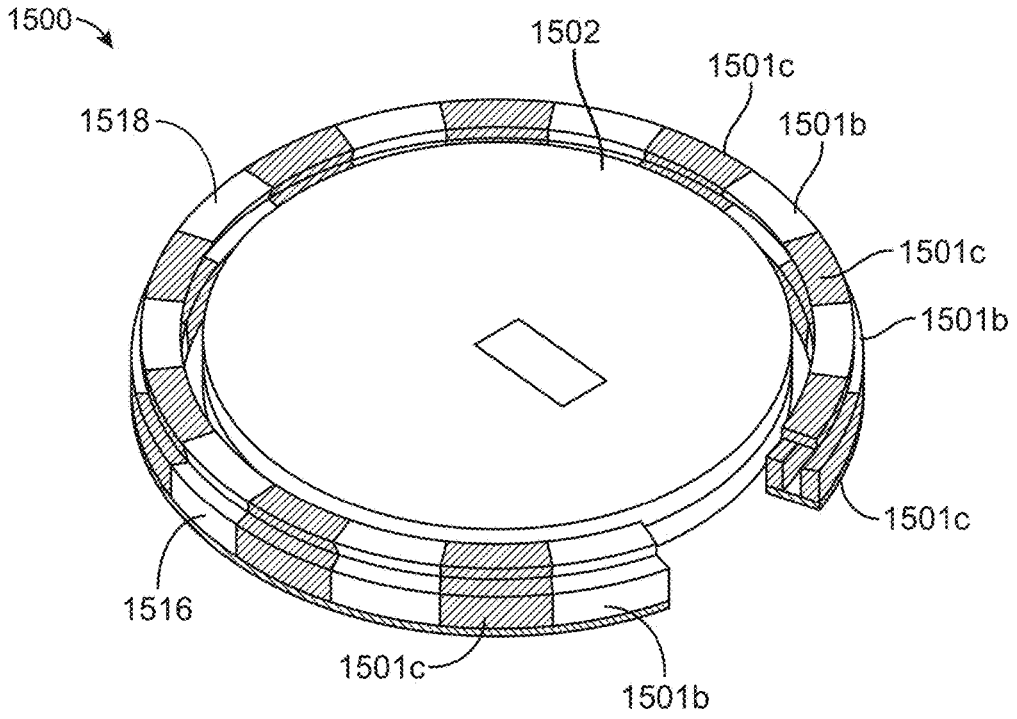
FIG. 15A shows a perspective view of a magnetic alignment system according to some embodiments.

For example, FIG. 15A shows a perspective view of a magnetic alignment system 1500 according to some embodiments. Magnetic alignment system 1500 includes a secondary alignment component 1518 having alternating radial magnetic orientations (e.g., as shown in FIG. 14) and a complementary primary alignment component 1516. Some of the arcuate sections of magnetic alignment system 1500 are not shown in order to reveal internal structure; however, it should be understood that magnetic alignment system 1500 can be a complete annular structure. Also shown are components 1502, which can include, for example, inductive coil assemblies or other components located within the central region of primary annular alignment component 1516 and/or secondary annular alignment component 1518. Magnetic alignment system 1500 can be a closed-loop magnetic alignment system similar to magnetic alignment system 1000 described above and can include arcuate sectors 1501*b*, 1501*c* of alternating magnetic orientations, with each arcuate sector 1501*b*, 1501*c* including one or more arcuate magnets in each of primary annular alignment component 1516 and secondary annular alignment component 1518. In some embodiments, the closed-loop configuration of magnetic alignment system 1500 can reduce or prevent magnetic field leakage that may affect component 1502.

Figure 15B:
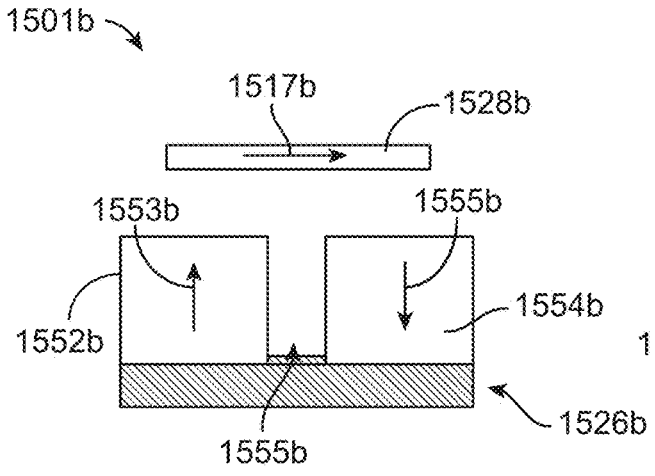
FIGS. 15B and 15C show axial cross-section views through different portions of the system of FIG. 15A.
Figure 15C:
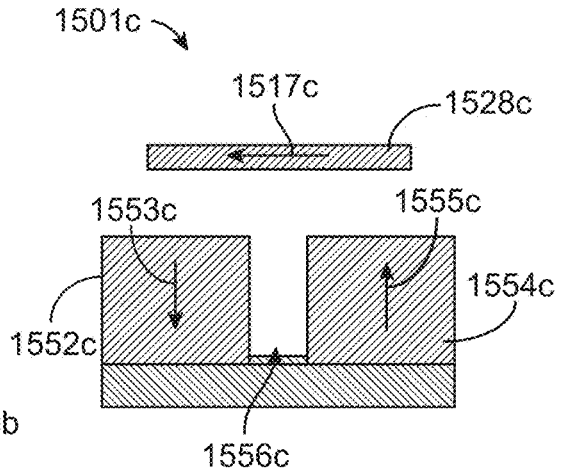

FIG. 15B shows an axial cross-section view through one of arcuate sectors 1501*b*, and FIG. 15C shows an axial cross-section view through one of arcuate sectors 1501*c*. Arcuate sector 1501*b* includes a primary magnet 1526*b* and a secondary magnet 1528*b*. As shown by orientation indicator 1517*b*, secondary magnet 1528*b* has a magnetic polarity oriented in a radially outward direction, i.e., the north magnetic pole is toward the radially outward side of magnetic alignment system 1500. Like primary magnets 1026 described above, primary magnet 1526*b* includes an inner arcuate magnetic region 1552*b*, an outer arcuate magnetic region 1554*b*, and a central nonmagnetic region 1556*b* (which can include, e.g., an air gap or a region of nonmagnetic material). Inner arcuate magnetic region 1552*b* has a magnetic polarity oriented axially such that the north magnetic pole is toward secondary magnet 1528*b*, as shown by indicator 1553*b*, while outer arcuate magnetic region 1554*b* has an opposite magnetic orientation, with the south magnetic pole oriented toward secondary magnet 1528*b*, as shown by indicator 1555*b*. As described above with reference to FIG. 10B, the arrangement of magnetic orientations shown in FIG. 15B results in magnetic attraction between primary magnet 1526*b* and secondary magnet 1528*b*.

As shown in FIG. 15C, arcuate sector 1501*c* has a "reversed" magnetic orientation relative to arcuate sector 1501*b*. Arcuate sector 1501*c* includes a primary magnet 1526*c* and a secondary magnet 1528*c*. As shown by orientation indicator 1517*c*, secondary magnet 1528*c* has a magnetic polarity oriented in a radially inward direction, i.e., the north magnetic pole is toward the radially inward side of magnetic alignment system 1500. Like primary magnets 1026 described above, primary magnet 1526*c* includes an inner arcuate magnetic region 1552*c*, an outer arcuate magnetic region 1554*c*, and a central nonmagnetic region 1556*c* (which can include, e.g., an air gap or a region of nonmagnetic material). Inner arcuate magnetic region 1552*c* has a magnetic polarity oriented axially such that the south magnetic pole is toward secondary magnet 1528*c*, as shown by indicator 1553*c*, while outer arcuate magnetic region 1554*c* has an opposite magnetic orientation, with the north magnetic pole oriented toward secondary magnet 1528*c*, as shown by indicator 1555*c*. As described above with reference to FIG. 10B, the arrangement of magnetic orientations shown in FIG. 15C results in magnetic attraction between primary magnet 1526*c* and secondary magnet 1528*c*.

An alternating arrangement of magnetic polarities as shown in FIGS. 14 and 15A-20C can create a "ratcheting" feel when secondary alignment component 1518 is aligned with primary alignment component 1516 and one of alignment components 1516, 1518 is rotated relative to the other about the common axis. For instance, as secondary alignment component 1518 is rotated relative to primary alignment component 1516, radially-outward secondary magnet 1528*b* alternately come into proximity with a complementary primary magnet 1526*b* of primary alignment component 1516, resulting in an attractive magnetic force, and with an anti-complementary magnet 1526*c* of primary alignment component 1516, resulting in a repulsive magnetic force. If primary magnets 1526*b*, 1526*c* and secondary magnets 1528*b*, 1528*c* have the same angular size and spacing, in any given orientation, each pair of magnets will experience similar net attractive or repulsive magnetic forces such that alignment is stable and robust in rotational orientations in which complementary pairs of magnets 1526*b*, 1528*b* and 1526*c*, 1528*c* are in proximity. In other rotational orientations, a torque toward a stable rotational orientation can be experienced.

Figure 16A:
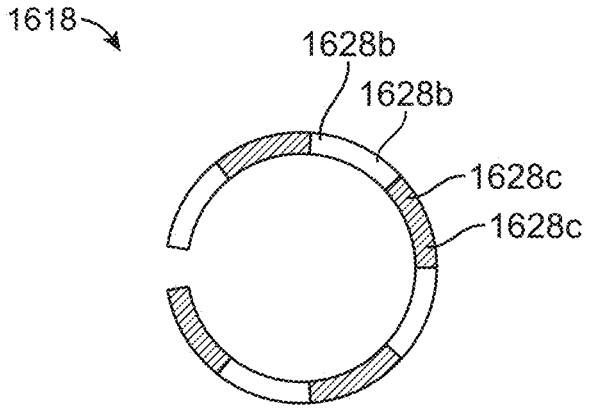
FIGS. 16A and 16B show simplified top-down views of secondary alignment components according to various embodiments.
Figure 16B:
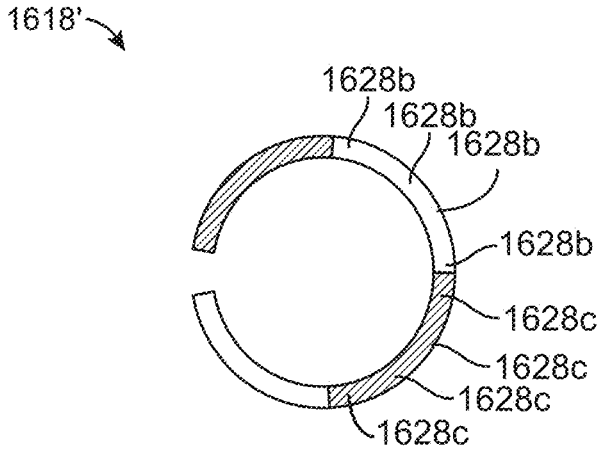

In the examples shown in FIGS. 14 and 15A through 15C, each sector includes one magnet, and the direction of magnetic orientation alternates with each magnet. In some embodiments, a sector can include two or more magnets having the same direction of magnetic orientation. For example, FIG. 16A shows a simplified top-down view of a secondary alignment component 1618 according to some embodiments. Secondary alignment component 1618 includes secondary magnets 1628*b* with radially outward magnetic orientations and secondary magnets 1628*c* with radially inward orientations, similarly to secondary alignment component 1518 described above. In this example, the magnets are arranged such that a pair of outwardly-oriented magnets 1628*b* (forming a first sector) are adjacent to a pair of inwardly-oriented magnets 1628*c* (forming a second sector adjacent to the first sector). The pattern of alternating sectors (with two magnets per sector) repeats around the circumference of secondary alignment component 1618. Similarly, FIG. 16B shows a simplified top-down view of another secondary alignment component 1618' according to some embodiments. Secondary alignment component 1618' includes secondary magnets 1628*b* with radially outward magnetic orientations and secondary magnets 1628*c* with radially inward orientations. In this example, the magnets are arranged such that a group of four radially-outward magnets 1628*b* (forming a first sector) is adjacent to a group of four radially-inward magnets 1628*c* (forming a second sector adjacent to the first sector). The pattern of alternating sectors (with four magnets per sector) repeats around the circumference of secondary alignment component 1618'. Although not shown in FIGS. 16A and 16B, the structure of a complementary primary alignment component for secondary alignment component 1618 or 1618' should be apparent in view of FIGS. 15A-20C. A shear force profile for the alignment components of FIGS. 16A and 16B can be similar to the ratcheting profile described above, although the number of rotational orientations that provide stable alignment will be different.

Figure 17:
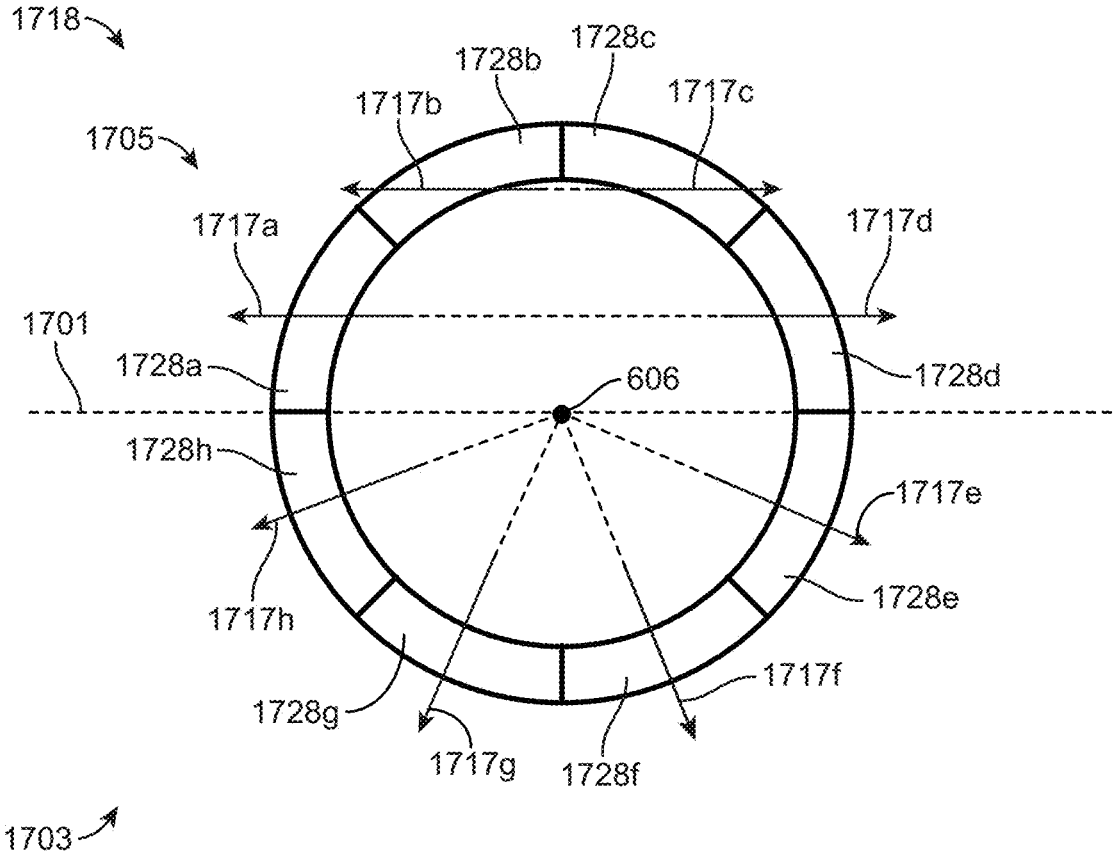
FIG. 17 shows a simplified top-down view of a secondary alignment component according to some embodiments.

In other embodiments, a variety of force profiles can be created by changing the alignment of different component magnets of the primary and/or secondary alignment components. As just one example, FIG. 17 shows a simplified top-down view of a secondary alignment component 1718 according to some embodiments having sectors 1728*a-h* with location-dependent magnetic orientations as shown by magnetic polarity indicators 1717*a-h*. In this example, secondary alignment component 1718 can be regarded as bisected by bisector line 1701, which defines two halves of secondary alignment component 1718. In a first half 1703, sectors 1728*e-h* have magnetic polarities oriented radially outward, similarly to examples described above.

In the second half-annulus 1705, sectors 1728*a-d* have magnetic polarities oriented substantially parallel to bisector line 1701 rather than radially. In particular, sectors 1728*a* and 1728*b* have magnetic polarities oriented in a first direction parallel to bisector line 1701, while sectors 1728*c* and 1728*d* have magnetic polarities oriented in the direction opposite to the direction of the magnetic polarities of sectors 1728*a* and 1728*b*. A complementary primary alignment component can have an inner annular region with magnetic north pole oriented toward secondary alignment component 1718, an outer annular region with magnetic north pole oriented away from secondary alignment component 1718, and a central non-magnetized region, providing a closed-loop magnetic orientation as described above. The asymmetric arrangement of magnetic orientations in secondary alignment component 1718 can modify the shear force profile such that secondary alignment component 1718 generates less shear force in the direction toward second half-annulus 1705 than in the direction toward first half 1703. In some embodiments, an asymmetrical arrangement of this kind can be used where the primary alignment component is mounted in a docking station and the secondary alignment component is mounted in a portable electronic device that docks with the docking station. Assuming secondary annular alignment component 1718 is oriented in the portable electronic device such that half-annulus 1705 is toward the top of the portable electronic device, the asymmetric shear force can facilitate an action of sliding the portable electronic device downward to dock with the docking station or upward to remove it from the docking station, while still providing an attractive force to draw the portable electronic device into a desired alignment with the docking station.

It will be appreciated that the foregoing examples are illustrative and not limiting. Sectors of a primary and/or secondary alignment component can include magnetic elements with the magnetic polarity oriented in any desired direction and in any combination, provided that the primary and secondary alignment components of a given magnetic alignment system have complementary magnetic orientations to provide forces toward the desired position of alignment. Different combinations of magnetic orientations may create different shear force profiles, and the selection of magnetic orientations may be made based on a desired shear force profile.

In various embodiments described above, a magnetic alignment system can provide robust alignment in a lateral plane and may or may not provide rotational alignment. For example, radially symmetric magnetic alignment system 1200 of FIGS. 12A-17B may not define a preferred rotational orientation. Radially alternating magnetic alignment system 1500 of FIGS. 15A-20C can define multiple equally preferred rotational orientations. For some applications, such as alignment of a portable electronic device with a wireless charging puck, rotational orientation may not be a concern. In other applications, such as alignment of a portable electronic device in attachable wallet 100 (shown above) a docking station or upright holder, a particular rotational alignment may be desirable. Accordingly, in some embodiments an annular magnetic alignment system can be augmented with one or more rotational alignment components that can be positioned externally to and spaced apart from the annular magnetic alignment components to help guide devices into a target rotational orientation relative to each other.

Figure 18:
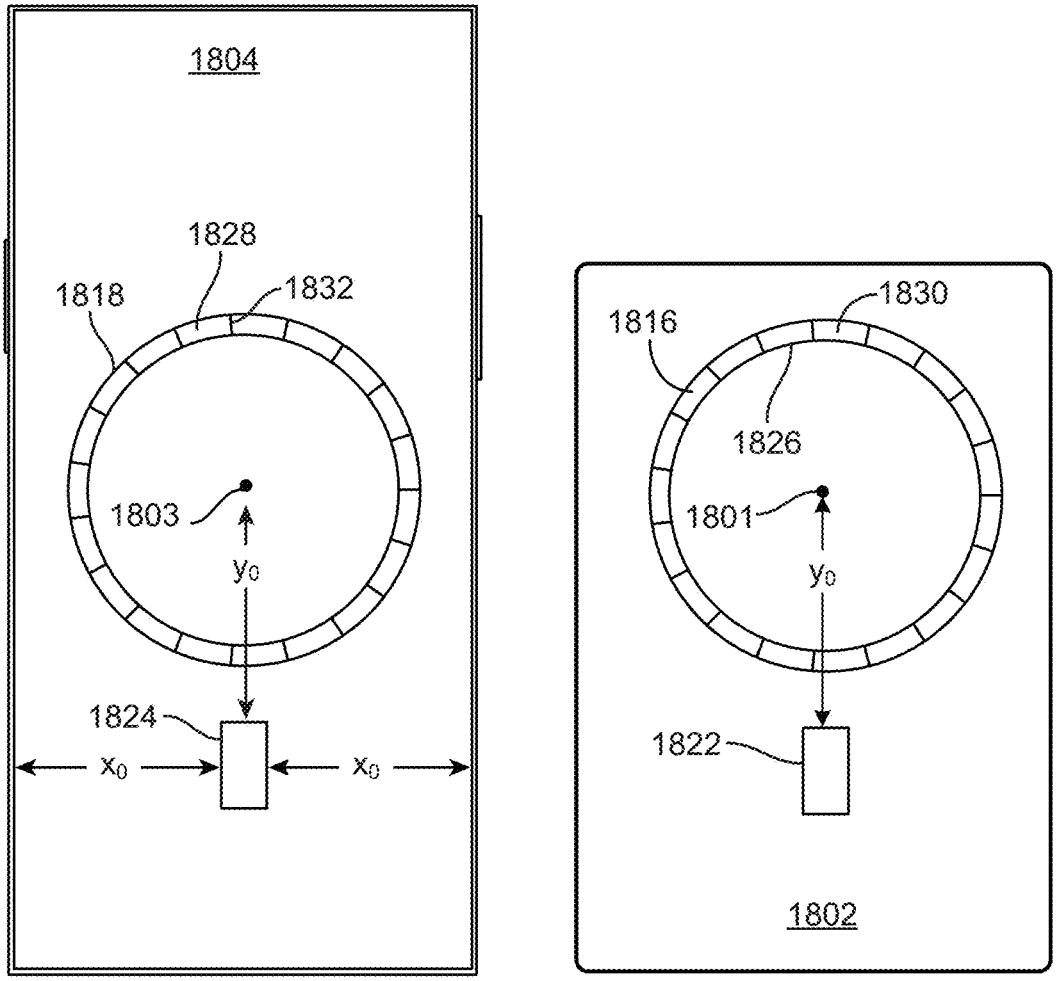
FIG. 18 shows an example of a magnetic alignment system with an annular alignment component and a rotational alignment component according to some embodiments.

FIG. 18 shows an example of a magnetic alignment system with an annular alignment component and a rotational alignment component according to some embodiments. In this example, primary alignment components of the magnetic alignment system are included in an accessory device 1802, and secondary alignment components of the magnetic alignment system are included in a portable electronic device 1804. Portable electronic device 1804 can be, for example, a smart phone whose front surface provides a touchscreen display and whose back surface is designed to support wireless charging. Accessory device 1802 can be, for example, a charging dock that supports portable electronic device 1804 such that its display is visible and accessible to a user. FIG. 18 shows proximal surfaces of portable electronic device 1804 and accessory device 1802. For instance, accessory device 1802 can support portable electronic device 1804 such that the display is vertical or at a conveniently tilted angle for viewing and/or touching. In the example shown, accessory device 1802 supports portable electronic device 1804 in a "portrait" orientation (shorter sides of the display at the top and bottom); however, in some embodiments accessory device 1802 can support portable electronic device 1804 in a "landscape" orientation (longer sides of the display at the top and bottom). Accessory device 1802 can also be mounted on a swivel, gimbal, or the like, allowing the user to adjust the orientation of portable electronic device 1804 by adjusting the orientation of accessory device 1802.

Accessory device 1802 can be used as all or part of attachable wallet 100 shown above, or as all or part of another attachable wallet according to an embodiment of the present invention.

As described above, components of a magnetic alignment system can include a primary annular alignment component 1816 disposed in accessory device 1802 and a secondary annular alignment component 1818 disposed in portable electronic device. Primary annular alignment component 1816 can be similar or identical to any of the primary alignment components described above. For example, primary annular alignment component 1816 can be formed of arcuate magnets 1826 arranged in an annular configuration. Although not shown in FIG. 18, one or more gaps can be provided in primary annular alignment component 1816, e.g., by omitting one or more of arcuate magnets 1826 or by providing a gap at one or more interfaces 1830 between adjacent arcuate magnets 1826. In some embodiments, each arcuate magnet 1826 can include an inner region having a first magnetic orientation (e.g., axially oriented in a first direction) and an outer region having a second magnetic orientation opposite the first magnetic orientation (e.g., axially oriented opposite the first direction), with a nonmagnetized gap region between the inner and outer regions (which can include an air gap or a nonmagnetic material). In some embodiments, primary annular alignment component can also include a shield (not shown) on the distal side of arcuate magnets 1826.

Likewise, secondary annular alignment component 1818 can be similar or identical to any of the secondary alignment components described above. For example, secondary annular alignment component 1818 can be formed of arcuate magnets 1828 arranged in an annular configuration. Although not shown in FIG. 18, one or more gaps can be provided in secondary annular alignment component 1818, e.g., by omitting one or more arcuate magnets 1828 or by providing a gap at one or more interfaces 1832 between adjacent magnets 1828. As described above, arcuate magnets 1828 can provide radially-oriented magnetic polarities. For instance, all sectors of secondary annular alignment component 1818 can have a radially-outward magnetic orientation or a radially-inward magnetic orientation, or some sectors of secondary annular alignment component 1818 may have a radially-outward magnetic orientation while other sectors of secondary annular alignment component 1818 have a radially-inward magnetic orientation.

As described above, primary annular alignment component 1816 and secondary annular alignment component 1818 can provide shear forces that promote alignment in the lateral plane so that center point 1801 of primary annular alignment component 1816 aligns with center point 1803 of secondary annular alignment component 1818. However, primary annular alignment component 1816 and secondary annular alignment component 1818 might not provide shear forces that favor any particular rotational orientation, such as portrait orientation.

Accordingly, in some embodiments, a magnetic alignment system can incorporate one or more rotational alignment components in addition to the annular alignment components. The rotational alignment components can include one or more magnets that provide torque about the common axis of the (aligned) annular alignment components, so that a preferred rotational orientation can be reliably established. For example, as shown in FIG. 18, a primary rotational alignment component 1822 can be disposed outside of and spaced apart from primary annular alignment component 1816 while a secondary rotational alignment component 1824 is disposed outside of and spaced apart from secondary annular alignment component 1818. Secondary rotational alignment component 1824 can be positioned at a fixed distance ($y_0$) from center point 1803 of secondary annular alignment component 1818 and centered between the side edges of portable electronic device 1804 (as indicated by distance xo from either side edge). Similarly, primary rotational alignment component 1822 can be positioned at the same distance $y_0$ from center point 1801 of primary annular alignment component 1816 and located at a rotational angle that results in a torque profile that favors the desired orientation of portable electronic device 1804 relative to accessory device 1802 when secondary rotational alignment component 1824 is aligned with primary rotational alignment component 1822. It should be noted that the same distance $y_0$ can be applied in a variety of portable electronic devices having different form factors, so that a single accessory can be compatible with a family of portable electronic devices. A longer distance $y_0$ can increase torque toward the preferred rotational alignment; however, the maximum distance $y_0$ may be limited by design considerations, such as the size of the smallest portable electronic device in a family of portable electronic devices that incorporate mutually compatible magnetic alignment systems.

According to some embodiments, each of primary rotational alignment component 1822 and secondary rotational alignment component 1824 can be implemented using one or more rectangular or square blocks of magnetic material each of which has each been magnetized such that its magnetic polarity is oriented in a desired direction. The magnetic orientations of rotational alignment components 1822 and 1824 can be complementary so that an attractive magnetic force is generated when the proximal surfaces of rotational alignment components 1822 and 1824 are near each other. This attractive magnetic force can help to rotate portable electronic device 1804 and accessory device 1802 into a preferred rotational orientation in which the proximal surfaces of rotational alignment components 1822 and 1824 are in closest proximity to each other. Examples of magnetic orientations for rotational alignment components 1822 and 1824 that can be used to provide a desired attractive force are described below. In some embodiments, primary rotational alignment component 1822 and secondary rotational alignment component 1824 can have the same lateral dimensions and the same thickness. The dimensions can be chosen based on a desired magnetic field strength, the dimensions of devices in which the rotational alignment components are to be deployed, and other design considerations. In some embodiments, the lateral dimensions can be about 6 mm by about 18 mm, and the thickness can be anywhere from about 0.3 mm to about 1.5 mm. In some embodiments, each of primary rotational alignment component 1822 and secondary rotational alignment component 1824 can be implemented using multiple rectangular blocks of magnetic material positioned adjacent to each other. As in other embodiments, a small gap may be present between adjacent magnets, e.g., due to manufacturing tolerances.

Figure 19A:
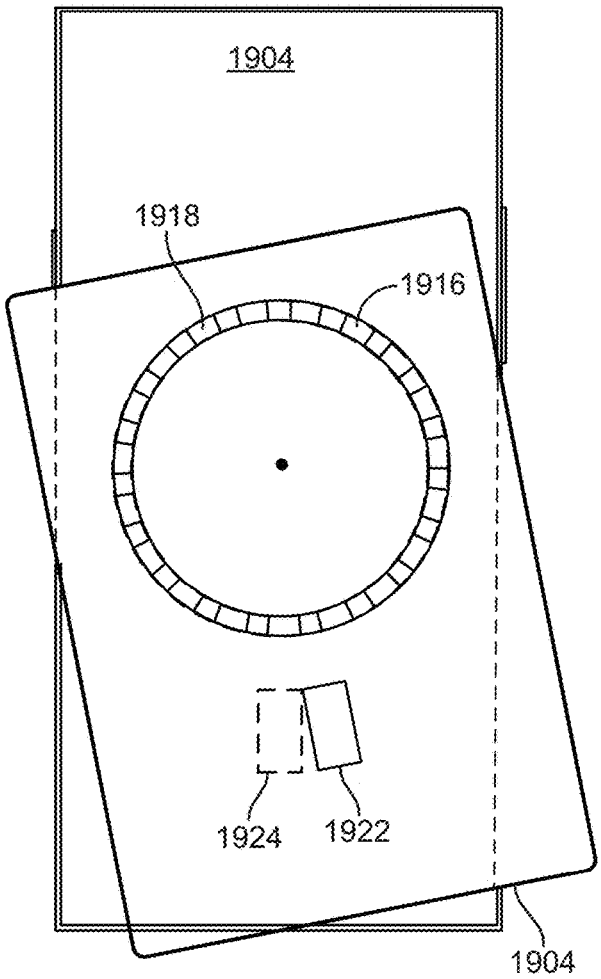
FIGS. 19A and 19B show an example of rotational alignment according to some embodiments.
Figure 19B:
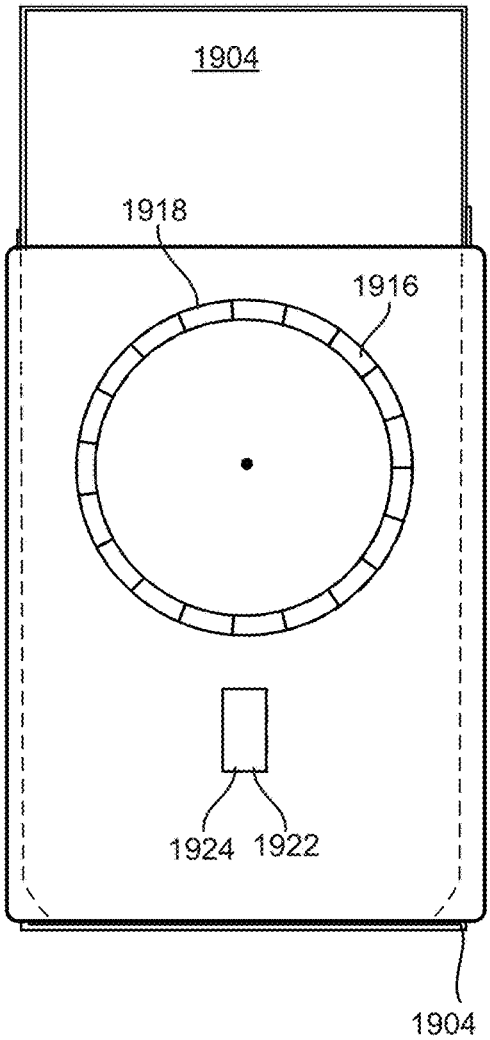

FIGS. 19A and 19B show an example of rotational alignment according to some embodiments. In FIG. 19A, accessory device 1802 is placed on the back surface of portable electronic device 1804 such that primary annular alignment component 1816 and secondary alignment component 1818 are aligned with each other in the lateral plane (which is the plane of the page in FIG. 19A); in the view shown, center point 1801 of primary annular alignment component 1816 overlies center point 1803 of secondary annular alignment component 1818 A relative rotation is present such that rotational alignment components 1822 and 1824 are not aligned. In this configuration, an attractive force between rotational alignment components 1822 and 1824 can help guide portable electronic device 1804 and accessory device 1802 into a target rotational orientation as shown in FIG. 12B. In FIG. 19B, the attractive magnetic force between rotational alignment components 1822 and 1824 has brought portable electronic device 1804 and accessory device 1802 into the target rotational alignment with the sides of portable electronic device 1804 parallel to the sides of accessory device 1802. In some embodiments, the same attractive magnetic force between rotational alignment components 1822 and 1824 can help to hold portable electronic device 1804 and accessory device 1802 in a fixed rotational alignment.

Rotational alignment components 1822 and 1824 can have various patterns of magnetic orientations. As long as the magnetic orientations of rotational alignment components 1822 and 1824 are complementary to each other, a torque toward the target rotational orientation can be present when the devices are brought into lateral alignment and close to the target rotational orientation. FIGS. 20A-28B show examples of magnetic orientations for a rotational alignment component according to various embodiments. While the magnetic orientation is shown for only one rotational alignment component, it should be understood that the magnetic orientation of a complementary rotational alignment component can be complementary to (e.g., the reverse of) the magnetic orientation of shown.

Figure 20A:
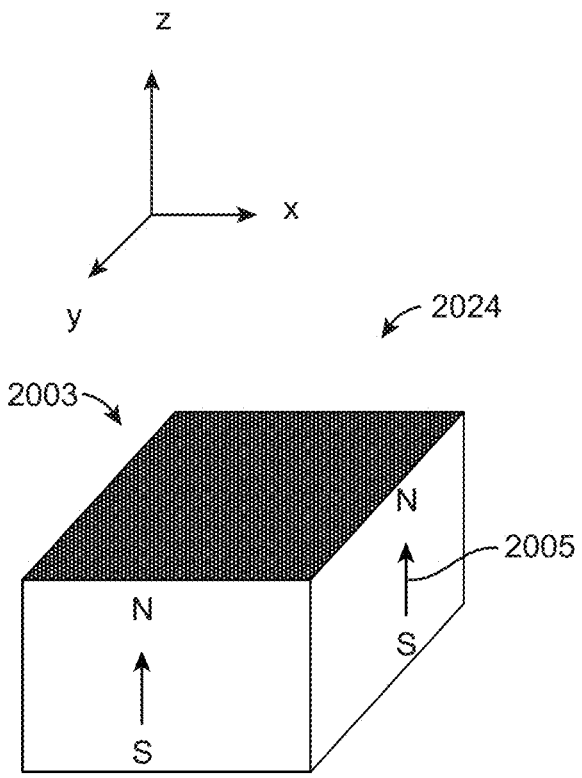
FIGS. 20A and 20B show a perspective view and a top view of a rotational alignment component having a "z-pole" configuration according to some embodiments.
Figure 20B:
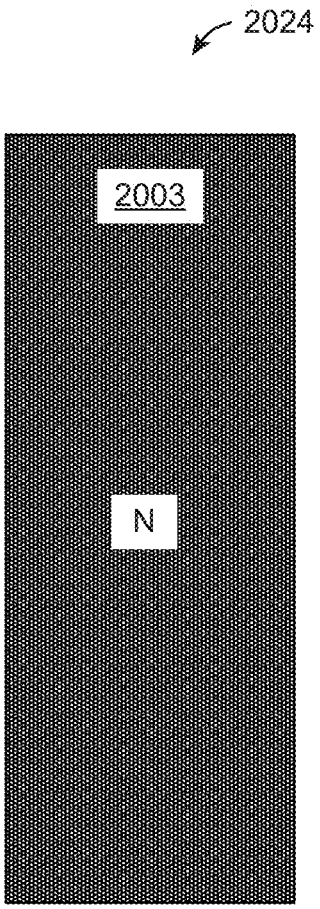

FIGS. 20A and 20B show a perspective view and a top view of a rotational alignment component 2024 having a "z-pole" configuration according to some embodiments. It should be understood that the perspective view is not to any particular scale and that the lateral (xy) dimensions and axial (z) thickness can be varied as desired. As shown in FIG. 20A, rotational alignment component 2024 can have a uniform magnetic orientation along the axial direction, as indicated by arrows 2005. Accordingly, as shown in FIG. 20B, a north magnetic pole (N) may be nearest the proximal surface 2003 of rotational alignment component 2024. A complementary z-pole alignment component can have a uniform magnetic orientation with a south magnetic pole nearest the proximal surface. The z-pole configuration can provide reliable alignment.

Other configurations can provide reliable alignment as well as a stronger, or more salient, "clocking" sensation for the user. A "clocking sensation," as used herein, refers to a user-perceptible torque about the common axis of the annular alignment components that pulls toward the target rotational alignment and/or resists small displacements from the target rotational alignment. A greater variation of torque as a function of rotational angle can provide a more salient clocking sensation. Following are examples of magnetization configurations for a rotational alignment component that can provide more salient clocking sensations than the z-pole configuration of FIGS. 20A and 20B.

Figure 21A:
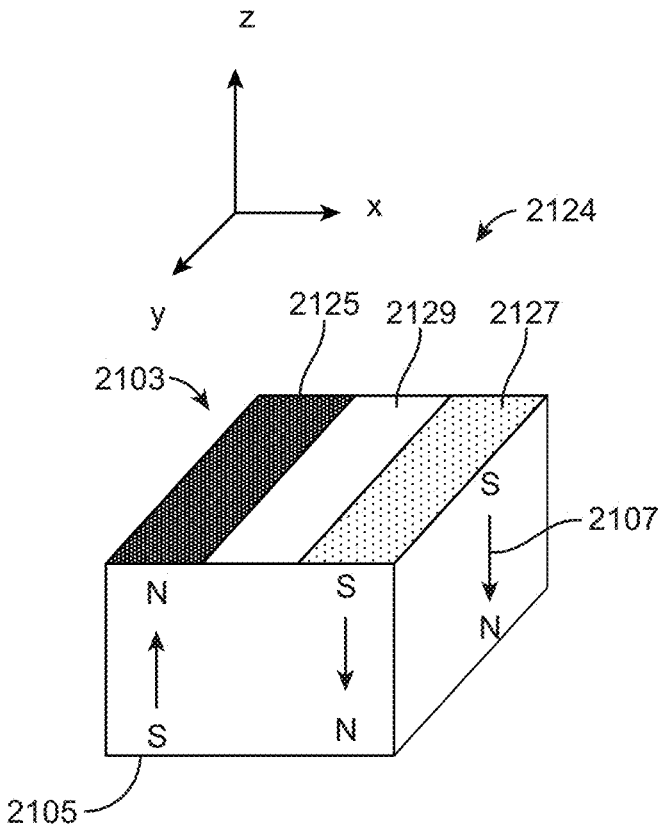
FIGS. 21A and 21B show a perspective view and a top view of a rotational alignment component having a "quad pole" configuration according to some embodiments.
Figure 21B:
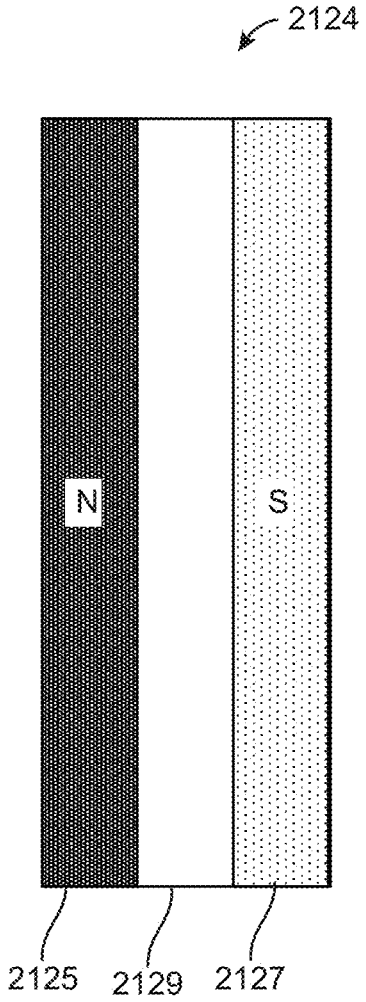

FIGS. 21A and 21B show a perspective view and a top view of a rotational alignment component 2124 having a "quad pole" configuration according to some embodiments. It should be understood that the perspective view is not to any particular scale and that the lateral (xy) dimensions and axial (z) thickness can be varied as desired. As shown in FIG. 21A, rotational alignment component 2124 has a first magnetized region 2125 with a magnetic orientation along the axial direction such that the north magnetic pole (N) is nearest the proximal (+z) surface 2103 of rotational alignment component 2124 (as indicated by arrow 2105) and a second magnetized region 2127 with a magnetic orientation opposite to the magnetic orientation of the first region such that the south magnetic pole (S) is nearest to proximal surface 2103 (as indicated by arrows 2107). Between magnetized regions 2125 and 2127 is a neutral region 2129 that is not magnetized. In some embodiments, rotational alignment component 2124 can be formed from a single piece of magnetic material that is exposed to a magnetizer to create regions 2125, 2127, 2129. Alternatively, rotational alignment component 2124 can be formed using two pieces of magnetic material with a nonmagnetic material or an air gap between them. As shown in FIG. 21B, the proximal surface of rotational alignment component 2124 can have one region having a "north" polarity and another region having a "south" polarity. A complementary quad-pole rotational alignment component can have corresponding regions of south and north polarity at the proximal surface.

Figure 22A:
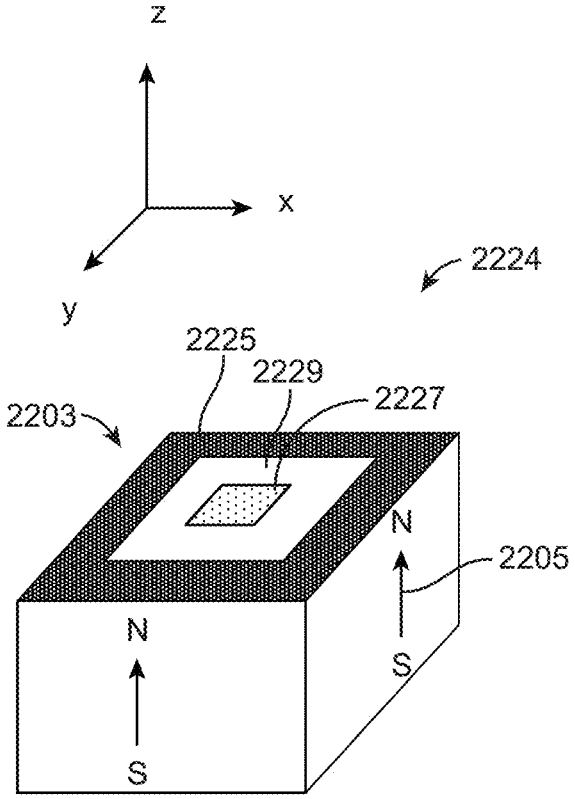
FIGS. 22A and 22B show a perspective view and a top view of a rotational alignment component having an "annulus design" configuration according to some embodiments.
Figure 22B:
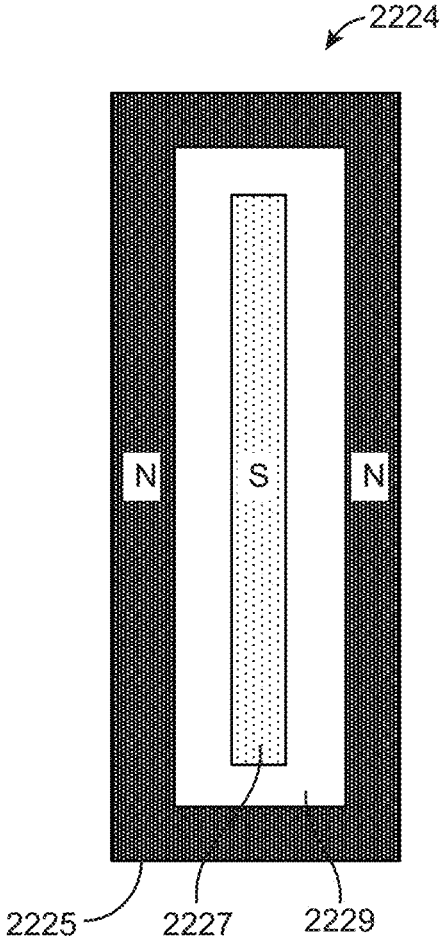

FIGS. 22A and 22B show a perspective view and a top view of a rotational alignment component 2224 having an "annulus design" configuration according to some embodiments. It should be understood that the perspective view is not to any particular scale and that the lateral (xy) dimensions and axial (z) thickness can be varied as desired. As shown in FIG. 22A, rotational alignment component 2224 has an outer magnetized region 2225 with a magnetic orientation along the axial direction such that the north magnetic pole (N) is nearest the proximal (+z) surface 2203 of rotational alignment component 2224 (as shown by arrows 2205) and an inner magnetized region 2227 with a magnetic orientation opposite to the magnetic orientation of the first region such that the south magnetic pole (S) is nearest to proximal surface 2203. Between magnetized regions 2225 and 2227 is a neutral annular region 2229 that is not magnetized. In some embodiments, rotational alignment component 2224 can be formed from a single piece of magnetic material that is exposed to a magnetizer to create regions 2225, 2227, 2229. Alternatively, rotational alignment component 2224 can be formed using two or more pieces of magnetic material with a nonmagnetic material or an air gap between them. As shown in FIG. 22B, the proximal surface of rotational alignment component 2224 can have an annular outer region having a "north" polarity and an inner region having a "south" polarity. The proximal surface of a complementary annulus-design rotational alignment component can have an annular outer region of south polarity and an inner region of north polarity.

Figure 23A:
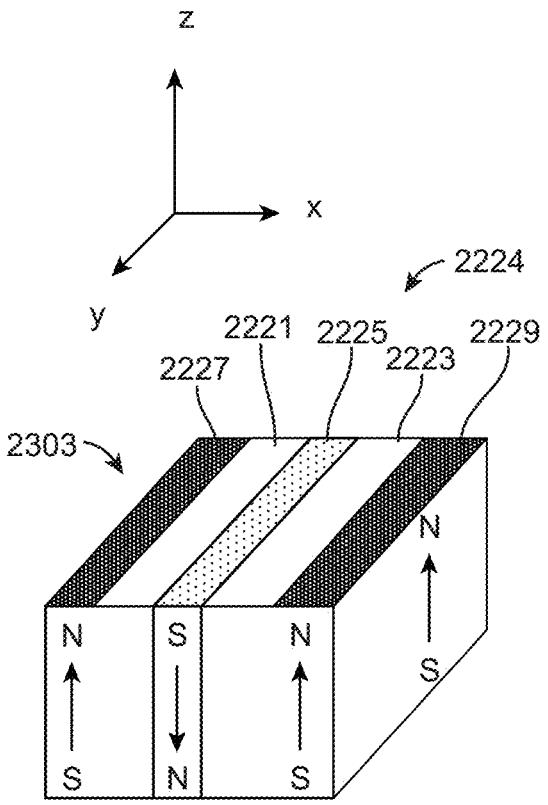
FIGS. 23A and 23B show a perspective view and a top view of a rotational alignment component having a "triple pole" configuration according to some embodiments.
Figure 23B:
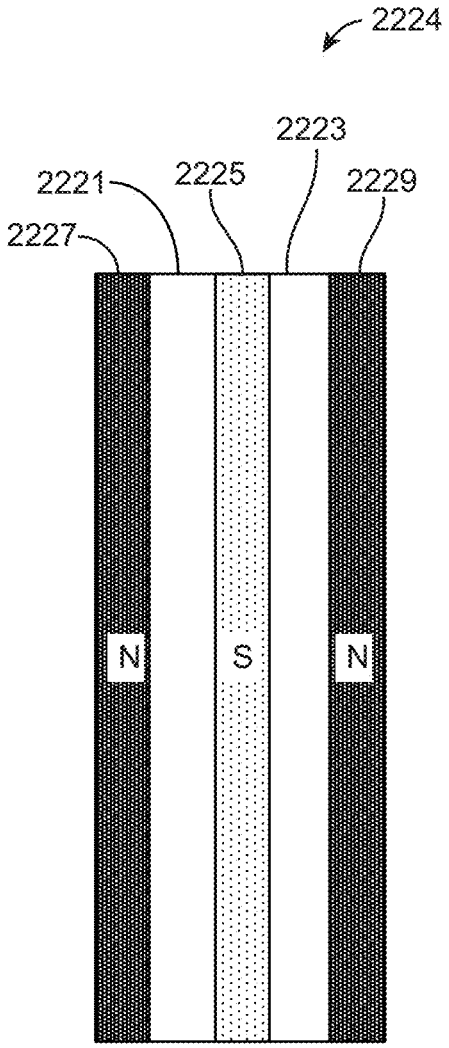

FIGS. 23A and 23B show a perspective view and a top view of a rotational alignment component 2324 having a "triple pole" configuration according to some embodiments. It should be understood that the perspective view is not to any particular scale and that the lateral (xy) dimensions and axial (z) thickness can be varied as desired. As shown in FIG. 23A, rotational alignment component 2324 has a central magnetized region 2325 with a magnetic orientation along the axial direction such that the south magnetic pole (S) is nearest the proximal (+z) surface 2303 of rotational alignment component 2324 (as shown by arrow 2305) and outer magnetized regions 2327, 2329 with a magnetic orientation opposite to the magnetic orientation of central region 2325 such that the north magnetic pole (N) is nearest to proximal surface 2303 (as shown by arrows 2307, 2309). Between central magnetized region 2325 and each of outer magnetized regions 2327, 2329 is a neutral region 2331, 2333 that is not strongly magnetized. In some embodiments, rotational alignment component 2324 can be formed from a single piece of magnetic material that is exposed to a magnetizer to create regions 2325, 2327, 2329. Alternatively, rotational alignment component 2324 can be formed using three (or more) pieces of magnetic material with nonmagnetic materials or air gaps between them. As shown in FIG. 23B, the proximal surface may have a central region having a "south" polarity with an outer region having "north" polarity to either side. The proximal surface of a complementary triple-pole rotational alignment component can have a central region of north polarity with an outer region of south polarity to either side.

It should be understood that the examples in FIGS. 20A-23B are illustrative and that other configurations may be used. The selection of a magnetization pattern for a rotational alignment component can be independent of the magnetization pattern of an annular alignment component with which the rotational alignment component is used.

In some embodiments, the selection of a magnetization pattern for a rotational alignment component can be based on optimizing the torque profile. For example, as noted above, it may be desirable to provide a strong tactile "clocking" sensation to a user when close to the desired rotational alignment. The clocking sensation can be a result of torque about a rotational axis defined by the annular alignment components. The amount of torque depends on various factors, including the distance between the axis and the rotational alignment component (distance y0 in FIG. 18), as well as the strength of the magnetic fields of the rotational alignment components (which may depend on the size of the rotational alignment components) and whether the annular alignment components exert any torque toward a preferred rotational orientation.

Figure 24:
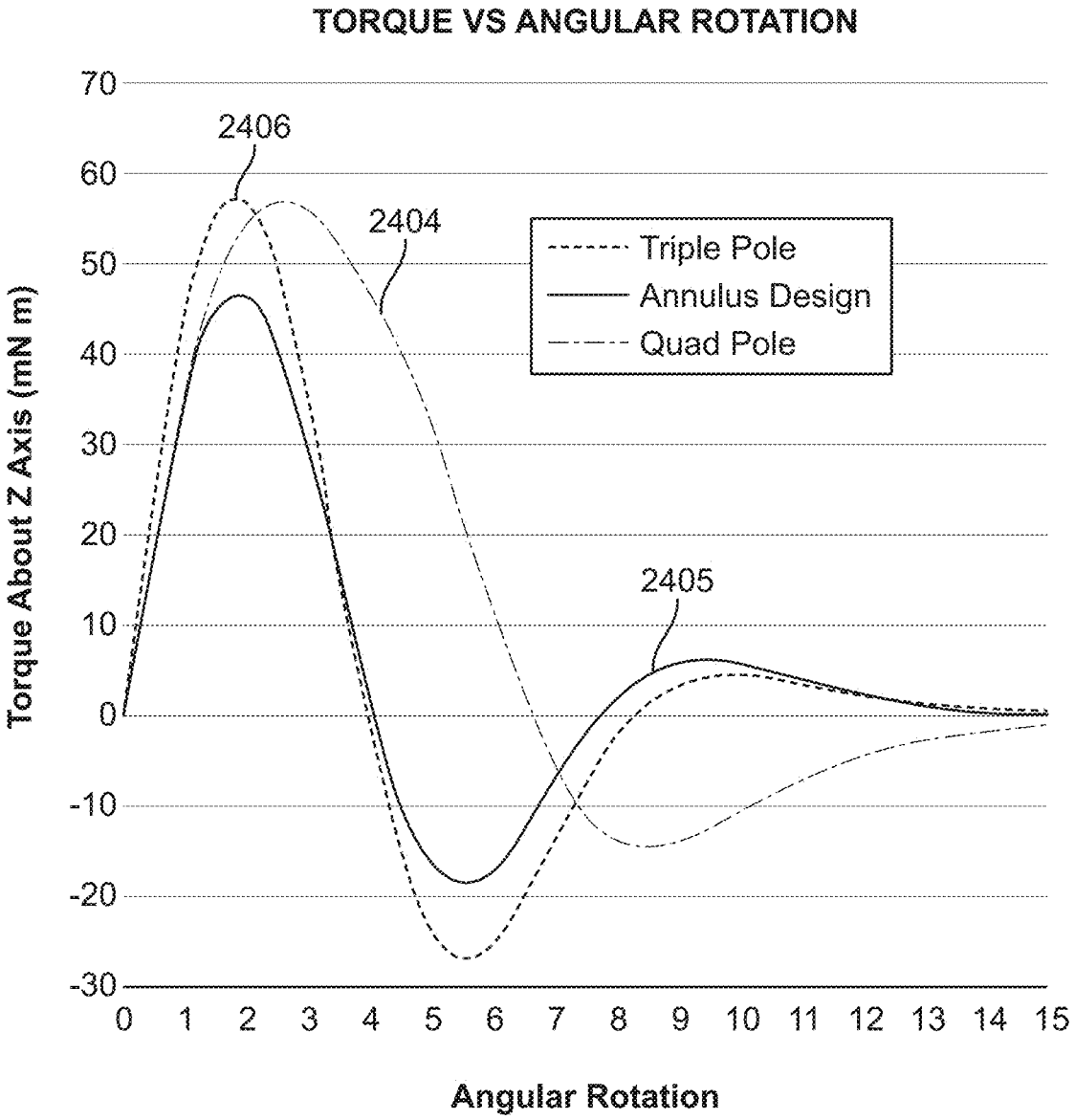
FIG. 24 shows graphs of torque as a function of angular rotation for magnetic alignment systems having rotational alignment components according to various embodiments.

FIG. 24 shows graphs of torque as a function of angular rotation (in degrees) for an alignment system of the kind shown in FIG. 18, for different magnetization configurations of the rotational alignment component according to various embodiments. Angular rotation is defined such that zero degrees corresponds to the target rotational alignment (where the proximal surfaces of rotational angular components 1822 and 1824 are in closest proximity, e.g., as shown in FIG. 19B). Torque is defined such that positive (negative) values indicate force in the direction of decreasing (increasing) rotational angle. For purpose of generating the torque profiles, it is assumed that annular alignment components 1816 and 1818 are rotationally symmetric and do not exert torque about the z axis defined by center points 1801 and 1803. Three different magnetization configurations are considered. Line 2404 corresponds to the quad-pole configuration of FIGS. 21A and 21B. Line 2405 corresponds to the annulus design configuration of FIGS. 22A and 22B. Line 2406 corresponds to the triple-pole configuration of FIGS. 23A and 23B. As shown, the annulus design (line 2405) and triple-pole (line 2406) configurations provide a sharper peak in the torque and therefore a more salient clocking sensation for the user, as compared to the quad-pole configuration (line 2404). In addition, the triple-pole configuration provides a stronger peak torque and therefore a more salient clocking sensation than the annulus-design configuration. It should be understood that the numerical values in FIG. 24 are illustrative, and that torque in a particular embodiment may depend on a variety of other factors in addition to the magnetization configuration, such as the magnet volume, aspect ratio, and distance y0 from the center of the annular alignment component.

Figure 25:
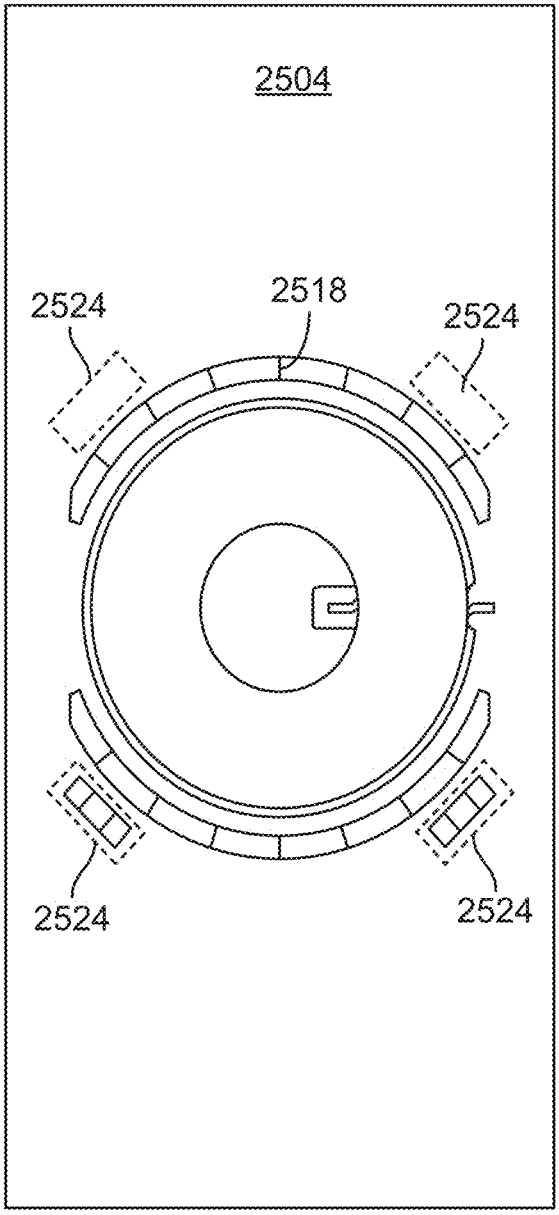
FIG. 25 shows a portable electronic device having an alignment system with multiple rotational alignment components according to some embodiments.

In the examples shown above, a single rotational alignment component is placed outside the annular alignment component at a distance $y_0$ from the center of the annular alignment component. This arrangement allows a single magnetic element to generate enough torque to produce a salient clocking sensation for a user aligning devices. In some embodiments, other arrangements are also possible. For example, FIG. 25 shows a portable electronic device 2504 having an alignment system 2500 with multiple rotational alignment components according to some embodiments. In this example, alignment system 2500 includes an annular alignment component 2518 and a set of rotational alignment components 2524 positioned at various locations around the perimeter of annular alignment component 2518. In this example, there are four rotational alignment components 2524 positioned at angular intervals of approximately 90 degrees. In other embodiments, different numbers and spacing of rotational alignment components can be used. Each rotational alignment component 2524 can have any of the magnetization configurations described above, including z-pole, quad-pole, triple-pole, or annulus-design configurations, or a different configuration. Further, different rotational alignment components 2524 can have different magnetization configurations from each other. It should be noted that rotational alignment components 2524 can be placed close to the perimeter of annular alignment component 2518, and the larger number of magnetic components can provide increased torque at a smaller radius. Complementary rotation alignment components can be disposed around the outer perimeter of any type of annular alignment component (e.g., primary alignment components, secondary alignment components, or annular alignment components as described herein).

It will be appreciated that the foregoing examples of rotational alignment components are illustrative and that variations or modifications are possible. In some embodiments, a rotational alignment component can be provided as an optional adjunct to an annular alignment component, and a device that has both an annular alignment component and a rotational alignment component can align laterally to any other device that has a complementary annular alignment component, regardless of whether the other device has or does not have a rotational alignment component. Thus, for example, portable electronic device 1804 of FIG. 18 can align rotationally to accessory device 1802 (which has both annular alignment component 1816 and rotational alignment component 1822) as well as aligning laterally to another accessory (such as attachable wallet 100 of FIG. 1) that has annular alignment component 1816 but not rotational alignment component 1822. In the latter case, lateral alignment can be achieved, e.g., to support efficient wireless charging, but there may be no preferred rotational alignment, or rotational alignment may be achieved using a non-magnetic feature (e.g., a mechanical retention feature such as a ledge, a clip, a notch, or the like). A rotational alignment component can be used together with any type of annular alignment component (e.g., primary alignment components, secondary alignment components, or annular alignment components as described herein).

In embodiments described above, it is assumed (though not required) that the magnetic alignment components are fixed in position relative to the device enclosure and do not move in the axial or lateral direction. This provides a fixed magnetic flux. In some embodiments, it may be desirable for one or more of the magnetic alignment components to move in the axial direction. For example, in various embodiments of the present invention, it can be desirable to limit the magnetic flux provided by these magnetic structures. Limiting the magnetic flux can help to prevent the demagnetization of various charge and payment cards that a user might be carrying with an electronic device that incorporates one of these magnetic structures. But in some circumstances, it can be desirable to increase this magnetic flux in order to increase a magnetic attraction between an electronic device and an accessory or a second electronic device. Also, it can be desirable for one or more of the magnetic alignment components to move laterally. For example, an electronic device and an attachment structure or wireless device can be offset from each other in a lateral direction. The ability of a magnetic alignment component to move laterally can compensate for this offset and improve coupling between devices, particularly where a coil moves with the magnetic alignment component. Accordingly, embodiments of the present invention can provide structures where some or all of the magnets in these magnetic structures are able to change positions or otherwise move. Examples of magnetic structures having moving magnets are shown in the following figures.

Figure 26C:
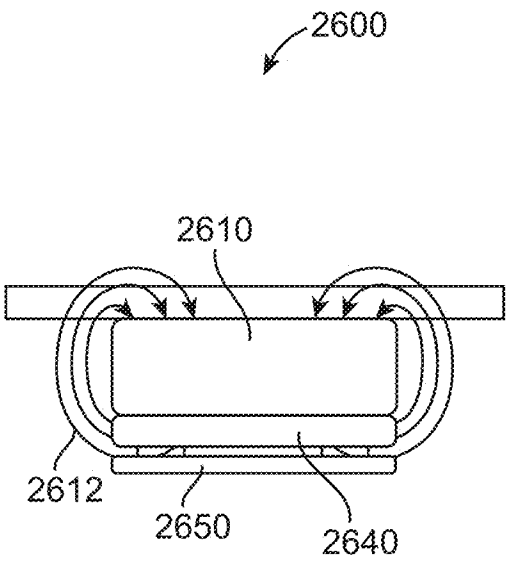
FIGS. 26A through 26C illustrate moving magnets according to an embodiment of the present invention.
Figure 26B:
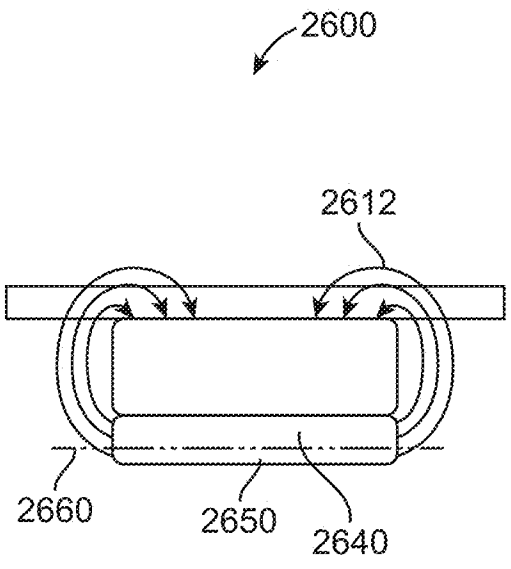
Figure 26A:
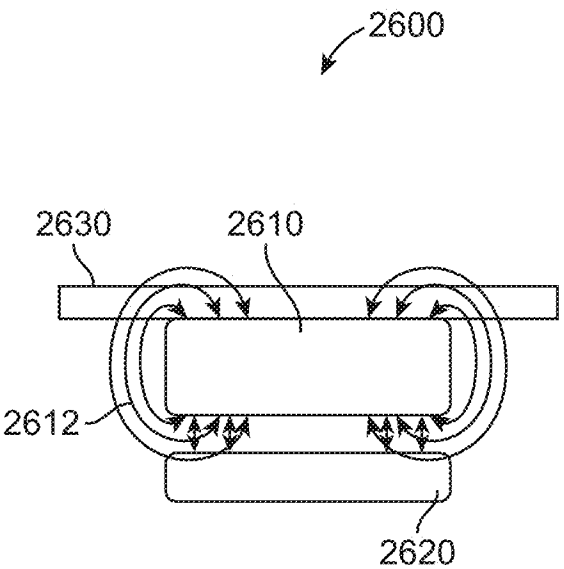

FIGS. 26A through 26C illustrate examples of moving magnets according to an embodiment of the present invention. In these examples, first electronic device 2600 can be an attachable wallet, such as attachable wallet 100 shown in FIG. 1, a wireless charging device, or other device having a magnet 2610 (which can be, e.g., any of the annular or other magnetic alignment components such as the magnet array 190 and alignment magnets 192 described above). In FIG. 26A, moving magnet 2610 can be housed in a first electronic device 2600. First electronic device 2600 can include device enclosure 2630, magnet 2610, and shield 2620. Magnet 2610 can be in a first position (not shown) adjacent to nonmoving shield 2620. In this position, magnet 2610 can be separated from device enclosure 2630. As a result, the magnetic flux 2612 at a surface of device enclosure 2630 can be relatively low, thereby protecting magnetic devices and magnetically stored information, such as information stored on payment cards. As magnet 2610 in first electronic device 2600 is attracted to a second magnet (not shown) in a second electronic device (not shown), magnet 2610 can move, for example it can move away from shield 2620 to be adjacent to device enclosure 2630, as shown. With magnet 2610 at this location, magnetic flux 2612 at surface of device enclosure 2630 can be relatively high. This increase in magnetic flux 2612 can help to attract the second electronic device to first electronic device 2600.

With this configuration, it can take a large amount of magnetic attraction for magnet 2610 to separate from shield 2620. Accordingly, these and other embodiments of the present invention can include a shield that is split into a shield portion and a return plate portion. For example, in FIG. 26B, line 2660 can be used to indicate a split of shield 2620 into a shield 2640 and return plate 2650.

In FIG. 26C, moving magnet 2610 can be housed in first electronic device 2600. First electronic device 2600 can include device enclosure 2630, magnet 2610, shield 2640, and return plate 2650. In the absence of a magnetic attraction, magnet 2610 can be in a first position (not shown) such that shield 2640 can be adjacent to return plate 2650. Again, in this configuration, magnetic flux 2612 at a surface of device enclosure 2630 can be relatively low. As magnet 2610 and first electronic device is attracted to a second magnet (not shown) in a second electronic device (not shown), magnet 2610 can move, for example it can move away from return plate 2650 to be adjacent to device enclosure 2630, as shown. In this configuration, shield 2640 can separate from return plate 2650 and the magnetic flux 2612 at a surface of device enclosure 2630 can be increased. As before, this increase in magnetic flux 2612 can help to attract the second electronic device to the first electronic device 2600.

In these and other embodiments of the present invention, various housings and structures can be used to guide a moving magnet. Also, various surfaces can be used in conjunction with these moving magnets. These surfaces can be rigid. Alternatively, these surfaces can be compliant and at least somewhat flexible. Examples are shown in the following figures.

Figure 27B:
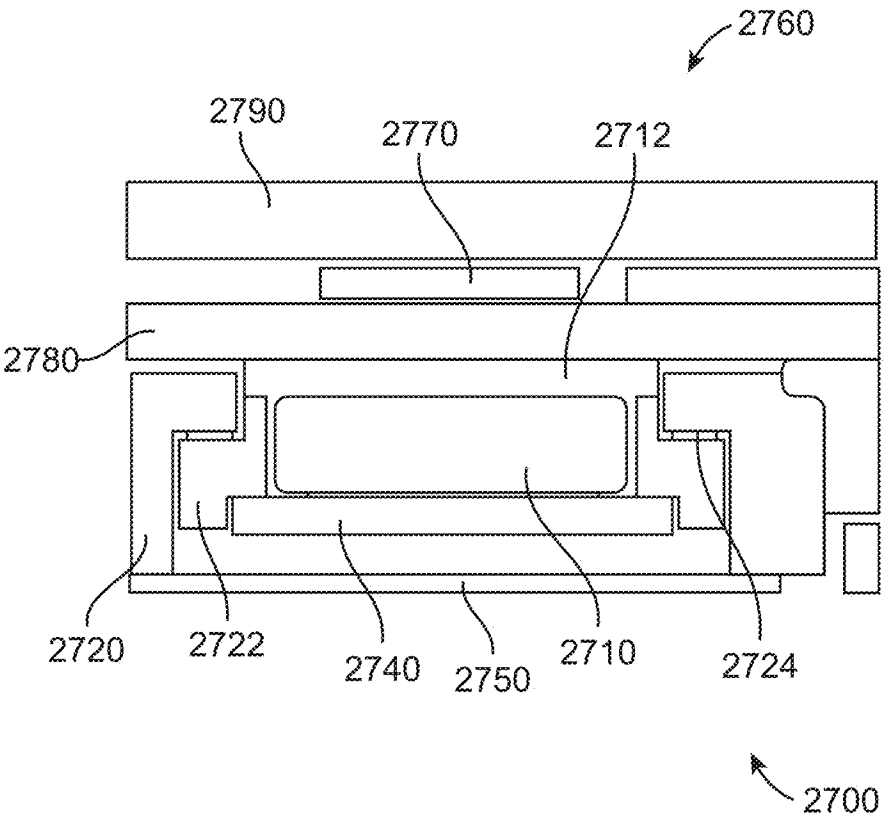
FIGS. 27A and 27B illustrate a moving magnetic structure according to an embodiment of the present invention.
Figure 27A:
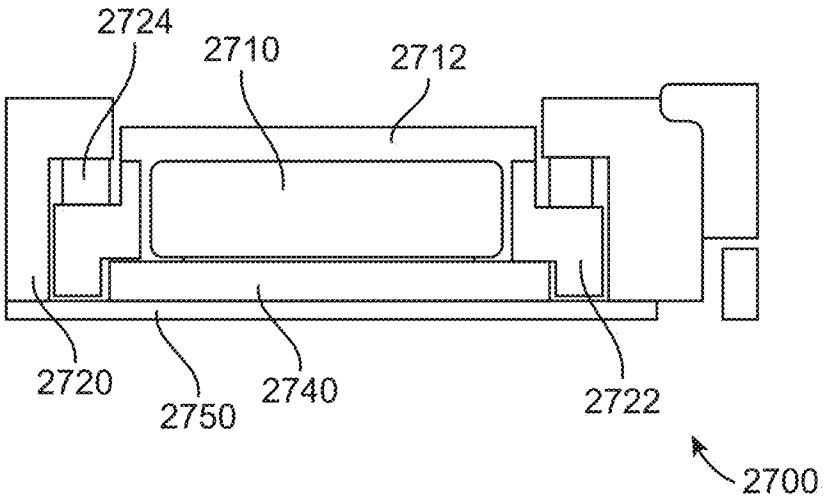

FIGS. 27A and 27B illustrate a moving magnetic structure according to an embodiment of the present invention. In this example, first electronic device 2700 can be an attachable wallet, such as attachable wallet 100, a wireless charging device, or other device having a magnet 2710 (which can be, e.g., any of the annular or other magnetic alignment components such as the magnet array 190 and alignment magnets 192 described above). FIG. 27A illustrates a moving first magnet 2710 in a first electronic device 2700. First electronic device 2700 can include first magnet 2710, protective surface 2712, housings 2720 and 2722, compliant structure 2724, shield 2740, and return plate 2750. In this figure, first magnet 2710 is not attracted to a second magnet (not shown), and therefore shield 2740 is magnetically attracted to or attached to return plate 2750. In this position, compliant structure 2724 can be expanded or relaxed. Compliant structure 2724 can be formed of an elastomer, silicon rubber open cell foam, silicon rubber, polyurethane foam, or other foam or other compressible material.

In FIG. 27B, second electronic device 2760 has been brought into proximity of first electronic device 2700. Second magnet 2770 can attract first magnet 2710, thereby causing shield 2740 and return plate 2750 to separate from each other. Housings 2720 and 2722 can compress compliant structure 2724, thereby allowing protective surface 2712 of first electronic device 2700 to move towards or adjacent to housing 2780 of second electronic device 2760. Second magnet 2770 can be held in place in second electronic device 2760 by housing 2790 or other structure. As second electronic device 2760 is removed from first electronic device 2700, first magnet 2710 and shield 2740 can be magnetically attracted to return plate 2750, as shown in FIG. 27A.

Figure 28B:
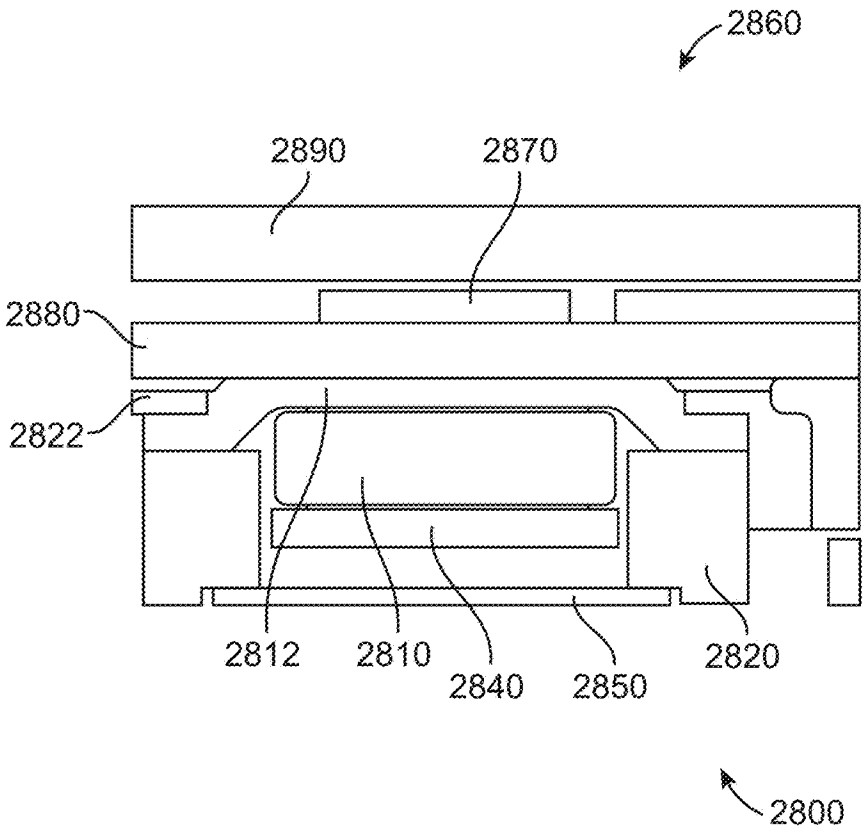
FIGS. 28A and 28B illustrate a moving magnetic structure according to an embodiment of the present invention.
Figure 28A:
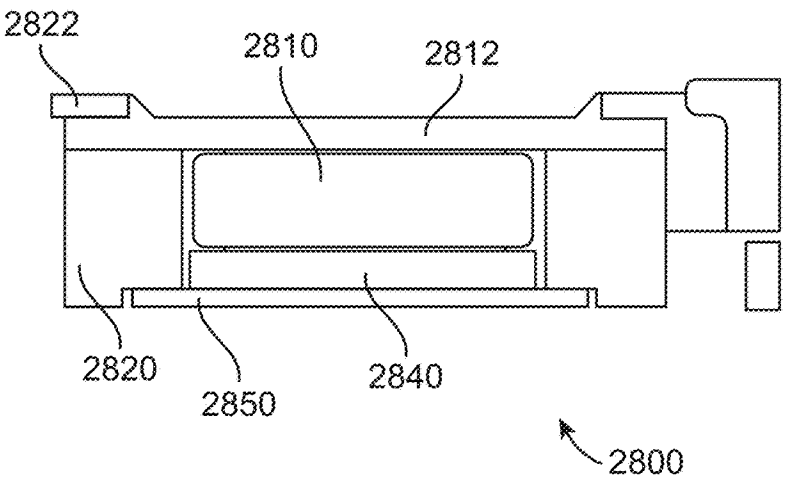

FIGS. 28A and 28B illustrate moving magnetic structures according to an embodiment of the present invention. In this example, first electronic device 2800 can be an attachable wallet, such as attachable wallet 100, a wireless charging device, or other device having a magnet 2810 (which can be, e.g., any of the annular or other magnetic alignment components such as the magnet array 190 and alignment magnets 192 described above). FIG. 28A illustrates a moving first magnet 2810 in a first electronic device 2800. First electronic device 2800 can include first magnet 2810, pliable surface 2812, housing portions 2820 and 2822, shield 2840, and return plate 2850. In this figure, first magnet 2810 is not attracted to a second magnet, and therefore shield 2840 is magnetically attached or attracted to return plate 2850. In this position, pliable surface 2812 can be relaxed. Pliable surface 2812 can be formed of an elastomer, silicon rubber open cell foam, silicon rubber, polyurethane foam, or other foam or other compressible material.

In FIG. 28B, second electronic device 2860 has been brought into the proximity of first electronic device 2800. Second magnet 2870 can attract first magnet 2810, thereby causing shield 2840 and return plate 2850 to separate from each other. First magnet 2810 can stretch pliable surface 2812 towards second electronic device 2860, thereby allowing first magnet 2810 of first electronic device 2800 to move towards housing 2880 of second electronic device 2860. Second magnet 2870 can be held in place in second electronic device 2860 by housing 2890 or other structure. As second electronic device 2860 is removed from first electronic device 2800, first magnet 2810 and shield 2840 can be magnetically attracted to return plate 2850 as shown in FIG. 28A.

Figure 29:
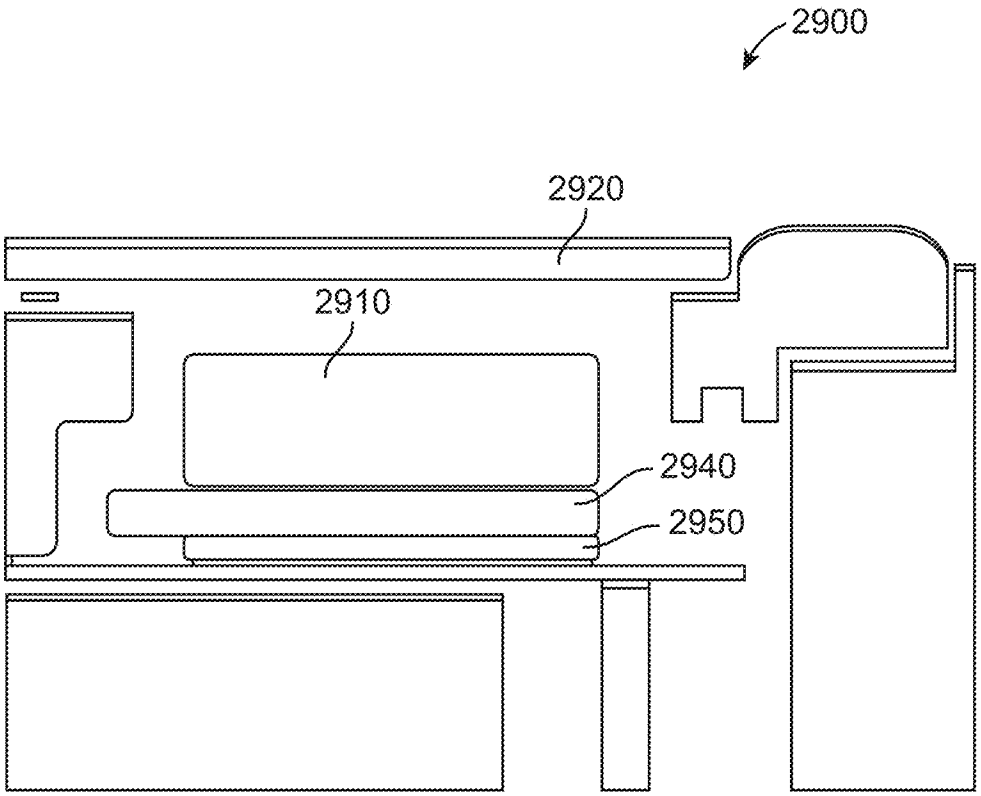
FIG. 29 through FIG. 31 illustrate a moving magnetic structure according to an embodiment of the present invention.
Figure 30:
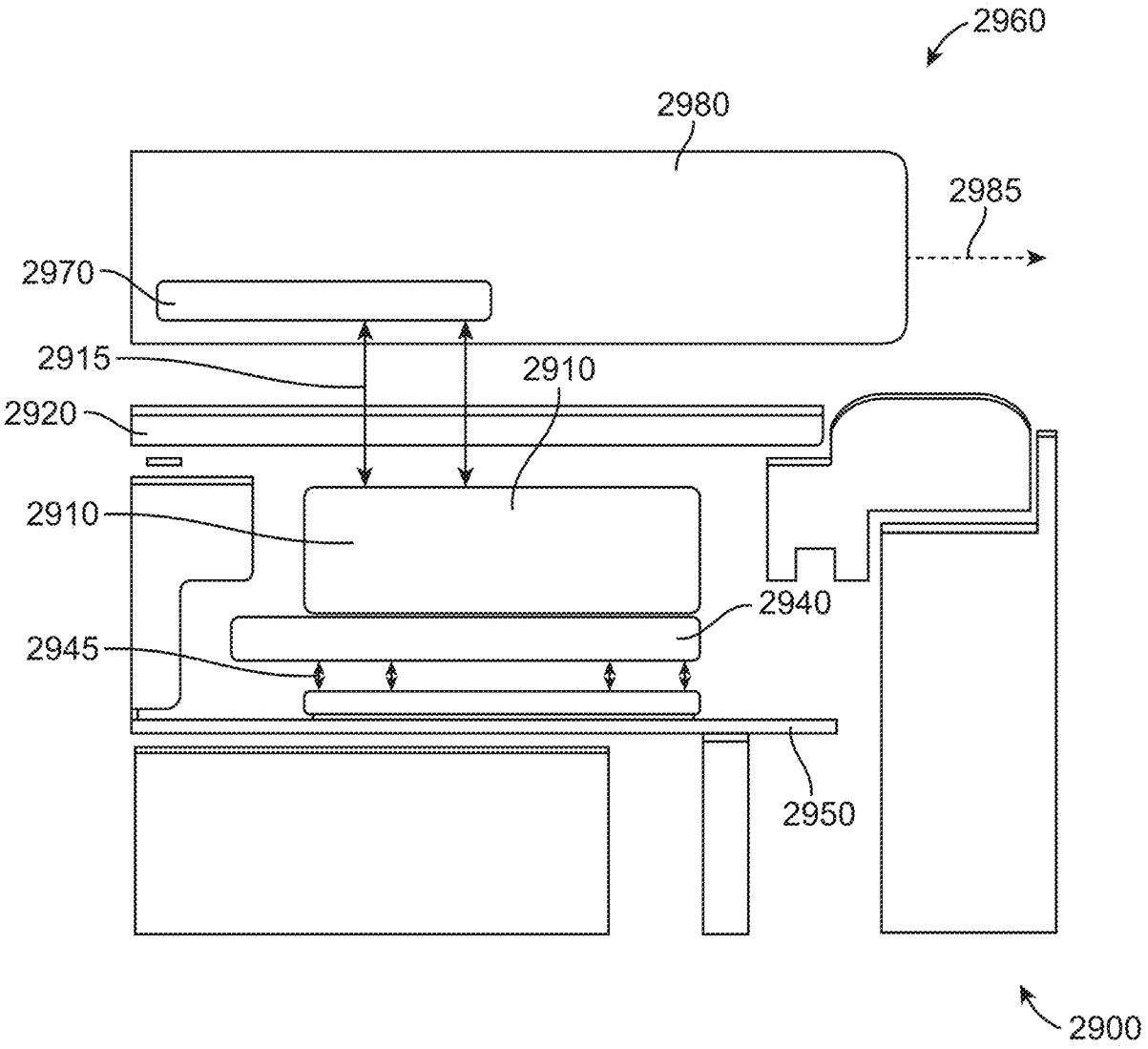
Figure 31:
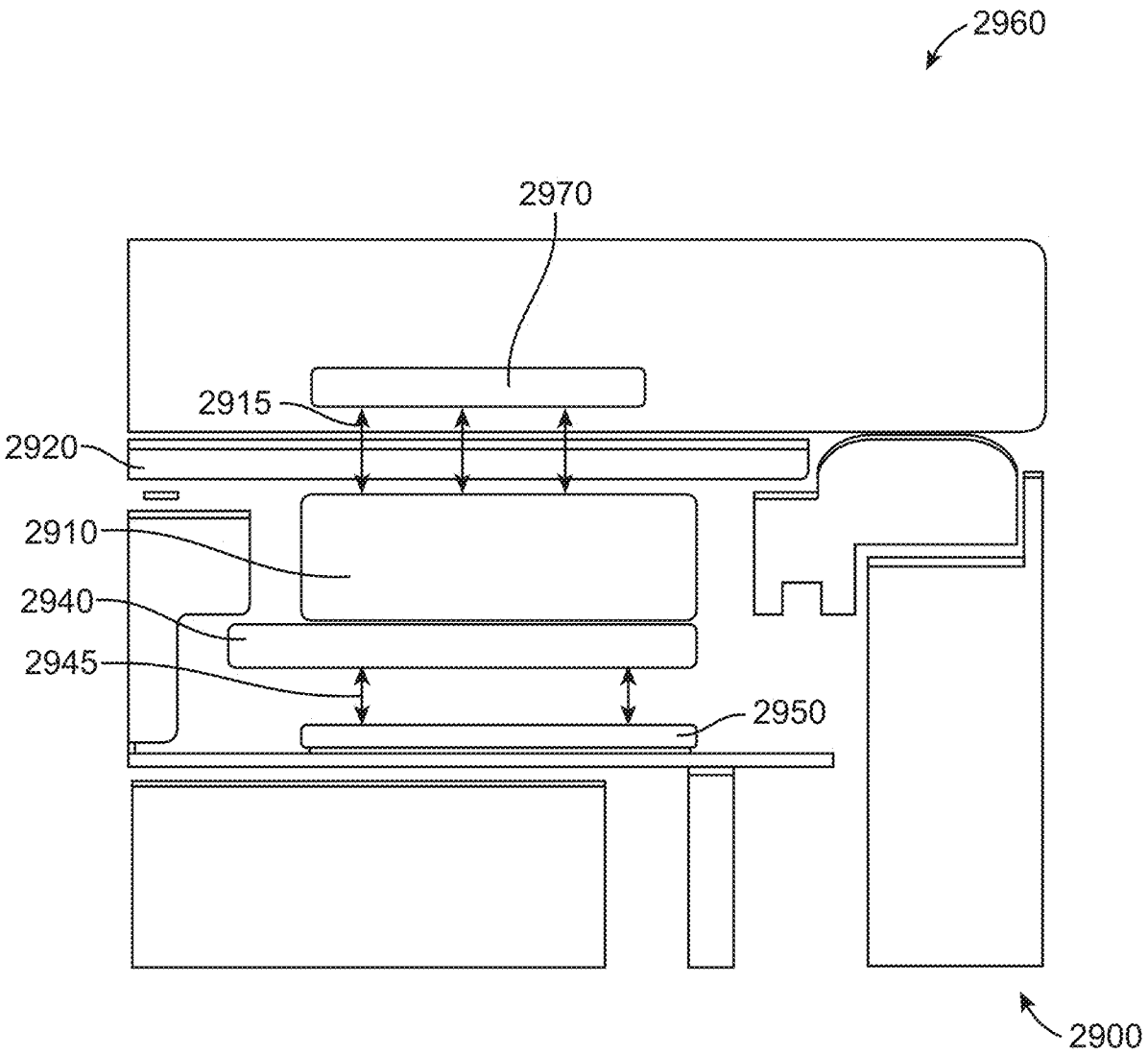

FIG. 29 to FIG. 31 illustrate a moving magnetic structure according to an embodiment of the present invention. In this example, first electronic device 2900 can be an attachable wallet, such as attachable wallet 100, a wireless charging device, or other device having a magnet 2910 (which can be, e.g., any of the annular or other magnetic alignment components such as the magnet array 190 and alignment magnets 192 described above). In FIG. 29, first magnet 2910 and shield 2940 can be magnetically attracted or attached to return plate 2950 in first electronic device 2900. First electronic device 2900 can be at least partially housed in device enclosure 2920. In FIG. 30, housing 2980 of second electronic device 2960 can move laterally across a surface of device enclosure 2920 of first electronic device 2900 in a direction 2985. Second magnet 2970 in second electronic device 2960 can begin to attract first magnet 2910 in first electronic device 2900. This magnetic attraction 2915 can cause first magnet 2910 and shield 2940 to pull away from return plate 2950 by overcoming the magnetic attraction 2945 between shield 2940 and return plate 2950. In FIG. 31, second magnet 2970 in second electronic device 2960 has become aligned with first magnet 2910 in first electronic device 2900. First magnet 2910 and shield 2940 have pulled away from return plate 2950 thereby reducing the magnetic attraction 2945. First magnet 2910 has moved nearby or adjacent to device enclosure 2920, thereby increasing the magnetic attraction 2915 to second magnet 2970 in second electronic device 2960.

As shown in FIG. 29 through FIG. 31, the magnetic attraction between first magnet 2910 in first electronic device 2900 and the second magnet 2970 in the second electronic device 2960 can increase when first magnet 2910 and shield 2940 pull away from return plate 2950. This is shown graphically in the following figures.

Figure 32:
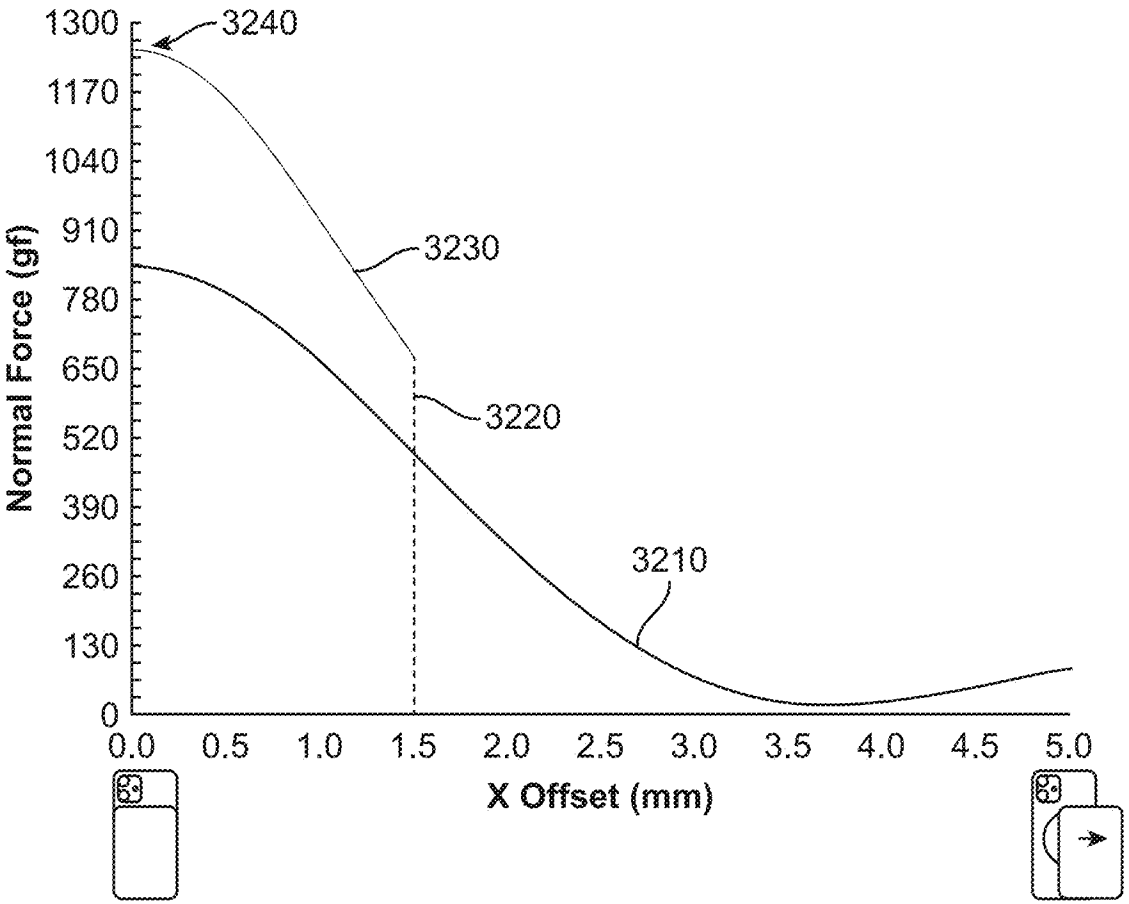
FIG. 32 illustrates a normal force between a first magnet in a first electronic device and a second magnet in a second electronic device.

FIG. 32 illustrates a normal force between a first magnet in first electronic device and a second magnet in a second electronic device as a function of a lateral offset between them. As shown in FIGS. 29-36, with a large offset between first magnet 2910 and second magnet 3170, first magnet 2910 and shield 2940 can remain attached to return plate 2950 in first electronic device 2900 and the magnetic attraction 2915 can be minimal. The shear force necessary to overcome this magnetic attraction is illustrated here as curve 3210. As shown in FIG. 30, as the offset or lateral distance between first magnet 2910 and second magnet 2970 decreases, first magnet 2910 and shield 2940 can pull away or separate from return plate 2950, thereby increasing the magnetic attraction 2915 between first magnet 2910 and second magnet 2970. This is illustrated here as discontinuity 3220. As shown in FIG. 31, as first magnet 2910 and second magnet 2970 come into alignment, the magnetic attraction 2915 increases along curve 3230 to a maximum 3240. The difference between curve 3210 and curve 3230 can show the increase in magnetic attraction between a phone or other electronic device, such as second electronic device 2960 and an attachable wallet or wireless charging device, such as first electronic device 2900, that results from first magnet 2910 being able to move axially. It should also be noted that in this example first magnet 2910 does not move in a lateral direction, though in other examples it is capable of such movement. Where first magnet 2910 is capable of moving in a lateral direction, curve 3230 can have a flattened peak from an offset of zero to an offset that can be overcome by a range of possible lateral movement of first magnet 2910.

Figure 33:
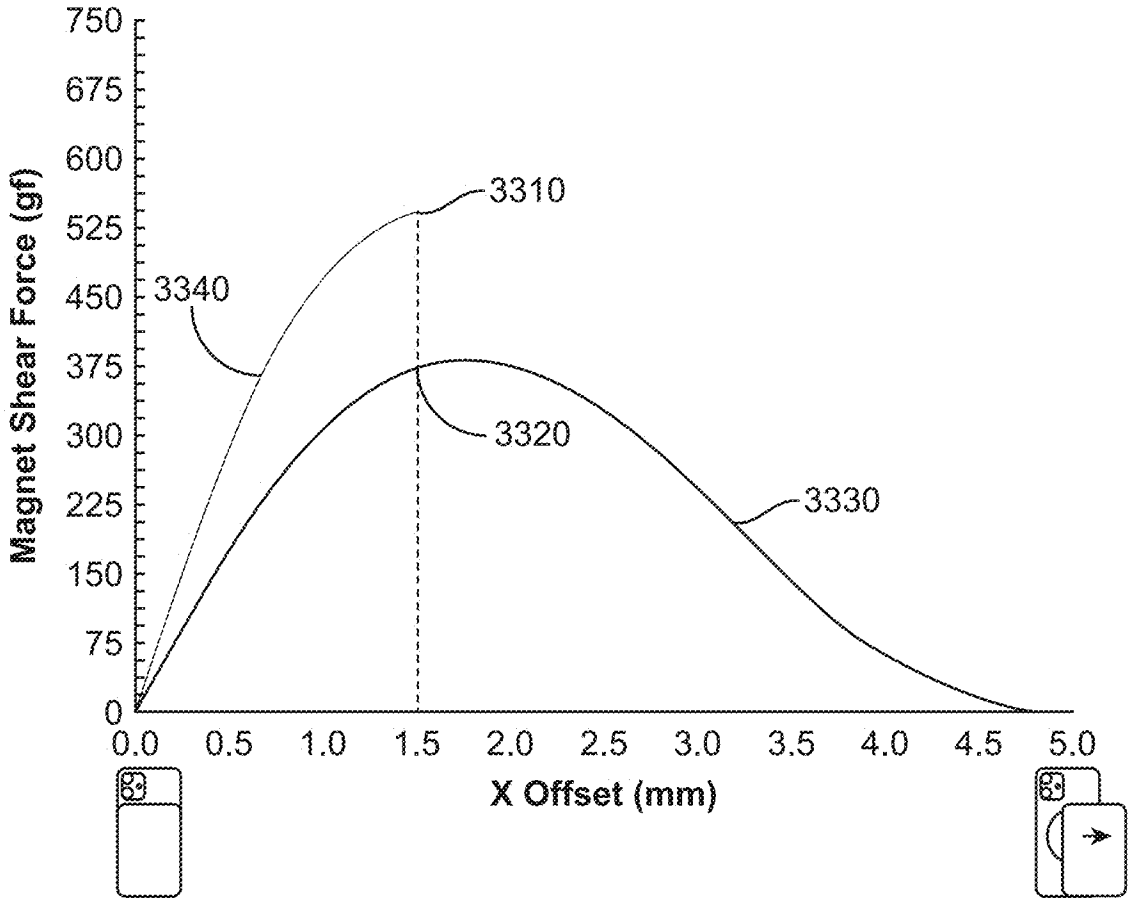
FIG. 33 illustrates a shear force between a first magnet in a first electronic device and a second magnet in a second electronic device.

FIG. 33 illustrates a shear force between a first magnet in a first electronic device and a second magnet in a second electronic device as a function of a lateral offset between them. With no offset between first magnet 2910 and second magnet 2970, there it is no shear force to move second magnet 2970 relative to first magnet 2910, as shown in FIG. 29. As the offset is increased, the shear force, that is the force attempting to realign the magnets, can increase along curve 3340. At discontinuity 3310, first magnet 2910 and shield 2940 can return to return plate 2950 (as shown in FIGS. 29-36), thereby decreasing the magnetic shear force to point 3320. The magnetic shear force can continue to drop off along curve 3330 as the offset increases. The difference between curve 3330 and curve 3340 can show the increase in magnetic attraction between a phone or other electronic device, such as second electronic device 2960 and an attachable wallet or wireless charging device, such as first electronic device 2900, that results from first magnet 2910 being able to move axially. It should also be noted that in this example first magnet 2910 does not move in a lateral direction, though in other examples it is capable of such movement. Where first magnet 2910 is capable of moving in a lateral direction, curve 3330 can remain at zero until the lateral movement of the second magnet 2970 overcomes the range of possible lateral movement of first magnet 2910.

In these and other embodiments of the present invention, it can be desirable to further increase this shear force. Accordingly, embodiments of the present invention can provide various high friction or high stiction surfaces, suction cups, pins, or other structures to increase this shear force.

For various applications, it may be desirable to enable a device having a magnetic alignment component to identify other devices that are brought into alignment. In some embodiments where the devices support a wireless charging standard that defines a communication protocol between devices, the devices can use that protocol to communicate. For example, the Qi standard for wireless power transfer defines a communication protocol that enables a power-receiving device (i.e., a device that has an inductive coil to receive power transferred wirelessly) to communicate information to a power-transmitting device (i.e., a device that has an inductive coil to generate time-varying magnetic fields to transfer power wirelessly to another device) via a modulation scheme in the inductive coils. The Qi communication protocol or similar protocols can be used to communicate information such as device identification or charging status or requests to increase or decrease power transfer from the power-receiving device to the power-transmitting device.

In some embodiments, a separate communication subsystem, such as a Near-Field Communication subsystem can be provided to enable additional communication between devices. For example, each device that has an annular magnetic alignment component can also have an NFC coil that can be disposed inside and concentric with the annular magnetic alignment component. Where the device also has an inductive charging coil (which can be a transmitter coil or a receiver coil), the NFC coil can be disposed in a gap between the inductive charging coil and an annular magnetic alignment component. In some embodiments, the NFC coils can be used to allow a portable electronic device to identify other devices, such as a wireless charging device and/or an auxiliary device, when the respective magnetic alignment components of the devices are brought into alignment. For example, the NFC coil of a power-receiving device can be coupled to an NFC reader circuit while the NFC coil of a power-transmitting device or an accessory device is coupled to an NFC tag circuit. When devices are brought into proximity, the NFC reader circuit of the power-receiving device can be activated to read the NFC tag of the power-transmitting device and/or the accessory device. In this manner, the power-receiving device can obtain information (e.g., device identification) from the power-transmitting device and/or the accessory device.

In some embodiments, an NFC reader in a portable electronic device can be triggered by detecting a change in the DC (or static) magnetic field generated by the magnetic alignment component of the portable electronic device that corresponds to a change expected when another device with a complementary magnetic alignment component is brought into alignment. When the expected change is detected, the NFC reader can be activated to read an NFC tag in the other device, assuming the other device is present.

In some embodiments, an NFC tag may be located in a device that includes a wireless charger and an annular alignment structure. The NFC tag can be positioned and configured such that when the wireless charger device is aligned with a portable device having a complementary annular alignment structure and an NFC reader, the NFC tag is readable by the NFC reader of the portable electronic device.

Figure 34:
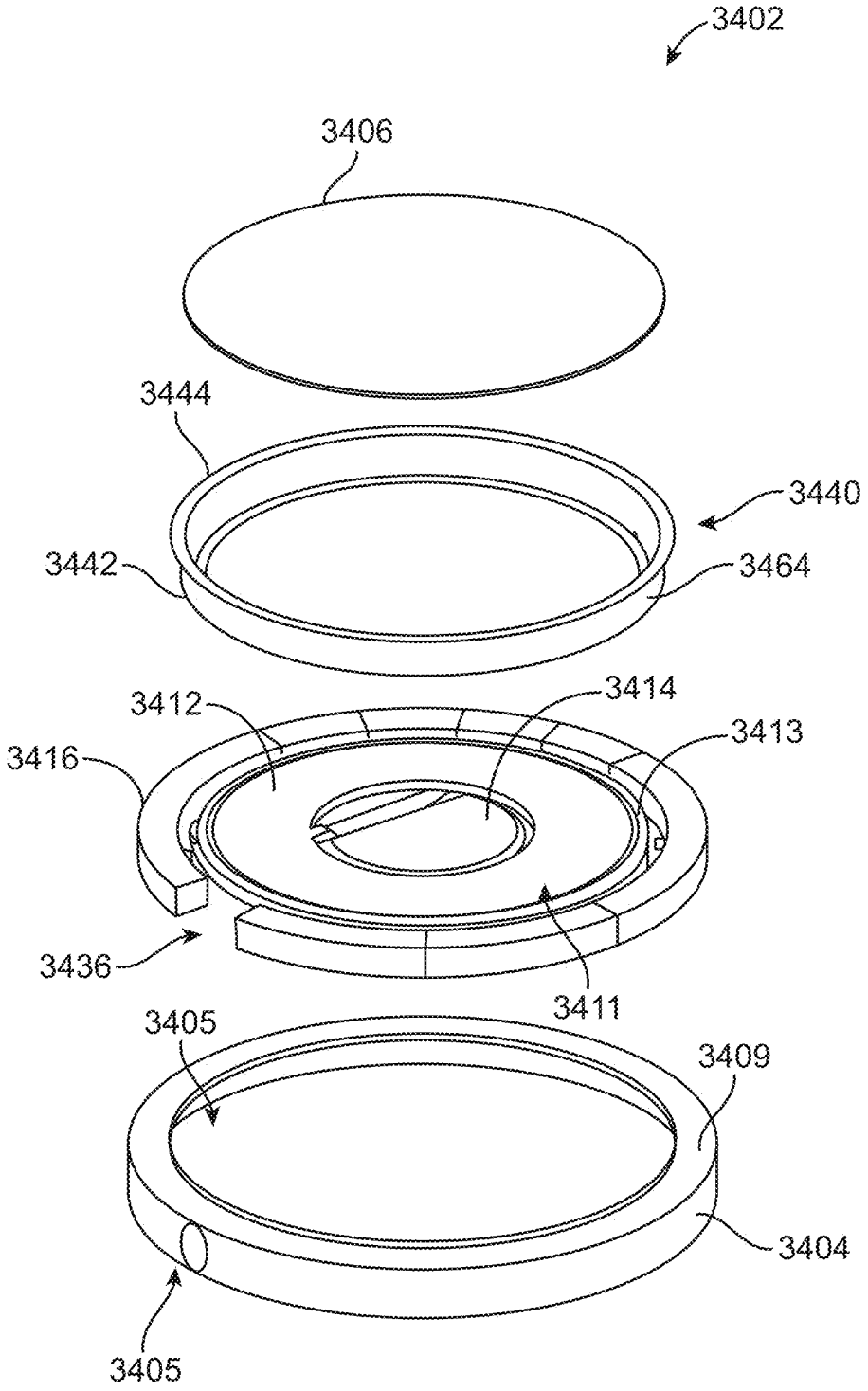
FIG. 34 shows an exploded view of a wireless charger device incorporating an NFC tag circuit according to some embodiments.
Figure 35:
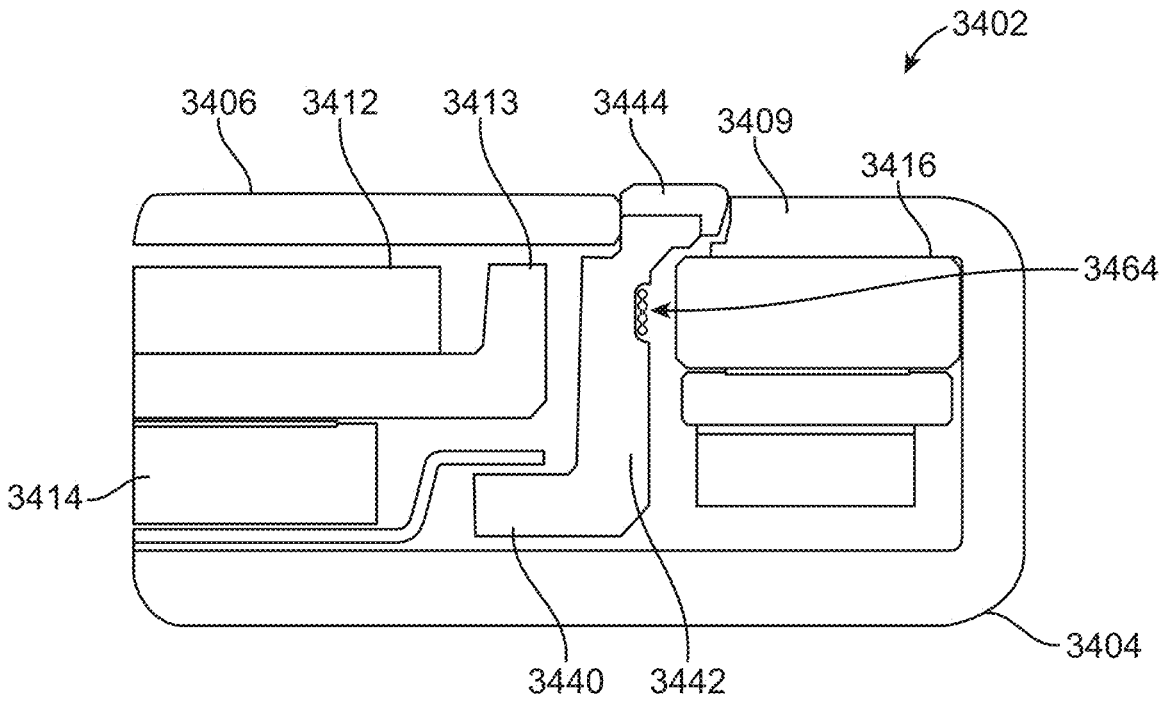
FIG. 35 shows a partial cross-section view of a wireless charger device according to some embodiments.

FIG. 34 shows an exploded view of a wireless charger device 3402 incorporating an NFC tag according to some embodiments, and FIG. 35 shows a partial cross-section view of wireless charger device 3402 according to some embodiments. As shown in FIG. 34, wireless charger device 3402 can include an enclosure 3404, which can be made of plastic or metal (e.g., aluminum), and a charging surface 3406, which can be made of silicone, plastic, glass, or other material that is permeable to AC and DC magnetic fields. Charging surface 3406 can be shaped to fit within a circular opening 3403 at the top of enclosure 3404.

A wireless transmitter coil assembly 3411 can be disposed within enclosure 3404. Wireless transmitter coil assembly 3411 can include a wireless transmitter coil 3412 for inductive power transfer to another device as well as AC magnetic and/or electric shield(s) 3413 disposed around some or all surfaces of wireless transmitter coil 3412. Control circuitry 3414 (which can include, e.g., a logic board and/or power circuitry) to control wireless transmitter coil 3412 can be disposed in the center of coil 3412 and/or underneath coil 3412. In some embodiments, control circuitry 3414 can operate wireless transmitter coil 3412 in accordance with a wireless charging protocol such as the Qi protocol or other protocols.

A primary annular magnetic alignment component 3416 can surround wireless transmitter coil assembly 3411. Primary annular magnetic alignment component 3416 can include a number of arcuate magnet sections arranged in an annular configuration as shown. Each arcuate magnet section can include an inner arcuate region having a magnetic polarity oriented in a first axial direction, an outer arcuate region having a magnetic polarity oriented in a second axial direction opposite the first axial direction, and a central arcuate region that is not magnetically polarized. In some embodiments, the diameter and thickness of primary annular magnetic alignment component 3416 is chosen such that arcuate magnet sections of primary annular magnetic alignment component 3416 fit under a lip 3409 at the top surface of enclosure 3404, as best seen in FIG. 35. For instance, each arcuate magnet section can be inserted into position under lip 3409, either before or after magnetizing the inner and outer regions. In some embodiments, primary annular magnetic alignment component 3416 can have a gap 3436 between two adjacent arcuate magnet sections. Gap 3436 can be aligned with an opening 3407 in a side surface of enclosure 3404 to allow external wires to be connected to wireless transmitter coil 3412 and/or control circuitry 3414.

A support ring subassembly 3440 can include an annular frame 3442 that extends in the axial direction and a friction pad 3444 at the top edge of frame 3442. Friction pad 3444 can be made of a material such as silicone or thermoplastic elastomers (TPE) such as thermoplastic urethane (TPU) and can provide support and protection for charging surface 3406. Frame 3442 can be made of a material such as polycarbonate (PC), glass-fiber reinforced polycarbonate (GFPC), or glass-fiber reinforced polyamide (GFPA). Frame 3442 can have an NFC coil 3464 disposed thereon. For example, NFC coil 3464 can be a four-turn or five-turn solenoidal coil made of copper wire or other conductive wire that is wound onto frame 3442. In some embodiments, NFC coil 3464 can be electrically connected to NFC tag circuitry (not shown) that can be disposed on frame 3442. The relevant design principles of NFC circuits are well understood in the art and a detailed description is omitted. Frame 3442 can be inserted into a gap region 3417 between primary annular magnetic alignment component 3416 and wireless transmitter coil assembly 3411. In some embodiments, gap region 3417 is shielded by AC shield 3413 from AC electromagnetic fields generated in wireless transmitter coil 3412 and is also shielded from DC magnetic fields of primary annular magnetic alignment component 3416 by the closed-loop configuration of the arcuate magnet sections.

FIG. 36 illustrates a portion of NFC inlay according to an embodiment of the present invention. NFC inlay 620 can include NFC coil 3710. NFC coil 3710, capacitor 3820, capacitor 3830, and tag or electronic circuit 3810 can form an NFC circuit or NFC circuitry. NFC coil 3710 can be formed of a wire wrapped in concentric loops. These loops can be positioned in a plane parallel to flexible circuit board 3720. Alternatively, these loops can be stacked to form a cylindrical surface that is orthogonal to a plane parallel to flexible circuit board 3720. These loops can be formed by wrapping a wire around a mandrel (not shown) or by using other techniques. The wire can be insulated with insulation (not shown) to prevent the loops from shorting to each other. The wire can further have a layer of adhesive (not shown) on the outside of the insulation. This adhesive can be pressure-sensitive adhesive, heat-activated adhesive, or other type of adhesive. This adhesive can help NFC coil 3710 to maintain shape during manufacturing.

The number of loops in NFC coil 3710 can be 5 loops, 7 loops, 9 loops, 11 loops, or other number of loops. The wire forming NFC coil 3710 can have various diameters, such as 50 microns, 100 microns, 150 microns, 200 microns, 300 microns, or other diameter. The wrapped wire forming NFC coil 3710 can include two ends, where a first end 3712 can be positioned on an inside of NFC coil 3710 and a second end 3714 can be positioned on the outside of NFC coil 3710. First end 3712 of NFC coil 3710 can be attached to flexible circuit board 3720 at encapsulation 3850. Second end 3714 of NFC coil 3710 can be attached to flexible circuit board 3720 at encapsulation 3840. Capacitor 3820, capacitor 3830, and tag or electronic circuit 3810 can also be attached to flexible circuit board 3720. Traces 3722 can attach capacitor 3820, capacitor 3830, and electronic circuit 3810 to NFC coil 3710. In this example, two capacitors and one electronic circuit are shown, though in other embodiments of the present invention, other number of capacitors and electronic circuits can be included on flexible circuit board 3720 or elsewhere on or associated with flexible circuit board 3720.

FIG. 37A and FIG. 37B illustrate portions of an NFC inlay according to an embodiment of the present invention. In FIG. 37A, first end 3712 of NFC coil 3710 can be attached to flexible circuit board 3720 at location 3723. Second end 3714 of NFC coil 3710 can be attached to flexible circuit board 3720 at location 3724. Capacitor 3820, capacitor 3830, and electronic circuit 3810 can be attached to traces 3722 on flexible circuit board 3720.

In FIG. 37B, shim 3730 can be attached to or placed over flexible circuit board 3720 and NFC coil 3710. Shim 3730 can include opening 3734 for capacitor 3820, opening 3736 for capacitor 3830, and opening 3738 for tag or electronic circuit 3810. Location 3723 and location 3724 (shown in FIG. 37A) can be encapsulated by encapsulation 3840 and encapsulation 3850. Shim 3730 can include notch 3737 for encapsulation 3840 and notch 3739 for encapsulation 3850. Again, shim 3730 can provide a planarized surface to help prevent visible or tactile impressions and a surface of back panel 120 (shown in FIG. 1)

In these and other embodiments of the present invention, ferrite 610 (shown in FIG. 3B) can be formed in various ways. Similarly, shield layer 460 (shown in FIG. 4) can be formed in various ways. Ferrite 610 and shield layer 460 can be formed of the same or substantially similar layers. Alternatively, ferrite 610 and shield layer 460 can be formed of different layers. Examples are shown in the following figures.

FIG. 38 illustrates a cross-section of a ferrite according to an embodiment of the present invention. Ferrite 610 can be formed as a piece of ferritic material. Alternately, ferrite 610 can be formed of a number of layers. In one example, ferrite 610 can be formed of layer 4010, layer 4020, layer 4030, and layer 4040, where each layer can be the same or substantially similar. For example, layer 4010 can include a top layer of polyester or polyethylene terephthalate (PET) over a layer of ferritic material. An adhesive layer can be attached to a bottom side of the ferritic material such that layer 4010 can adhere to layer 4020. Layers 4020, layer 4030, and layer 4040 can be the same or substantially similar to layer 4010. In these and other embodiments of the present invention, layer 4050 can be an adhesive layer. When layer 4050 is an adhesive layer, a bottom adhesive layer can be omitted from layer 4040, though the adhesive layer can be retained to simplify manufacturing.

In these and other embodiments of the present invention, it can be desirable for layer 4010, layer 4020, layer 4030, layer 4040 to be cut to shape without breaking the ferritic material into shards. Accordingly, the ferritic material in layer 4010, layer 4020, layer 4030, and layer 4040 can be pre-cracked, for example using rollers or other technique. The adjacent polyester and adhesive layers can help to maintain the form of the ferritic material before and after cracking.

In these and other embodiments of the present invention, the ferritic material can be formed of iron, silica and iron, aluminum iron, nanocrystalline structures or other ferritic material, steel, or other material.

In these and other embodiments of the present invention, either or both ferrite 610 or shield layer 460 can be formed in other ways. In these and other embodiments of the present invention, a ferrite layer and a metallic layer can be combined to form shield layer 460. In this way, a ferrite layer having a high permeability can provide magnetic shielding, while the metallic layer can provide magnetic and electric field shielding. An example is shown in the following figure.

Figure 39:
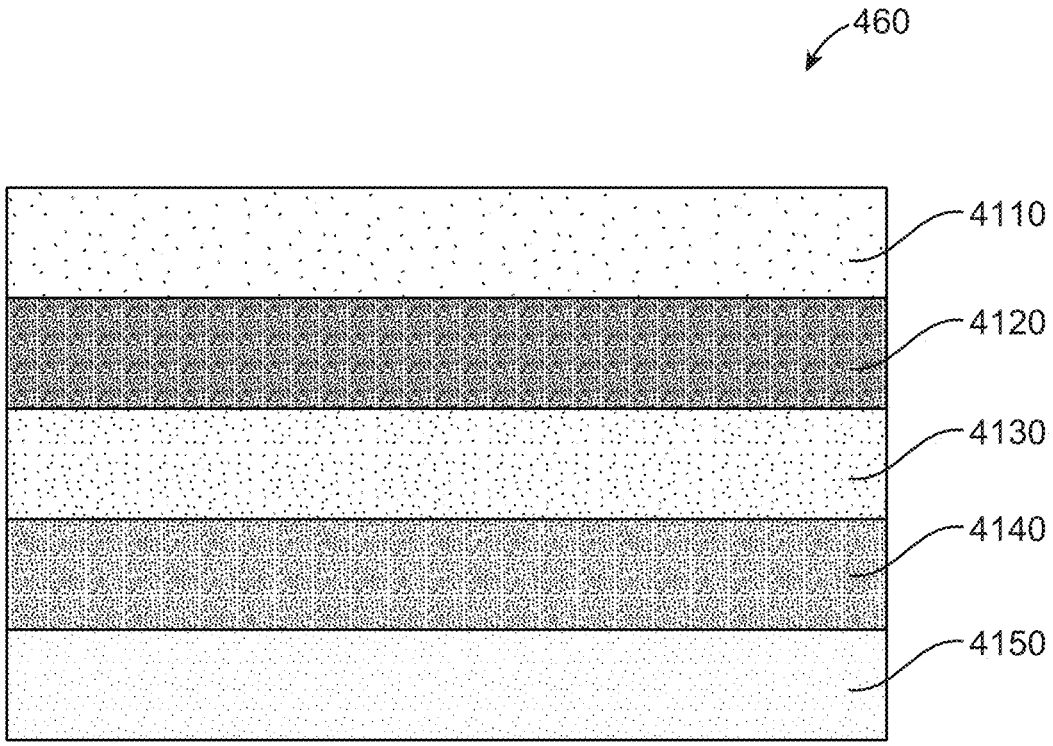
FIG. 39 illustrates a cross-section of a shield layer according to an embodiment of the present invention.

FIG. 39 illustrates a cross-section of a shield layer according to an embodiment of the present invention. In this example, shield layer 460 can include layer 4110. Layer 4110 can be formed of polyester or polyethylene terephthalate. This layer can protect a soft magnetic layer or other ferritic layer 4120. An adhesive layer 4130 and can attach a soft magnetic layer or other ferrite layer 4120 to a metal layer 4140, which can be formed of copper, steel, or other material. Adhesive layer 4150 can attach shield layer 460 to taffeta layer 480 (shown in FIG. 4), thereby replacing adhesive layer 470 (shown in FIG. 4.) In this example, soft magnetic layer or other ferrite layer 4120 can be arranged to face electronic device 200 (shown in FIG. 1), while metal layer 4140 can be arranged to face an outside surface of front panel 110 (shown in FIG. 1.) Alternatively, ferrite layer 4120 can be arranged to face an outside surface of front panel 110, while metal layer 4140 can be arranged to face electronic device 200. The layers shown as examples for ferrite 610 in FIG. 38 and shield layer 460 in FIG. 39 can be implemented in various combinations in each of these structures, and these and other layers can be included or omitted for each of these structures.

In these and other embodiments of the present invention, adhesive layers, such as adhesive layer 172, adhesive layer 174, adhesive layer 176, (each shown in FIG. 3B) and the other adhesive layers can be a pressure sensitive adhesive, a double-sided pressure sensitive adhesive, a heat activated adhesive, a double-sided heat activated material, or other type of single or double-sided adhesive layers.

Figure 40:
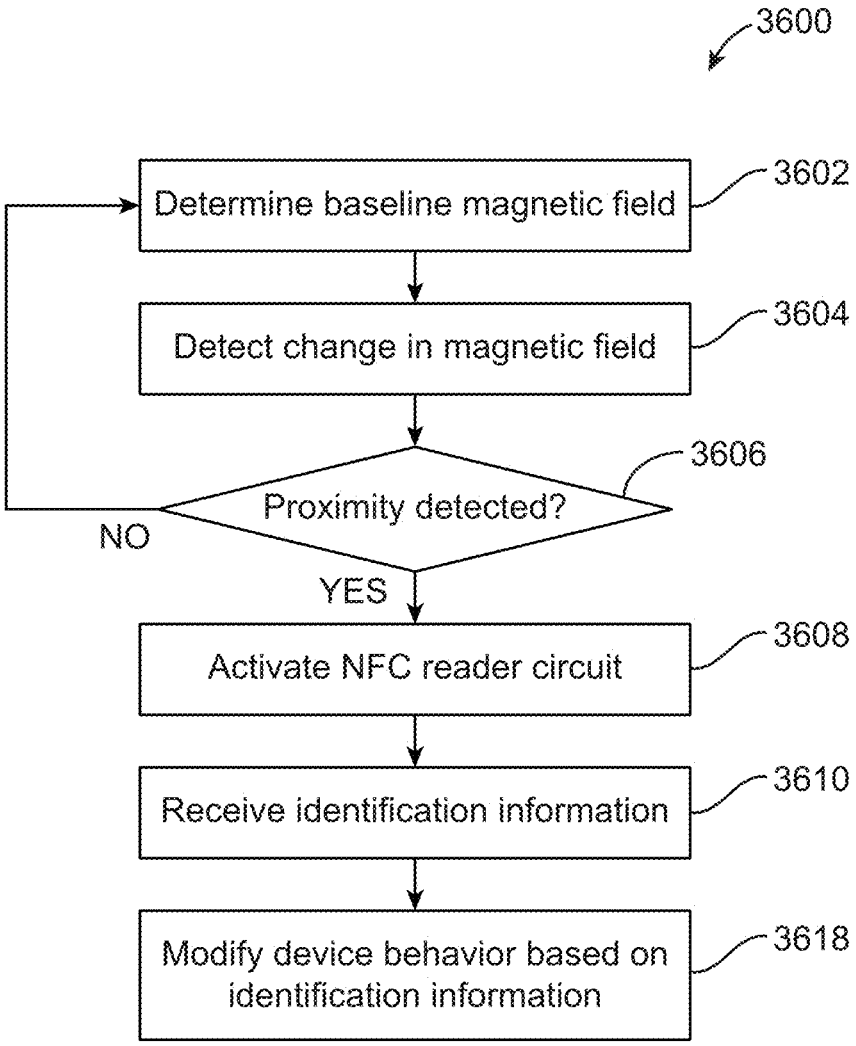
FIG. 40 shows a flow diagram of a process that can be implemented in a portable electronic device according to some embodiments.

FIG. 40 shows a flow diagram of a process 3600 that can be implemented in portable electronic device 5004 according to some embodiments. In some embodiments, process 3600 can be performed iteratively while portable electronic device 5004 is powered on. At block 3602, process 3600 can determine a baseline magnetic field, e.g., using magnetometer 5080. At block 3604, process 3600 can continue to monitor signals from magnetometer 5080 until a change in magnetic field is detected. At block 3606, process 3600 can determine whether the change in magnetic field matches a magnitude and direction of change associated with alignment of a complementary magnetic alignment component. If not, then the baseline magnetic field can be updated at block 3602. If, at block 3606, the change in magnetic field matches a magnitude and direction of change associated with alignment of a complementary alignment component, then at block 3608, process 3600 can activate the NFC reader circuitry associated with NFC coil 5060 to read an NFC tag of an aligned device. At block 3610, process 3600 can receive identification information read from the NFC tag. At block 3612, process 3600 can modify a behavior of portable electronic device 5004 based on the identification information, for example, generating a color wash effect as described above. After block 3612, process 3600 can optionally return to block 3602 to provide continuous monitoring of magnetometer 5080. It should be understood that process 3600 is illustrative and that other processes can be performed in addition to or instead of process 3600.

It is well understood that the use of personally identifiable information should follow privacy policies and practices that are generally recognized as meeting or exceeding industry or governmental requirements for maintaining the privacy of users. In particular, personally identifiable information data should be managed and handled so as to minimize risks of unintentional or unauthorized access or use, and the nature of authorized use should be clearly indicated to users.

The above description of embodiments of the invention has been presented for the purposes of illustration and description. It is not intended to be exhaustive or to limit the invention to the precise form described, and many modifications and variations are possible in light of the teaching above. The embodiments were chosen and described in order to best explain the principles of the invention and its practical applications to thereby enable others skilled in the art to best utilize the invention in various embodiments and with various modifications as are suited to the particular use contemplated. Thus, it will be appreciated that the invention is intended to cover all modifications and equivalents within the scope of the following claims.

What is claimed is:

1. An attachable wallet comprising:

a back panel, wherein the back panel has a passage from an outside surface of the back panel to an interior compartment;

a front panel, wherein the back panel and the front panel are attached along two sides and a bottom of the attachable wallet thereby forming a throat at a top of the attachable wallet, the throat providing access to the interior compartment; and a subassembly in the back panel, the subassembly comprising:

a metallic shunt; and a magnet array between the outside surface of the back panel and the metallic shunt, wherein magnets in the magnet array laterally and circumferentially surround the passage through the back panel.

2. The attachable wallet of claim 1 wherein the magnet array attaches the attachable wallet to a surface of an electronic device.

3. The attachable wallet of claim 2 further comprising an alignment magnet to align the attachable wallet in a specific orientation relative to the surface of the electronic device.

4. The attachable wallet of claim 3 wherein the metallic shunt comprises a spring tab biased towards the interior compartment.

5. The attachable wallet of claim 4 wherein the back panel further comprises a ferrite and a near-field communication circuit, wherein the ferrite is attached to the metallic shunt and the ferrite is between the near-field communication circuit and the metallic shunt.

6. The attachable wallet of claim 5 wherein the front panel comprises a shield layer, where the shield layer includes a ferrite layer and a metal layer.

7. An attachable wallet comprising:

a back panel having a passage from an outside surface of the back panel to an interior compartment;

a front panel, wherein the back panel and the front panel are attached along two sides and a bottom of the attachable wallet thereby forming a throat at a top of the attachable wallet, the throat providing access to the interior compartment; and a subassembly in the back panel, the subassembly comprising:

a metallic shunt comprising a spring tab extending from the metallic shunt towards the interior compartment;

a magnet array between the outside surface of the back panel and the metallic shunt, wherein the magnet array attaches the attachable wallet to a surface of an electronic device, wherein magnets in the magnet array laterally and circumferentially surround the passage through the back panel; and an alignment magnet between the outside surface of the back panel and the metallic shunt, the alignment magnet to align the attachable wallet to the surface of the electronic device.

8. The attachable wallet of claim 7 wherein the metallic shunt is formed of stainless steel and the spring tab is stamped from the metallic shunt and biased towards the interior compartment.

9. The attachable wallet of claim 8 wherein the back panel further comprises a ferrite and a near-field communication circuit, wherein the ferrite is attached to the metallic shunt and the ferrite is between the near-field communication circuit and the metallic shunt.

10. The attachable wallet of claim 9 wherein the ferrite is formed of a plurality of layers of ferritic material.

11. An attachable wallet comprising:

a front panel comprising a shield layer, the shield layer comprising:

a ferritic layer;

a first adhesive layer; and a metal layer attached to the ferritic layer by the first adhesive layer; and a back panel, wherein the back panel and the front panel are stitched together along two sides and a bottom of the attachable wallet thereby forming a throat at a top of the attachable wallet, the throat providing access to an interior compartment, the back panel comprising:

a metallic shunt supporting a spring tab, the spring tab extending from the metallic shunt towards the interior compartment; and an attachment feature arranged to attach the attachable wallet to a surface.

12. The attachable wallet of claim 11 further comprising:

an alignment feature to align the attachable wallet to the surface.

13. The attachable wallet of claim 12 wherein the attachment feature comprises a magnet array.

14. The attachable wallet of claim 13 wherein the alignment feature is a magnet.

15. The attachable wallet of claim 14 wherein the back panel has a passage from an outside of the back panel to the interior compartment.

16. The attachable wallet of claim 15 wherein the magnet array is attached to the metallic shunt and laterally and circumferentially surrounds the passage through the back panel.

17. The attachable wallet of claim 11 wherein the shield layer further comprises a protective layer over the ferritic layer.

18. The attachable wallet of claim 17 wherein the protective layer is formed of a polyester.

19. The attachable wallet of claim 17 further comprising a liner and a second adhesive layer to attach the metal layer to the liner.

20. The attachable wallet of claim 19 wherein the liner is formed of taffeta.

* * * * *